US010563487B2

(12) United States Patent
Campbell et al.

(10) Patent No.: US 10,563,487 B2
(45) **Date of Patent: *Feb. 18, 2020**

(54) SYSTEM AND RELATED METHODS FOR FRACKING AND COMPLETING A WELL WHICH FLOWABLY INSTALLS SAND SCREENS FOR SAND CONTROL

(71) Applicant: SC ASSET CORPORATION, Calgary (CA)

(72) Inventors: Sean P. Campbell, Airdrie (CA); Daniel Rojas, Cypress, TX (US)

(73) Assignee: SC ASSET CORPORATION, Calgary, Alberta (CA)

( * ) Notice: Subject to any disclaimer, the term of this patent is extended or adjusted under 35 U.S.C. 154(b) by 53 days.

This patent is subject to a terminal disclaimer.

(21) Appl. No.: 15/900,382

(22) Filed: Feb. 20, 2018

(65) Prior Publication Data

US 2018/0320488 A1 Nov. 8, 2018

Related U.S. Application Data

(63) Continuation of application No. 15/607,640, filed on May 29, 2017, now Pat. No. 9,976,394.

(30) Foreign Application Priority Data

May 5, 2017 (CA) ..... 2966123

(51) Int. Cl.
*E21B 43/08* (2006.01)
*E21B 43/10* (2006.01)
(Continued)

(52) U.S. Cl.
CPC ..... *E21B 43/10* (2013.01); *E21B 43/08* (2013.01); *E21B 43/25* (2013.01); *E21B 43/261* (2013.01); *E21B 43/00* (2013.01)

(58) Field of Classification Search
CPC ..... E21B 43/08; E21B 43/10
See application file for complete search history.

(56) References Cited

U.S. PATENT DOCUMENTS 4,043,392 A 8/1977 Gazda
4,436,152 A 3/1984 Fisher, Jr. et al.
(Continued)

FOREIGN PATENT DOCUMENTS

CA 2842568 A1 5/2014
CA 2867207 10/2014
(Continued)

OTHER PUBLICATIONS

ISA/CA CIPO—International Search Report and Written Opinion of the International Searching Authority for PCT/CA2017/050650.

*Primary Examiner* — Taras P Bemko
(74) *Attorney, Agent, or Firm* — D. Doak Home

(57) ABSTRACT

A system and method for successively fracking a wellbore at spaced intervals along tubing having therein frac ports each openably closed by a sliding sleeve. The system has at least one actuation member and at least one cylindrical sand screen sub insertable into the tubing. Each actuation member has a collet sleeve with a radially-outwardly biased protuberance of a first profile configured to matingly engage an interior groove profile on at least one of the sliding sleeves and slide the sliding sleeve downhole to open the corresponding port. Each cylindrical sand screen sub has a dissolvable plug member or burst plate disposed on one end thereof allowing for the sand screen to be forced into the well by pressure acting against the plug or plate, and has a resiliently-outwardly biased protuberance configured for engaging a mating profile on the tubing and retaining the sand screen sub in a desired position.

26 Claims, 53 Drawing Sheets

(51) Int. Cl.

| | |
|---|---|
| ***E21B 43/25*** | (2006.01) |
| ***E21B 43/26*** | (2006.01) |
| *E21B 43/00* | (2006.01) |

(56) References Cited

U.S. PATENT DOCUMENTS

| | | | |
|---|---|---|---|
| 4,723,606 | A | 2/1988 | Vinzant et al. |
| 4,893,678 | A | 1/1990 | Stokley et al. |
| 4,896,721 | A | 1/1990 | Welch |
| 5,305,833 | A | 4/1994 | Collins |
| 5,309,988 | A | 5/1994 | Shy et al. |
| 5,730,224 | A | 3/1998 | Williamson et al. |
| 7,325,617 | B2 | 2/2008 | Murray |
| 7,552,779 | B2 | 6/2009 | Murray |
| 8,215,411 | B2 | 7/2012 | Flores et al. |
| 8,365,824 | B2 | 2/2013 | Phillips |
| 8,395,879 | B1 | 3/2013 | Gorst et al. |
| 8,869,903 | B2 | 10/2014 | Thomas et al. |
| 2003/0173089 | A1 | 9/2003 | Westgard et al. |
| 2004/0118564 | A1 | 6/2004 | Themig et al. |
| 2013/0068484 | A1 | 3/2013 | Themig et al. |
| 2013/0081827 | A1 | 4/2013 | Etzel |
| 2013/0299200 | A1 | 11/2013 | Hughes et al. |
| 2014/0102709 | A1 | 4/2014 | Arabskyy |
| 2014/0209306 | A1 | 7/2014 | Hughes et al. |
| 2014/0246207 | A1 | 9/2014 | Hofman et al. |
| 2015/0218916 | A1 | 8/2015 | Richards et al. |
| 2015/0226034 | A1 | 8/2015 | Jani |
| 2016/0061011 | A1 | 3/2016 | Ireland |
| 2016/0097257 | A1 | 4/2016 | Jani |
| 2016/0108711 | A1 | 4/2016 | Lynk |
| 2016/0312580 | A1 | 10/2016 | Nordheimer |
| 2017/0198543 | A1 | 7/2017 | Nordheimer et al. |
| 2017/0314370 | A1* | 11/2017 | Bruce ..... E21B 33/1277 |

FOREIGN PATENT DOCUMENTS

| | | | |
|---|---|---|---|
| CA | 2904470 | A1 | 11/2015 |
| CA | 2879044 | C | 4/2016 |
| CA | 2916982 | A1 | 6/2017 |
| WO | 2013048810 | A1 | 4/2013 |

* cited by examiner

SYSTEM AND RELATED METHODS FOR FRACKING AND COMPLETING A WELL WHICH FLOWABLY INSTALLS SAND SCREENS FOR SAND CONTROL

CROSS-REFERENCE

This application is a continuation of U.S. patent application Ser. No. 15/607,640 filed May 29, 2017, which claims the benefit of priority from Canadian Patent Application No. 2,966,123 filed May 5, 2017, which is hereby incorporated by reference in its entirety.

FIELD OF THE INVENTION

The present invention relates to methods for completing a well within a hydrocarbon formation in order to ready the well for hydrocarbon production, and more particularly relates to methods for fracking a wellbore within a hydrocarbon formation which additionally provides for a sand screen to be flowably installed within the wellbore after the frac string has been inserted in the wellbore, for sand control, without having to trip out the frac string and insert a production string with sand screens. A system for doing the foregoing is further taught and claimed.

BACKGROUND OF THE INVENTION AND DESCRIPTION OF THE PRIOR ART

After an oil or gas well is drilled within an underground hydrocarbon formation, the zones of interest need to be completed prior to production commencing. Part of the completion process typically includes a fracking operation which involves injection of high pressure fluids into the reservoir to initiate fractures within the surrounding rock to increase porosity of "tight" formations and thereby increase the ability of hydrocarbons within the formation to flow into the wellbore and thereafter be pumped to surface.

Fracking operations for completing a well within a reservoir may increase production from the well by many multiples in a given time period, in some cases up to 3× or greater if conducted over the entire length of a horizontal wellbore than what would otherwise have been the case if a fracking operation had not been completed.

Accordingly, the fracking process can be a very important and critical step in preparing a wellbore for production. It is important, however, to be able to frack and complete a wellbore and ready it for production as quickly and efficiently as possible since delay further increases the expense of providing equipment such as tanker trucks for transporting frac fluid to site and remaining "on site" while frac fluid is drawn from such trucks and injected downhole, as such frac trucks typically charge at an hourly rate, to say nothing of the revenue lost arising from the delay in the well coming "on line".

In the stimulation/fracking of directional and horizontal wells, it can be desirable to treat multiple stages in a single zone, known as a cluster, with a single fracture stimulation. It can also be desirable to treat more than one zone with a single fracture stimulation to save time and expense associated with multiple treatments and time spent running tubing and tools in and out of the wellbore.

Various prior art downhole tools and systems exist and have been used to stimulate wells by permitting treatment/fracturing in multiple contiguous regions within a single zone.

Many of such tools and systems require complex valving components within a wellbore to selectively/successively open certain ports for fracking, and thereafter open and frac at all ports along the wellbore. As a result, to the extent such systems or remnants thereof remain in the wellbore when production commences, such disadvantageously restrict flow of hydrocarbons through and thus production of hydrocarbons from, the wellbore.

Also disadvantageously, such prior art systems, to the extent that remnants of the valving remain in the wellbore when production commences, such accordingly reduce the diameter of a downhole pump which may be inserted in the wellbore when the well goes "on line" and thus require the use of smaller diameter pumps which thereby undesirably limit the rate at which hydrocarbons, typically oil, can be produced from the well.

As well, due to complex configuration and multiplicity of mechanisms to open frac ports, numerous flow restrictions exist within tubing and thus numerous pressure drops are caused occur along the length of the tubing, which result in less efficient fracking as there is greater pressure loss incurred prior to the fracture fluid contacting the zone. Ideally, less pressure drop is desired to conduct a fracture stimulation more efficiently in each stage, to avoid having to use oversize frac injection pumps.

To avoid the aforesaid problems, resort is often had to milling out of some or all of the frac port opening/closing components prior to being able to commence production flow from the hydrocarbon bearing zones. These processes are not only expensive, but time consuming as well.

It is thus desirous to have fewer or no materials/components to mill out within the bore liner, in order to be able to immediately after fracking be able to commence production from the hydrocarbon bearing zones.

Numerous patents and pending patent applications exist related to apparatus and systems for opening a plurality of ports in a liner within a wellbore at multiple contiguous locations therealong, to thereby permit injection of a fluid from such liner into a hydrocarbon formation, for the purpose of fracturing the formation and conditioning the formation at such locations.

For example, U.S. Pat. No. 8,215,411 teaches a plurality of opening sleeve/cluster valves along a liner for wellbore treatment, and utilizes a ball member or plug to open a sleeve at each valve thereby allowing fluid communication between the bore and a port in the sleeve's housing. This invention requires, however, a ball seat corresponding to each sleeve in a cluster valve, potentially restricting flow. The presence of a ball seat at each valve to be opened, due to the resulting bore restriction at each valve sleeve, creates a significant pressure drop across the cluster valve assembly.

U.S. Pat. No. 8,395,879 teaches a hydrostatically powered sliding sleeve. Again, such configuration utilizes a single ball, but each sliding sleeve configuration requires its own ball seat, and the balls need to later be pumped out.

U.S. Pat. No. 4,893,678 discloses a multiple-set downhole tool and method that utilizes a single ball. Again, each valve requires a seat which is integral with a sliding sleeve, and which remains with each valve/port. When the sleeve/seat is forced by the ball to slide and thereby open the port, collet fingers may then move radially outwardly, disengaging the ball and allowing the ball to further travel downhole to actuate (open) further ports.

US Patent Application Publication No. 2014/0102709 discloses a tool and method for fracturing a wellbore that uses a single ball, each valve with a deformable ball seat. Again, each valve has a valve seat which remains with each valve/port.

Other patents and published applications avoid the problem of each valve/port having a ball seat which remains with each valve, and provide a dart or ball member which actuates a number of valves/ports. However, such designs are not without their own unique drawbacks.

For example, US 2013/0068484 published Mar. 21, 2013, inter alia in FIG. 6 thereof, (and likewise to same effect US 2004/0118564 published Jun. 24, 2004, likewise in FIG. 6 thereof) teaches an axially movable sliding sleeve 322 which is capable of actuating (i.e. opening) a number of downhole port sleeves 325*a*, 325*b* to thereby open corresponding respective downhole ports 317*a*, 317*a*' which are normally covered by port sleeve 325*a*, and similarly subsequently open respective downhole ports 317*b*, 317*b*' normally covered by port sleeve 325*b*. Sliding sleeve 322 is mounted by a shear pin 350 in the tubing string. Plug/ball 324 is inserted in the tubing, and uphole fluid pressure applied thereto cause plug 324 to travel downwardly in the in the string and abut sliding sleeve 322, further causing shear pin 350 to shear and thus sleeve 322 to then be driven downhole. Spring-biased dogs 351 on outer periphery of sliding sleeve 322 then engage inner profile 353*a* on sliding sleeve 325*a* and cause sleeve 325*a* (due to fluid pressure acting on plug 324) to move downhole thereby opening ports 317*a*, 317*a*'. As noted in paragraph [0071] therein, continued application of fluid pressure causes dogs 351 to collapse, thereby releasing sleeve 322 from engagement with inner profile 353*a* on sliding sleeve 325, and allowing sleeve 322 to further travel downhole and actuate (i.e. open) further sleeves in like manner. Although not expressly mentioned nor shown in US 2013/0068484, seals are necessary around dogs 351 in order to allow creation of a pressure differential when such continued application of fluid pressure is applied, in order to cause collapse of such dogs to allow disengagement with a first sleeve and allow the dart to thereafter further travel downhole for subsequent actuation of additional downhole sleeves and ports. The necessity for seals around dogs 351 necessarily introduces added mechanical complexity and the possibility of inability to release sleeve 322 from engagement if such seals were to leak due to the then-inability to create a pressure differential.

WO 2013/048810 entitled "Multizone Treatment System" published Apr. 4, 2013 teaches a system and method for successively opening flow control devises (which may be sliding sleeves) in a tubing string along a length thereof, commencing with a most downhole valve and opening a sleeve at such location, and by insertion of additional darts progressing successively upwardly in the tubing string to open further uphole sleeves. The tubing string is provided with a plurality of spaced apart flow control devices, such as sliding sleeves, each having an annulary-located recess therein with a unique profile relative to other flow control devices. A first dart, having an engagement feature sized to correspond with a selected annulary-located recess of a particular most-downhole flow control device, is injected, and such dart passes to actuate the flow control device to allow it to open a port. The process is progressively repeated for additional uphole flow control devices by injecting additional darts, having corresponding features to engage a selected flow control device. The darts are then drilled out to allow production from the tubing. Disadvantageously, only one dart can open one port, and thus a plurality of contiguously spaced ports are not capable of being opened by a single dart using such apparatus/method, thereby rendering such system/method time consuming.

CA 2,842,568 entitled "Apparatus and Method for Perforating a Wellbore Casing, and Method and Apparatus for Fracturing a Formation" published May 29, 2014 teaches inter alia dart members similar to the dart of WO 2013/048810, each dart having a protruding spring-biased profile uniquely sized to engage a similarly-sized annular recess on a plurality of downhole sliding sleeves, and thereby open sliding sleeve, with further means being provided on each of such sliding sleeves to allow the single dart member to further travel downhole and open additional sleeves having similar-sized annular recesses. No collet sleeve is provided, and a non-beveled surface on the annular recess of the most downhole sleeve is used to retain the dart from travelling further downhole. Disadvantageously, in comparison to the system as hereinafter described, the configuration of the dart, namely having a spring-biased profile and a cup seal thereon, essentially requires the dart to be virtually solid and thereby permanent obstruction to the wellbore once opening the last of a series of slidable sleeves. If additional uphole sleeves are desired to be actuated using a second dart (having a narrower protruding spring-biased profile than the first dart used), the first dart must be installed using a locator tool and thereafter retrieved, after actuating a plurality of sleeves and associated ports using such tool, as shown in FIGS. 9A-9D. Such a system involves extensive equipment from surface, and the need of a bypass port that need by opened and closed to allow effective operation. These steps and features complicate the operation of such prior art system and add to expense and time.

US Pub. 2016-0097257 (CA 2,867, 207) filed Oct. 2, 2014 entitled "Multi-Stage Liner with Cluster Valves and Method of Use", commonly assigned with the present application, teaches a method and system of flowing a ball and ball seat member downhole, which successively engages and disengages a plurality (cluster) of sliding sleeve members, to thereby successively open frac ports. The sliding sleeve members are initially respectively covering a plurality of longitudinally-spaced frac ports along a tubular liner in a wellbore. The ball and seat member is flowed downhole by application of fluid pressure on an uphole side thereof. The ball and seat member initially engages a sliding sleeve member covering a most uphole frac port, and causes the sliding sleeve member to slide so as to uncover the associated frac port, whereupon the ball and seat member upon continued application of uphole fluid pressure becomes disengaged, and thereafter moves downhole to successively engage and uncover frac ports in a cluster of sliding sleeve members.

US Pub. 2016-0097257 (CA 2,879,044) filed Jan. 22, 2015 entitled "System and Method for Injecting Fluid at Selected Locations along a Wellbore", likewise commonly assigned with the present application, teaches a system and method for selectively actuating sliding sleeves to uncover associated frac ports in a tubular member, using one or more actuating dart members. The dart member may thereafter be coupled to a retrieval tool and when so coupled allows a bypass valve to be opened and disengagement of the dart member from the associated sleeve to allow withdrawing the dart member uphole and from within the tubular member. Specifically, upward movement of the retrieval tool allows a wedge-shaped member on the dart member to disengage the dart member from a corresponding actuated sliding sleeve, to thereby allow the dart member to be withdrawn from the wellbore.

US Pub. 2016-0312580 (CA 2,904,470) filed Apr. 27, 2015 entitled "System for Successively Uncovering Ports along a Wellbore to permit Injection of a Fluid along said Wellbore" having a common inventor and likewise commonly assigned with the present application, teaches a system for moving sleeves to successively uncover a plurality of contiguous ports in a tubing liner within a wellbore which are covered by such sleeves, or for successively uncovering individual groups of ports arranged at different locations along the liner, to allow successive fracking of the wellbore at such locations. Sliding sleeves in the tubing liner are successively moved from a closed position covering a respective port to an open position uncovering such port by an actuation member placed in the bore of the tubing liner and pumped down the tubing liner. The actuation member for moving the sliding sleeves to cause them to open comprises a single collet sleeve, having a dissolvable plug retained in a fixed position within such collet sleeve by shear pins. The collet sleeve has radially-outwardly biased protuberances (fingers) at a downhole end thereof, adapted to and which matingly engage corresponding cylindrical grooves in such sliding sleeves, based on the width of the protuberance. Upon the actuation member actuating all of the desired sleeves and after having actuated the last most downhole sleeve, the shear pin shears thereby allowing the plug in the collet to move downhole in the collet sleeve and thereby prevent the protuberances (fingers) on the collet sleeve from thereafter disengaging the cylindrical groove of the corresponding sliding sleeve, thereby preventing any further progress of the collet sleeve downhole.

U.S. Ser. No. 14/991,597 (CA 2,916,982) filed Jan. 8, 2017 entitled "Collet Baffle System and Method for Fracking a Hydrocarbon Formation", likewise commonly assigned with the present application, teaches a baffle system for progressively fracking or treating a formation via a plurality of longitudinally spaced frac ports along a tubular liner. The baffle members each have a collet finger protuberance thereon of a unique width relative to other baffle members. Each collet finger protuberance on an uphole edge thereof has a chamfer which allows disengagement of the collet finger protuberance and thus removal of the baffle member from the wellbore when the baffle member is pulled uphole by a wireline retrieval tool.

None of the aforesaid patents/publications, however, teach or in any way suggest how such systems or methods could be further adapted to provide not only fracking, but further provide sand control during production without having to trip out the frac string from the wellbore.

Fracking fluid is usually an incompressible liquid for the purpose of fracturing the rock, and may contain various adjuvants such as acids and/or diluents to increase followability of the oil/gas from the formation.

In addition, fracking fluids commonly contain proppants such as fine sand (frac sand) or ceramic beads of consistent and engineered uniform diameter, to uniformly "prop" open the created fractures and maintain such fractures in the formation so that hydrocarbons may better flow from the formation.

As explained below, the introduction of large quantities of frac sand into a formation during the fracking process typically results in significant quantities of frac sand being entrained in the oil or gas which flows back into the wellbore for pumping to surface. Due to the abrasive nature of sand, such results in additional increased and heavy wear on pump components within the well, greatly shortening pump life. Downhole pumps, and even downhole pumps most resistive to sand abrasion such as progressive cavity pumps, are typically expensive, and frequent replacement thereof results in increased costs not only in replacing/refurbishing the pump and its components, but further results in service rig time and costs in having to "trip out" of a well a downhole pump and "run back in" the production string with a new pump, to say nothing of the lost production and profits due to the well being "off line" during the time of such repairs.

Sand screens are known in the art, and are typically inserted within a production string, after the tripping out of the frac string from the well. The production string is then separately "run in" wellbore.

Disadvantageously, however, the aforesaid two-step process having to frac, trip out the frac string, and then run in a production string with pre-installed sand screens thereon results in considerable additional time and expense in tripping out the frac string, and thereafter running in the production string with elongate cylindrical screens installed thereon. There is also an inherent risk of damaging the screens during "run in" of the production string in the wellbore.

A more efficient system which allows not only fracking, but further immediately thereafter allows production and sand control during such production, without having to trip out a frac string, would be very beneficial to the wellbore completion industry.

The above-background information and description of prior publications is provided for the purpose of making known information believed by the applicant to be of possible relevance to the present invention. No admission is necessarily intended nor should be construed, that any of the below publications and information provided below constitutes prior art against the present invention.

SUMMARY OF THE INVENTION

It is an object of the invention that sand from a hydrocarbon formation, and additional sand resulting from conducting a fracking operation along a wellbore within the formation, be prevented to a greater degree from entering a wellbore during production operations and otherwise detrimentally affecting pumping equipment, to say nothing of increased disposal requirements in respect of such sand.

It is a further object of the invention that a frac string not have to be "tripped out" and a separate production string, with sand screens installed thereon at surface, be thereafter "run in" to the well, in order to commence production from the well after fracking operations.

It is a further object of the invention that fracking be able to be completed without the impediment of, or potential damage to, sand screens, and without having to "trip out" the frac string and "run in" a production string, with sand screens installed thereon at surface.

It is a further object of the invention to provide a system and method which reduces instances of damage being inflicted to sand screens when they are positioned within a wellbore downhole.

It is a still further object to be able to immediately after fracking, and prior to the frac string having to be "tripped out" of the well, provide frac screens at the locations of the frac ports and fractures in the well, to immediately thereafter prevent, as much as possible, the ingress of sand into the wellbore and the deleterious results which occur therefrom.

Reference herein and below to "uphole" and "downhole" with regard to a particular component of the system, or with respect to the method of the present invention, is a reference to a location on the component within a wellbore where uphole means in the direction of the surface along a wellbore, and "downhole" is the correspondingly opposite direction towards a toe of the wellbore.

Reference herein and below and herein to an element in the singular, such as by use of the article "a" or "an" is not intended to mean "one and only one" unless specifically so stated, but rather "one or more". In addition, where reference to "fluid" is made, such term is considered meaning all liquids and gases having fluid properties.

Accordingly, in order to meet some or all of the above objects, in a first broad embodiment the present invention comprises a system for fracking a hydrocarbon formation at a given location along a wellbore and installing a sand screen after fracking at said location, for sand control during subsequent production from the fracked formation, comprising;

a tubular liner insertable within said wellbore and having an interior bore, further comprising:

(a) a plurality of spaced-apart frac ports longitudinally spaced at intervals along said tubular liner, providing, when open, fluid communication between the interior bore of the tubular liner and an exterior of the tubular liner;

(b) a corresponding plurality of cylindrical hollow sliding sleeve members, each configured in an initial closed position to cover a corresponding of said frac ports and prevent flow of fluid from the interior bore to an exterior of the tubular liner, and slidably moveable longitudinally in the interior bore to an open position to uncover said corresponding of the frac ports, each sliding sleeve member initially covering a respective of said plurality of frac ports so as to prevent flow of a fluid from within the interior bore to the exterior of the tubular liner, each of the sliding sleeve members having an interior circumferential groove profile therein of a given longitudinal width; and (c) a plurality of shear members, initially securing respectively said slidable sleeve members to the tubular liner in the initial closed position thereof, and sheareable when a longitudinal force is applied thereto to thereafter allow longitudinal slidable movement of respective of said slidable sleeve members;

at least one actuation member, insertable within the interior bore of the tubular liner, comprising:

(a) a cylindrical hollow collet sleeve, having a radially-outwardly biased protuberance on a periphery thereof having a first profile, said radially-outwardly biased protuberance configured to matingly engage said interior circumferential groove profile on at least one of the plurality of sliding sleeve members;

(b) a burst plate, dissolvable plug member, or a seating surface configured to provide a sealing surface against which a dissolvable plug member may abut, which burst plate, plug member, or sealing surface in combination with said plug member, at least for a limited time prevents pressurized fluid injected downhole in said interior bore from travelling past said actuation member in said tubular liner thereby allowing said actuation member to be flowed downhole by said pressurized fluid;

at least one cylindrical sand screen sub, insertable within the interior bore of said tubular liner and displaceable within said tubular liner to a location therein proximate a one of said frac ports in said tubular liner whose corresponding sliding sleeve member has been uncovered by said actuation member, said at least one sand screen sub comprising:

(a) a cylindrical hollow member having at an uphole end thereof a dissolvable plug member or burst plate which at least for a limited time substantially obstructs passage of fluid within said interior bore thereby causing pressurized fluid injected downhole in said bore of said tubular liner to force said sand screen sub downhole in said tubular liner;

(b) a cylindrical, longitudinally-extending oil-permeable screen mesh forming a portion of an outer periphery of said sand screen sub downhole from said dissolvable plug member or burst plate thereon, which screen mesh when said sand screen sub is located proximate said one of said frac ports, underlies said one of said frac ports and prevents ingress of sand but permits ingress of oil, from said formation into the interior bore via said one of said frac ports; and (c) a resiliently outwardly biased retaining member, which engages, directly or indirectly, said tubular liner when said sand screen sub has flowed down said tubular liner to said one of said frac ports whose corresponding sliding sleeve member has been opened and to a position within the tubular liner wherein the screen mesh of said sand screen sub underlies said one of said frac ports, which retaining member after engagement with said tubular liner prevents uphole displacement of said sand screen sub in said tubular liner.

Advantageously, as may be now understood by a person of skill in the art, the tubing liner and associated sliding sleeve members which are uncovered after the fracking operation need not be tripped out of the wellbore and a production tubing liner, having sand screens installed thereon at surface, thereafter run into the wellbore in order to commence production.

Instead, and advantageously, the opened frac port in the above system may immediately, after fracking and insertion of the sand screen subs into the tubing liner, then be used to allow flow of oil from the fracked formation into the tubing liner, substantially screened of sand. Such oil, screened of sand and substantially sand-free, may then be pumped to surface, and such pumping equipment thereby enjoying greater life due to the reduced quantities of abrasive sand in the oil being pumped to surface.

In a first refinement, to ensure that the sand screen sub may flow downhole in the tubular liner to the desired position beneath a desired (typically lowermost) opened frac port, the resiliently outwardly biased retaining member on said at least one sand screen sub has a chamfer on a downhole side edge thereof and a flat face on an uphole side edge thereof perpendicularly disposed to a longitudinal axis of said tubular liner. Downhole movement of said at least one sand screen sub in said tubular liner is allowed by fluid pressure being exerted on an uphole side of said sand screen sub forcing said chamfer on said downhole edge against a portion of the tubing liner, thereby causing said resiliently outwardly biased retaining member to become radially depressed and thereby allowing continued downhole movement. In contrast, uphole movement of said sand screen sub is prevented by said flat face engaging, indirectly or indirectly, an annular region in said tubular liner.

To ensure each of the sliding sleeves, which have uncovered a corresponding frac/production port, remain open during production, in a preferred embodiment each of the sliding sleeve members, and the tubular liner at a location proximate each of said frac ports, have mating engagement means which become respectively lockingly engaged when said sliding sleeve members are each respectively moved to said open position, to thereby retain said sliding sleeve members, once in said open position, from thereafter returning to a closed position. In preferred embodiments the mating engagement means on said sliding sleeve members comprises a plurality of collet fingers, radially outwardly biased, and extending from a downhole end of each sliding sleeve member, and said mating engagement means on said tubular liner comprises an annular circumferential ring on said tubular member, which when said slidable sleeve member travels to said open position, said collet fingers thereof matingly engage said annular circumferential ring on said sliding sleeve member.

In a preferred embodiment, the mating engagement means on the sliding sleeve members may take the form of a radially-outwardly biased collet finger (protuberance) having a profile of width W2, and the mating engagement means on the sliding sleeve member take the form of an interior circumferential groove of a width or profile corresponding to that of the radially outwardly biased protuberance, to allow mating engagement thereof so as to allow the sliding sleeve members to be moved by the one or more actuation members to the open position. Other mating engagement means, such as a resiliently-biased lock ring, are well known and will now be apparent to a person of skill in the art.

In an alternative or additional further refinement, the profile of the radially outwardly biased protuberance on the actuation member may similarly comprise a raised collet profile of a width W2, and the interior circumferential groove profile of given longitudinal width on one of said sliding sleeve members comprises a mating circumferential groove of a width equal to or greater than W2.

In a further embodiment of the system of the present invention, a plurality of actuation members [i.e. at least a second (additional) actuation member) may be used, wherein each actuation member possesses a radially-outwardly biased protuberance having a unique profile, which is adapted to matingly engage a similarly unique profile/interior circumferential groove or grooves) on a desired one of the sliding sleeve members, so that each actuation member engages only one sliding sleeve member, and causes when engaged with the particular unique sliding sleeve member such sleeve member to uncover an associated frac/production port.

Accordingly, in one embodiment of such further refinement, each one or all of the aforesaid systems may further comprise:

a second actuation member, insertable within the interior bore of the tubular liner, comprising:

(a) a cylindrical hollow collet sleeve, having a radially-outwardly biased protuberance on a periphery thereof having a second profile of width W1, where W1<W2, said radially-outwardly biased protuberance configured to matingly engage said interior circumferential groove profile on another of the plurality of sliding sleeve members, having a width equal to or greater than W1 but less than W2;

(b) a burst plate, dissolvable plug member, or a seating surface situated at an uphole end of said collet sleeve configured to provide a sealing surface against which a dissolvable plug member may abut, which burst plate, plug member, or plug member and sealing surface are situated at an uphole end of said collet sleeve and at least for a limited time prevent pressurized fluid injected downhole in said interior bore from travelling past said actuation member in said tubular liner;

a second sand screen sub, insertable within the interior bore of said tubular liner comprising:

(a) a cylindrical hollow member having at an uphole end thereof a dissolvable plug member or burst plate which at least for a limited time substantially obstructs passage of fluid within said interior bore thereby causing pressurized fluid injected downhole in said bore of said tubular liner to force said sand screen sub downhole in said tubular liner;

(b) a cylindrical, longitudinally-extending oil-permeable screen mesh forming a portion of an outer periphery of said second sand screen sub downhole from said dissolvable plug member or burst plate thereon, which screen mesh when said sand screen sub is located proximate said one of said frac ports, underlies said one of said frac ports and prevents ingress of sand but permits ingress of oil, from said formation into the interior bore via said one of said frac ports; and (c) a retaining member on said cylindrical hollow member, which engages, directly or indirectly, said tubular liner when said second sand screen sub has flowed down said tubular liner to another of said frac ports whose corresponding sliding sleeve member has been opened on said tubular liner by said second actuation member to a position wherein the screen mesh of said sand screen sub underlies said another of said frac ports, which retaining member after engagement with said tubular liner prevents uphole displacement of said second sand screen sub in said tubular liner.

In one embodiment, the radially-outwardly biased protuberance on the actuation member is configured such that after matingly engaging said interior circumferential groove profile on at least one of the plurality of sliding sleeve members, such radially-outwardly biased protuberance on said actuation member remains lockingly engaged with said interior circumferential groove profile on said slidable sleeve and said actuation member is thereby prevented from further downhole movement within said tubular liner.

In such above embodiment, after said actuation member has moved a most downhole of said sliding sleeves to an open position uncovering said corresponding frac port, and said sand screen sub flowed downhole to underlie the uncovered frac port, further movement of said at least one sand screen sub downhole in said tubing liner is prevented by said sand screen sub abutting said actuation member.

Alternatively, rather than using a plurality of uniquely-configured actuation members to each engage uniquely configured individual sliding sleeve members and thereafter frac the reservoir at the particularly location of the opened port, it may be desired to frac a particular zone within a formation wherein such zone extends along a region of the wellbore having a plurality (cluster) of frac/production ports. In may be thus desired to have a single actuation member instead successively engage and cause a plurality of sliding sleeve members to uncover a corresponding plurality of associated frac/production ports, frac at such opened frac ports, and thereafter install sand screen subs at each opened frac port, before then inserting a differently configured additional actuation member to open an (or plurality of) additional frac port(s).

Accordingly, in such configuration the system employs a single actuation member, which is capable of engaging a first sleeve and causing the first sleeve to open its associated frac port, disengage the sliding sleeve member and further move downhole to similarly engage additional sliding sleeves and open additional frac ports.

Accordingly, in a further refinement, to provide for a system of such a configuration, in a first broad embodiment of such a system further comprises providing the radially-outwardly biased protuberance on the collet sleeve of the actuation member with a chamfer on a downhole side thereof. Upon the radially-outwardly biased protuberance engaging the interior circumferential groove profile in the at least one sliding sleeve member and the at least one sliding sleeve member being moved downhole to open said desired frac port and further fluid pressure applied uphole to said actuation member, the chamfer engages a downhole side edge of the circumferential groove within the respective sliding sleeve and the radially-outwardly biased protuberance thereafter becomes disengaged from mating engagement in the circumferential groove thereby allowing said actuation member to disengage from the respective sliding sleeve (now in an open position) and continue moving downhole to successively engage one or more additional sliding sleeve members and open corresponding additional frac ports.

In such further refinement, the at last one sand screen sub comprises a plurality of sand screen subs, and when inserting sand screen subs, it will be necessary that each sand screen sub, on the retaining member thereof, possess a "keying" feature, so that each sand screen sub will only become installed at a particular successive downhole location. Otherwise, in absence of such "keying" feature, when flowing a first sand screen sub downhole after uncovering the ports and after having completed the fracking operation for the cluster of opened frac ports, such first sand screen sub would lockingly engage the tubing liner at the most uphole location of an opened port, and further successive sand screen subs would not be able to be flowed downhole to provide sand control for other (more downhole) uncovered frac ports.

Accordingly, in a further refinement of the aforesaid further refinement, the at least one sand screen sub comprises a plurality of sand screen subs, and:

the retaining member on each sand screen sub possesses a unique profile; and the tubular liner, proximate each frac port, possesses an annular region of a corresponding unique profile or width;

wherein the retaining member of each sand screen sub, when said one of said sand screen subs is flowed down the tubular liner, will only engage the tubular liner at a particular annular region along the tubing liner, and the retaining member thereof after engagement with said interior circumferential groove or grooves, thereafter prevents further displacement of said sand screen sub from said position in said tubular liner.

In a refinement, the retaining member on each sand screen sub is of a unique width relative to a width of a retaining member on another of said sand screen subs; and wherein a retaining member of width "$X_2$" on a first sand screen sub inserted downhole is of a greater width than a width $X_1$ of a retaining member on a second sand screen sub thereafter subsequently inserted downhole in said tubular liner; and said retaining member on said first sand screen sub matingly engages a corresponding annular region in said tubular liner of an equal or greater width $X_2$; and said retaining member on said second sand screen sub matingly engages a corresponding annular region of width $\geq X_1$ but $< X_2$, located uphole in said tubular liner.

In one embodiment of the above systems, the actuation member may further of a material or composition such that it is dissolvable, upon a corrosive fluid being flowed into and applied to the interior bore of the tubular liner.

In a further broad aspect of the invention, the invention comprises a method for conducting a fracking procedure at least one location along a wellbore situated within a hydrocarbon formation, and thereafter installing a sand screen within a tubular liner within said wellbore to prevent ingress of sand into said tubular liner.

In such aspect of the invention, the invention comprises a method comprising the steps of:

(i) locating a tubular liner having:
  a hollow interior bore;
  a plurality of frac ports spaced along a periphery of said tubular liner;
  a corresponding plurality of sliding sleeve members respectively initially covering each of said frac ports;
within said wellbore;

(ii) situating a first actuation member having a resiliently outwardly biased protuberance of a first profile, within said tubular liner;

(iii) applying a pressurized fluid to an uphole end of said first actuation member and causing said first actuation member to flow downhole and to a position in said tubular liner where said radially outwardly-biased protuberance thereon engages a mating profile on one of said plurality of sliding sleeve members;

(iv) continuing to apply said pressurized fluid to said tubular liner and causing said one sliding sleeve member and actuation member to together move downhole and uncover and thereby open an associated of said frac ports in said tubular liner and thereby allow fluid communication from said interior bore to an exterior of said tubular liner and said hydrocarbon formation via the opened associated frac port;

(v) injecting a fracking fluid into said tubular liner and causing said frac fluid to flow into the hydrocarbon formation via the opened frac port;

(vi) inserting a first sand screen sub into said tubular liner, said first sand screen sub having:
  a resiliently-outwardly biased protuberance having a given profile; and
  an annular screen mesh about an outer periphery of said first sand screen sub; and (vii) applying a pressurized fluid to an uphole end of said first sand screen sub and causing said first sand screen sub to flow downhole to a position in said tubular liner where said annular screen mesh thereof underlies said open frac port and causing said profile of said resiliently-outwardly biased protuberance thereon to engage a mating profile on an interior of said tubular liner and thereby retain said first sand screen sub in a position wherein the annular screen mesh thereof underlies said open frac port.

In a further refinement of the above method, such method may further comprise the step, after step (iv) or step (v), of injecting pressurized fluid into said interior bore at a pressure sufficient to rupture a burst disk member located on said actuation member, so as to thereafter allow fluid to flow through said actuation member.

In a further or alternative refinement of the above method comprising steps (i)-(vii), such method may further comprise the step after step (vii) of injecting pressurized fluid into said interior bore at a pressure sufficient to rupture a burst disk member located on said sand screen member, so as to thereafter allow fluid to flow through said sand screen member.

In a further or alternative refinement of the above method comprising steps (i)-(vii), such method may further comprise the step, at some time after step (iv), of dissolving a plug member in said actuation member to allow subsequent flow of fluid through said actuation member after said actuation member has moved said sliding sleeve downhole and thereby opened said associated frac port. The step of dissolving said plug member further comprises flowing a corrosive fluid down said tubular liner to said actuation member.

In a further or alternative refinement of the above method comprising steps (i)-(vii), such method may further comprise the step after step (vii) of exposing said sand screen sub to a corrosive fluid so as to dissolve a portion of said sand screen sub so as to thereafter allow fluid to flow longitudinally through said sand screen sub.

In a further or alternative refinement of the above method comprising steps (i)-(vii), such method may further comprise the step at some time after step (iv) of flowing a corrosive fluid into said interior bore and causing said actuation member to dissolve.

In a further or alternative refinement of the above method comprising steps (i)-(vii), when said first actuation member engages said one sliding sleeve member and moves said sliding sleeve member to said open position, causing said actuation member to lockingly engage said sliding sleeve member, and said sliding sleeve member to further lockingly engage said tubing liner, thereby preventing further movement of said actuation member within said tubing liner.

The above method comprising steps (i)-(vii) may further, where is desired to conduct a fracking procedure at a plurality of spaced apart locations along said wellbore and installing sand screens within the tubular liner at each of said plurality of locations to prevent ingress of sand into the tubular liner at each of said locations, be modified wherein, after step (vii), such method further comprises carrying out the following further steps:

(viii) situating a second actuation member having a resiliently-outwardly biased protuberance of a second profile thereon different than said first profile, within said tubular liner;

(ix) applying a pressurized fluid to an uphole end of said second actuation member and causing said second actuation member to flow downhole and to a position in said tubular liner where said second profile on said second actuation member engages a corresponding mating profile on a further one of said sliding sleeve members;

(x) continuing to apply said pressurized fluid to said tubular liner and causing said second actuation member and said further one of sliding sleeve member to together move downhole and uncover and thereby open a further associated of said frac ports in said tubular liner and thereby allow fluid communication from said interior bore to an exterior of said tubular liner and said hydrocarbon formation via the further opened frac port;

(xi) injecting a fracking fluid into said tubular liner and causing said frac fluid to flow into the hydrocarbon formation via the further opened frac port;

(xii) situating a second sand screen sub within said tubular liner, said second sand screen sub having a resiliently-outwardly biased protuberance thereon and an annular screen mesh about an outer periphery thereof; and (xiii) applying a pressurized fluid to an uphole end of said second sand screen sub and causing said second sand screen sub to flow downhole to a position in said tubular liner where said screen mesh thereon underlies said further opened frac port, and causing said resiliently-outwardly biased protuberance on said second sand screen sub to engage a mating profile on an interior of said tubular liner proximate said further opened frac port so as to thereby retain said second sand screen sub and said annular screen mesh thereof underlying said further opened frac port.

Preferably in such modified method the resiliently-outwardly biased protuberance of said first actuation member is of a width W2, and said resiliently-outwardly biased protuberance of said second actuation member is of a width W1, wherein W1<W2.

In an alternative method of the present invention, a method is provided for fracking a hydrocarbon formation at a plurality of clustered contiguous locations along a wellbore within said formation using only one actuation member rather than several. Such method is used where it is desired to frac a plurality of group of contiguous locations along a wellbore. Such alternative method comprises the steps of:

(i) locating a tubular liner having:
- a hollow interior bore;
- a plurality of contiguous frac ports spaced along a periphery of said tubular liner;
- a corresponding plurality of sliding sleeve members respectively initially covering each of said frac ports;

within said wellbore;

(ii) situating an actuation member having a radially and resiliently outwardly-biased protuberance of a first profile within said tubular liner, said radially-outwardly biased protuberance having a chamfer on a downhole side thereof;

(iii) applying a pressurized fluid to an uphole end of said actuation member and causing said actuation member to flow downhole and to a position in said tubular liner where said profile thereon engages a corresponding mating profile on a first of said sliding sleeve members;

(iv) continuing to apply said pressurized fluid to said tubular liner and causing said first sliding sleeve member to move further downhole and simultaneously thereby uncover and thereby open a first associated frac port in said tubular liner and allow fluid communication from said interior bore to an exterior of said tubular liner and said hydrocarbon formation via the first opened frac port;

(v) continuing to apply said pressurized fluid to said tubular liner and causing said resiliently-based protuberance, due to said chamfer on a downhole side edge thereof, to become radially inwardly depressed and thereby disengage said profile from said meting engagement with said mating profile on said first sliding sleeve member and thereby permit said actuation member to then further move downhole and said resiliently-biased protuberance thereon to then engage a further corresponding mating profile on a second sliding sleeve member downhole from said first sliding sleeve member;

(vi) continuing to apply said pressurized fluid to said tubular liner and causing said second sliding sleeve member to move further downhole and simultaneously thereby uncover and thereby open a further second frac port in said tubular liner and allow fluid communication from said interior bore to an exterior of said tubular liner and said hydrocarbon formation via the further opened second frac port;

(vii) injecting a fracking fluid into said tubular liner and causing said frac fluid to flow into the hydrocarbon formation via the opened first and second frac ports;

(viii) situating a first sand screen sub within said tubular liner, said first sand screen sub having a resiliently-outwardly biased protuberance having a profile, and said first sand screen sub further having an annular screen mesh about an outer periphery thereof;

(ix) applying a pressurized fluid to an uphole end of said first sand screen sub and causing said first sand screen sub to flow downhole to a position in said tubular liner where said annular screen mesh thereof underlies said second open frac port and causing said profile of said protuberance thereon to engage a mating profile on an interior of said tubular liner and thereby retain said first sand screen sub and said annular screen mesh thereof underlying said second open frac port;

(x) situating a second sand screen sub within said tubular liner, said second sand screen sub having a resiliently-outwardly biased protuberance having a profile different than the profile of the protuberance on said first sand screen sub, and likewise having an annular screen mesh about an outer periphery thereof;

(xi) applying a pressurized fluid to an uphole end of said second sand screen sub and causing said second sand screen sub to flow downhole to a position in said tubular liner where said annular screen mesh thereof underlies said first open frac port, and causing said profile of said protuberance thereon to engage a mating profile on an interior of said tubular liner and thereby retain said second sand screen sub and said annular screen mesh thereof underlying said first open frac port.

The above method comprising steps (i)-(xi) may further comprise the step after step (iv), (vi) or (vii) of injecting pressurized fluid into said interior bore at a pressure sufficient to rupture a burst disk member located on said actuation member so as to thereafter allow fluid to flow through said actuation member.

The above method comprising steps (i)-(xi) with or without the above further modification may further comprise the step after step (vii) of injecting pressurized fluid into said interior bore at a pressure sufficient to rupture a burst disk member located on said sand screen member, so as to thereafter allow fluid to flow through said sand screen member.

The above method comprising steps (i)-(xi) with or without the above further modifications may further comprise the step after step (vii) of exposing said actuation member to a corrosive fluid so as to dissolve a portion of said actuation member so as to thereafter allow fluid to flow through said actuation member.

The above method comprising steps (i)-(xi) with or without the above further modifications may further comprise the step the step sometime after step (vi) of exposing said actuation member to a corrosive fluid so as to dissolve all or substantially all of said actuation member.

The above method comprising steps (i)-(xi) with or without the above further modifications may further comprise the step comprising the step after step (viii) of exposing said first sand screen sub to a corrosive fluid so as to dissolve a portion of said first sand screen sub so as to thereafter allow fluid to flow longitudinally through said first sand screen sub.

The above method comprising steps (i)-(xi) with or without the above further modifications may further comprise the step, after step (x), of exposing said second sand screen sub to a corrosive fluid so as to dissolve a portion of said second sand screen sub so as to thereafter allow fluid to flow longitudinally through said second sand screen sub.

In addition, the above method comprising steps (i)-(xi) with or without the above further modifications may further comprise the step, after step (iv) and step (vi) of allowing a biased protuberance on said sliding sleeve member to, when the first and second sliding sleeve member have respectively uncovered a respective frac port, to engage a mating groove in said tubular member so as to retain, respectively, said first and second sliding sleeve member in a position where a respective associated frac port is uncovered.

In the alternative to the method comprising steps (i)-(xi), an plurality of actuation members may be used, each having a collet finger (radially outwardly biased protuberance thereon) of a unique width or profile. Such method comprises successively uncovering spaced-apart frac ports situated along a hollow tubular liner, carrying out a fracking operation at each uncovered frac port, and installing a sand screen at each of said uncovered frac ports, and in particular comprises the steps of:

(i) locating an actuation member having a resiliently outwardly biased collet finger of a given profile thereon in said tubular liner, said tubular liner initially having a plurality of sliding sleeve members respectively covering a corresponding plurality of said spaced-apart frac ports along said tubular liner;

(ii) flowing said actuation member downhole so as to cause said profile on said first actuation member to engage an interior circumferential groove on a sliding sleeve member covering an lowermost covered frac port along said tubular liner, wherein said interior circumferential groove profile corresponds to said profile on said collet finger, and injecting fluid into said tubular liner and causing said actuation member and said lowermost sliding sleeve member to together move downhole and thereby uncover an associated of said ports in said tubular liner and causing a resiliently-biased protuberance on said lowermost sliding sleeve member to then engage an aperture in said tubular liner so as to cause said lowermost sliding sleeve member to thereafter remain immovable within said tubular liner;

(iii) injecting a pressurized frac fluid into said tubular liner to frac the formation at the location of the opened frac port;

(iv) injecting or allowing fluid in said tubular liner to dissolve a plug in said actuation member, or alternatively applying pressurized fluid in said tubular liner to burst a plug or disk in said actuation member, so as to thereafter allow longitudinal flow of fluid through said actuation member;

(v) injecting a sand screen sub down said tubular liner, said sand screen sub having a resiliently-outwardly biased protruding member thereon, which sand screen sub upon reaching said first actuation member then underlies said opened port and said protruding member thereafter prevents said sand screen sub from moving back uphole; and (vi) repeating steps (i)-(v) until all of said plurality of spaced-apart ports along said tubular liner have been uncovered, the wellbore fracked at each opened frac port, and sand screen subs installed at each opened frac port.

BRIEF DESCRIPTION OF THE DRAWINGS

Further advantages and permutations and combinations of the invention will now appear from the above and from the following detailed description of the various particular embodiments of the invention, taken together with the accompanying drawings each of which are intended to be non-limiting, in which:

FIGS. 1-10 show one system and successive steps in one method of the present invention, wherein:

FIG. 1 is a cross-sectional view of a tubing liner showing three successive longitudinally-spaced frac/production ports therein, each frac/production port initially slidably covered by a corresponding a slidable sleeve member, each slidable sleeve having an interior circumferential groove therein of width $W_0$, $W_1$, and $W_2$ respectively;

FIG. 2 is a subsequent view of the tubing liner of FIG. 1, wherein a first actuation member has been flowed downhole along the tubing liner, and a radially outwardly biased protuberance thereon has engaged a corresponding interior circumferential groove on the sliding sleeve on the lowermost (ie. most downhole) sliding sleeve member;

FIG. 3 is a subsequent view of the tubing liner of FIG. 2, wherein pressurized fluid applied uphole has caused longitudinal downhole displacement of the actuation member and most downhole sliding sleeve member, so as to thereby uncover the associated frac/production port, and where fracking of the formation can be completed via the opened frac port;

FIG. 4 is a subsequent view of the tubing liner of FIG. 3A, wherein a first sand screen sub has been run into the tubing liner, and become positioned below the frac/production port in the liner, and the retainer member thereon engaged the tubing liner to retain the sand screen sub in place within the liner;

FIG. 5 is a subsequent view of the tubing liner of FIG. 4, wherein a second actuation member has been flowed downhole along the tubing liner, and a radially outwardly biased protuberance thereon has engaged a corresponding interior circumferential groove on the sliding sleeve on the penultimate (ie. next most downhole) sliding sleeve member;

FIG. 6 is a subsequent view of the tubing liner of FIG. 5, wherein pressurized fluid applied uphole has caused longitudinal downhole displacement of the second actuation member and associated sliding sleeve member, so as to thereby uncover the associated frac/production port and where fracking of the formation can be completed at the location of the additionally-opened frac port;

FIG. 7 is a subsequent view of the tubing liner of FIG. 6A, wherein a second sand screen sub has been run into the tubing liner, and become positioned below the second frac/production port in the liner and the retainer member thereon engaged the tubing liner to retain the second sand screen sub in place within the liner;

FIG. 8 is a subsequent view of the tubing liner of FIG. 7A, wherein a third actuation member has been flowed downhole along the tubing liner, and a radially outwardly biased protuberance thereon has engaged a corresponding interior circumferential groove on the sliding sleeve on the next most uphole sliding sleeve member;

FIG. 9 is a subsequent view of the tubing liner of FIG. 8, wherein pressurized fluid applied uphole has caused longitudinal downhole displacement of the third actuation member and associated sliding sleeve member, so as to thereby uncover the associated frac/production port, and where fracking of the formation can be completed at the location of the additionally-opened frac port;

FIG. 10 is a subsequent view of the tubing liner of FIG. 9A, wherein a third sand screen sub has been run into the tubing liner, and become positioned below the third frac/production port in the liner, and the retainer member thereon engaged the tubing liner to retain the third sand screen sub in place within the liner, and production has commenced with oil flowing into the tubing liner and passing through each of the sand screens at each of the associated (opened) ports;

FIGS. 17-24A show a further system and successive steps in a second method of the present invention, wherein:

FIG. 17 is a cross-sectional view of a tubing liner showing three successive longitudinally-spaced frac/production ports therein, each frac/production port initially slidably covered by a corresponding a slidable sleeve member, each slidable sleeve having an interior circumferential groove therein of width $W_0$, $W_1$, and $W_2$ respectively;

FIG. 18 is a subsequent view of the tubing liner of FIG. 17, wherein a first actuation member has been flowed downhole along the tubing liner, and a radially outwardly biased protuberance thereon of width $W_2$ has engaged a corresponding interior circumferential groove of similar width $W_2$ on the sliding sleeve on the lowermost (i.e. most downhole) sliding sleeve member;

FIG. 19 is a subsequent view of the tubing liner of FIG. 18, wherein pressurized fluid applied uphole has caused longitudinal downhole displacement of the actuation member and most downhole sliding sleeve member, so as to thereby uncover the associated frac/production port and create a circumferential groove of width '$X_2$' in the tubing liner, and where fracking of the formation can be completed via the opened frac port;

FIG. 20 is a subsequent view of the tubing liner of FIG. 19A, wherein a first sand screen sub has been run into the tubing liner, and become positioned below the frac/production port in the liner, and the outwardly-biased retainer member thereon of width $X_2$ engaged the tubing liner to retain the first sand screen sub in place within the liner;

FIG. 21 is a subsequent view of the tubing liner of FIG. 20A, wherein pressurized fluid applied uphole has caused a second actuation member to have flowed downhole along the tubing liner, and a radially outwardly biased protuberance thereon of width $W_1$ engaged a corresponding interior circumferential groove of width $W_1$ on the sliding sleeve on the penultimate (ie. next most downhole) sliding sleeve member, and wherein the pressurized fluid has further caused longitudinal downhole displacement of the second actuation member and associated sliding sleeve member so as to thereby uncover the associated frac/production port and further create a circumferential groove of width $X_1$ in the tubing liner, and where fracking of the formation can be completed at the location of the additionally-opened frac port;

FIG. 22 is a subsequent view of the tubing liner of FIG. 21A, wherein a second sand screen sub has been run into the tubing liner and become positioned below the second frac/production port in the liner, and the outwardly-biased retainer member thereon of width '$X_1$' engaged the circumferential groove of width '$X_1$' in tubing liner to retain the second sand screen sub in place within the liner;

FIG. 23 is a subsequent view of the tubing liner of FIG. 22A, wherein a third actuation member has been flowed downhole along the tubing liner, and a radially outwardly biased protuberance thereon of width $W_0$ has engaged a corresponding interior circumferential groove of similar width $W_0$ n the sliding sleeve on the next most uphole sliding sleeve member, and wherein the pressurized fluid has further caused longitudinal downhole displacement of the third actuation member and associated sliding sleeve member so as to thereby uncover the associated frac/production port and further create a circumferential (annular) groove of width '$X_0$' in the tubing liner, and where fracking of the formation can be completed at the location of the additionally-opened frac port;

FIG. 24 is a subsequent view of the tubing liner of FIG. 23A, wherein a third sand screen sub has been run into the tubing liner, and become positioned below the third frac/production port in the liner, and the outwardly-biased retainer member thereon of width '$X_0$' engaged the created circumferential groove of width '$X_0$' in the tubing liner to thereby retain the third sand screen sub in place within the liner;

FIG. 24A is a subsequent view of the tubing liner of FIG. 24, wherein fluid applied uphole has caused bursting and subsequent disappearance of, or corrosive dissolution of, a plug member on an uphole side of the third actuation member sand screen sub, and the tubing liner is ready for production from the further opened frac/production ports;

FIGS. 26-30*a* show a further system and successive steps in a third method of the present invention, wherein:

FIG. 26 is a cross-sectional view of a tubing liner, showing three successive longitudinally-spaced frac/production ports therein, each frac/production port initially slidably covered by a corresponding a slidable sleeve member, each slidable sleeve having an interior circumferential groove therein of fixed width $W_2$;

FIG. 27 is a subsequent view of the tubing liner of FIG. 26, wherein a first actuation member has been flowed downhole along the tubing liner, and engaged the three sliding members and caused them to uncover the associated frac/production port and further and create a circumferential groove of width $X_0$, $X_1$, and $X_2$ at the location of the respective frac/production ports, the tubing liner, and wherein and a radially outwardly biased protuberance thereon of width $W_2$ has engaged a corresponding interior circumferential groove of similar width $W_2$ on the sliding sleeve on the lowermost (i.e. most downhole) sliding sleeve member; and where fracking of the formation can be completed via the opened frac port;

FIG. 28 is a subsequent view of the tubing liner of FIG. 27A, wherein a first sand screen sub has been run into the tubing liner, and become positioned below the frac/production port in the liner, and the outwardly-biased retainer member thereon of width $X_2$ engaged the tubing liner to retain the first sand screen sub in place within the liner;

FIG. 29 is a subsequent view of the tubing liner of FIG. 21A, wherein a second sand screen sub has been run into the tubing liner and become positioned below the second frac/production port in the liner, and the outwardly-biased retainer member thereon of width '$X_1$' engaged the circumferential groove of width '$X_1$' in tubing liner to retain the second sand screen sub in place within the liner;

FIG. 30 is a subsequent view of the tubing liner of FIG. 29*a*, wherein a third sand screen sub has been run into the tubing liner, and become positioned below the third frac/production port in the liner, and the outwardly-biased retainer member thereon of width '$X_0$' engaged the created circumferential groove of width '$X_0$' in the tubing liner to thereby retain the third sand screen sub in place within the liner;

FIG. 30*a* is a subsequent view of the tubing liner of FIG. 30, wherein fluid applied uphole has caused bursting and subsequent disappearance of, or corrosive dissolution of, a plug member on an uphole side of the third actuation member sand screen sub, and the tubing liner is ready for production from the further opened frac/production ports;

FIGS. 31*a*-31*f* show a further alternative system and successive steps in a third method of the present invention, wherein:

FIG. 31*a* is a cross-sectional view of a tubing liner, showing three successive longitudinally-spaced frac/production ports therein, each frac/production port initially slidably covered by a corresponding a slidable sleeve member, each slidable sleeve having an interior circumferential groove therein of fixed width $W_2$;

FIG. 31*b* is a subsequent view of the tubing liner of FIG. 31*a*, wherein a first actuation member comprising a seating surface and a ball plug member, has been flowed downhole along the tubing liner, and engaged the most uphole of the three sliding sleeve members;

FIG. 31*c* is a subsequent view of the tubing liner of FIG. 31*b*, wherein the actuation member has caused each of the sliding sleeve members to uncover the associated frac/production port, and further create a circumferential groove of width $X_0$, $X_1$, and $X_2$ at the location of the respective frac/production ports, in the tubing liner, and wherein and a radially outwardly biased protuberance thereon of width $W_2$ has engaged a corresponding interior circumferential groove of similar width $W_2$ on the sliding sleeve on the lowermost (i.e. most downhole) sliding sleeve member; and where fracking of the formation can be completed via the opened frac ports;

FIG. 31*d* is a subsequent view of the tubing liner of FIG. 31*c*, wherein first, second, and third sand screen subs have been successively run into the tubing liner, and become positioned below the frac/production port in the liner, and the outwardly-biased retainer member thereon of width $X_2$, $X_1$, and $X_0$ thereon respectively engaged the tubing liner to retain the first, second, and third sand screen subs in place within the liner;

FIG. 31*e* is a subsequent view of the tubing liner of FIG. 31*d*, wherein corrosive fluid applied uphole has caused corrosive dissolution of the ball plug member; and FIG. 31*f* is a subsequent view of the tubing liner of FIG. 31*d*, wherein corrosive fluid applied uphole has further caused corrosive dissolution of the actuation member, where the actuation member is configured to be dissolvable in a corrosive fluid.

DETAILED DESCRIPTION OF SOME PREFERRED EMBODIMENTS

One embodiment of the present invention, namely system/method 10, is depicted in successive steps illustrated in FIGS. 1-10.

As regards the particular system/method 10 shown in FIGS. 1-10, the system/method 10 uses a plurality of actuation members 30*a*, 30*b*, 30*c* which are successively flowed downhole, each actuation member 30*a*, 30*b*, 30*c* having a corresponding radially outwardly biased protuberance 31*a*, 31*b*, 31*c* thereon of a unique profile/width $W_0$, $W_1$, and $W_2$. The unique profile/width $W_0$, $W_1$, and $W_2$ of each radially outwardly biased protuberance 31*a*, 31*b*, 31*c* allows each actuation member to selectively engage a circumferential groove profile 22*a*, 22*b*, 22*c* of equal (or greater) profile/width $W_0$, $W_1$, and $W_2$ on a corresponding sliding sleeve member 18*a*, 18*b*, 18*c*, to thereby engage and slidably cause to open an associated of frac ports 16*a*, 16*b*, 16*c*.

After the opening of a frac port, and after a fracking operation is carried out at the respective opened frac port, one of sand screen subs 40*a*, 40*b*, 40*c* is flowed downhole and comes to rest against the last-installed actuation member 30*a*, 30*b*, 30*c*, as the case may be, so that the sand screen sub underlies the respective opened frac/production port 16*a*, 16*b*, 16*c*.

A retaining member 41*a*, 41*b*, 41*c* on the respective sand screen sub 40*a*, 40*b*, 40*c* engages a respective annular region 50*a*, 50*b*, 50*c* in the tubing liner 12, so as to prevent the sand screen sub 40*a*, 40*b*, 40*c* from being dislodged from its position underlying the respective opened frac port 16*a*, 16*b*, 16*c*.

Figure 1:
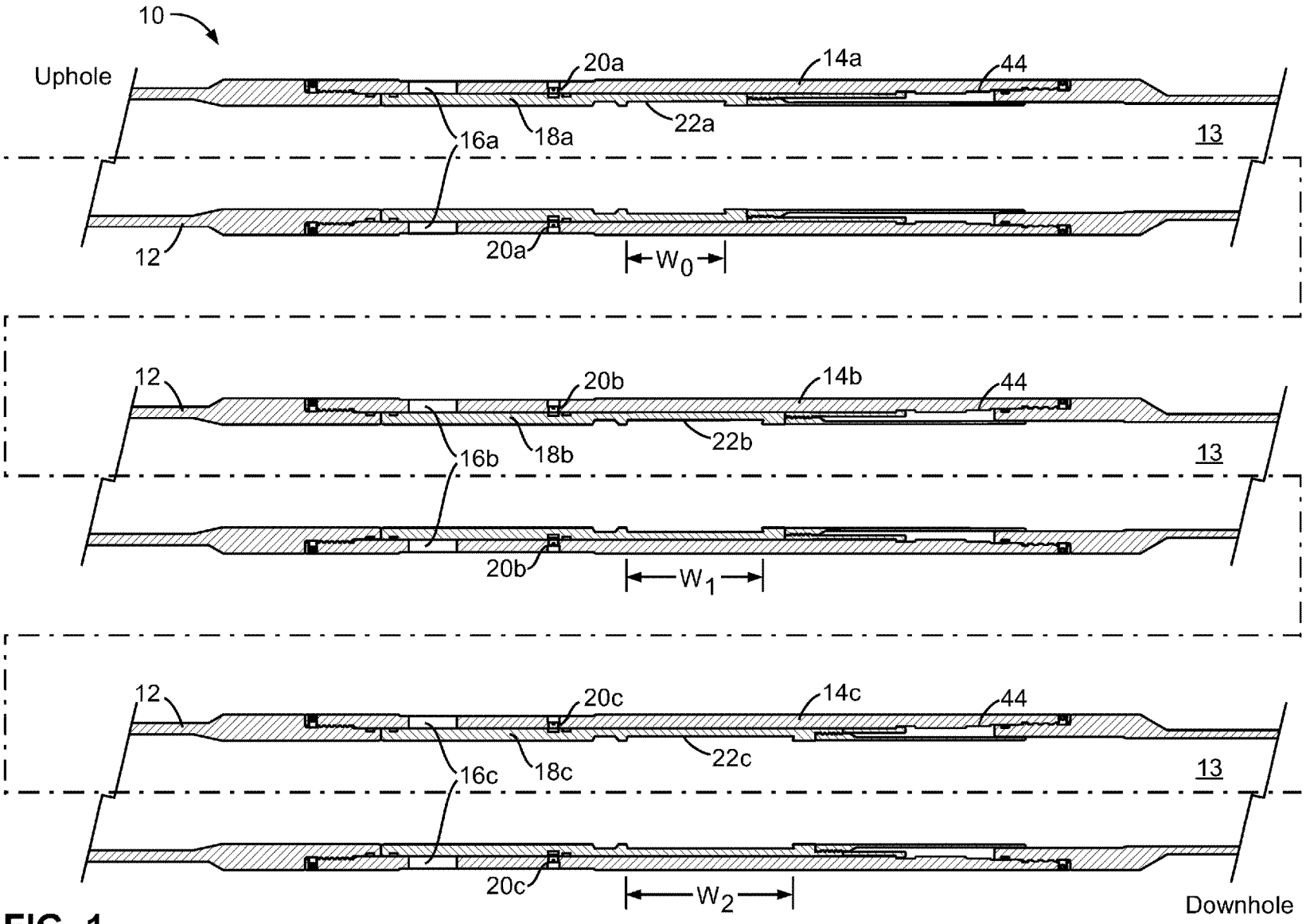

Accordingly, with reference to FIG. 1-10, commencing with FIG. 1, such system/method 10 initially comprises, as shown in FIG. 1, a tubing liner 12 having an interior bore 13 and a plurality of discrete sections 14*a*, 14*b*, 14*c* coupled together in end-to-end relation to form the tubing liner 12, which is run into a wellbore (not shown). Each discrete section 14*a*, 14*b*, 14*c* has a corresponding frac port/production port 16*a*, 16*b*, 16*c*.

Frac/production ports 16*a*, 16*b*, 16*c* of respective tubing sections 14*a*, 14*b*, 14*c* are each initially, during "run in" of the tubing liner 12 into the wellbore, covered by a respective sliding sleeve member 18*a*, 18*b*, 18*c* as shown in FIG. 1 so as to prevent ingress of detritus such as sand into the interior bore of the tubing liner during such "run-in". Sliding sleeve members 18*a*, 18*b*, 18*c* are thus initially in an initial closed position covering frac/production ports 16*a*, 16*b*, 16*c* and initially held in such closed position by shear members 20*a*, 20*b*, 20*c* coupling the sleeve members to the tubing liner 12. Shear members 20*a*, 20*b*, 20*c* are respectively shearable when a longitudinal force is transmitted by an actuation member, as explained below, to the corresponding sliding sleeve member 18*a*, 18*b*, 18*c* to cause the slidable sleeve members 18*a*, 18*b*, 18*c* to be slidably moved downhole to an open position where a respective frac/production port 16*a*, 16*b*, 16*c* is then uncovered, thereby allowing fluid communication between an exterior of tubing liner 12 and interior bore 13 thereof.

Each of sliding sleeve members 18*a*, 18*b*, 18*c* possesses an interior circumferential groove profile 22*a*, 22*b*, 22*c*, which in a preferred embodiment is of a given longitudinal width, namely $W_0$, $W_1$, and $W_2$ respectively, where $W_0<W_1<W_2$.

Figure 2:
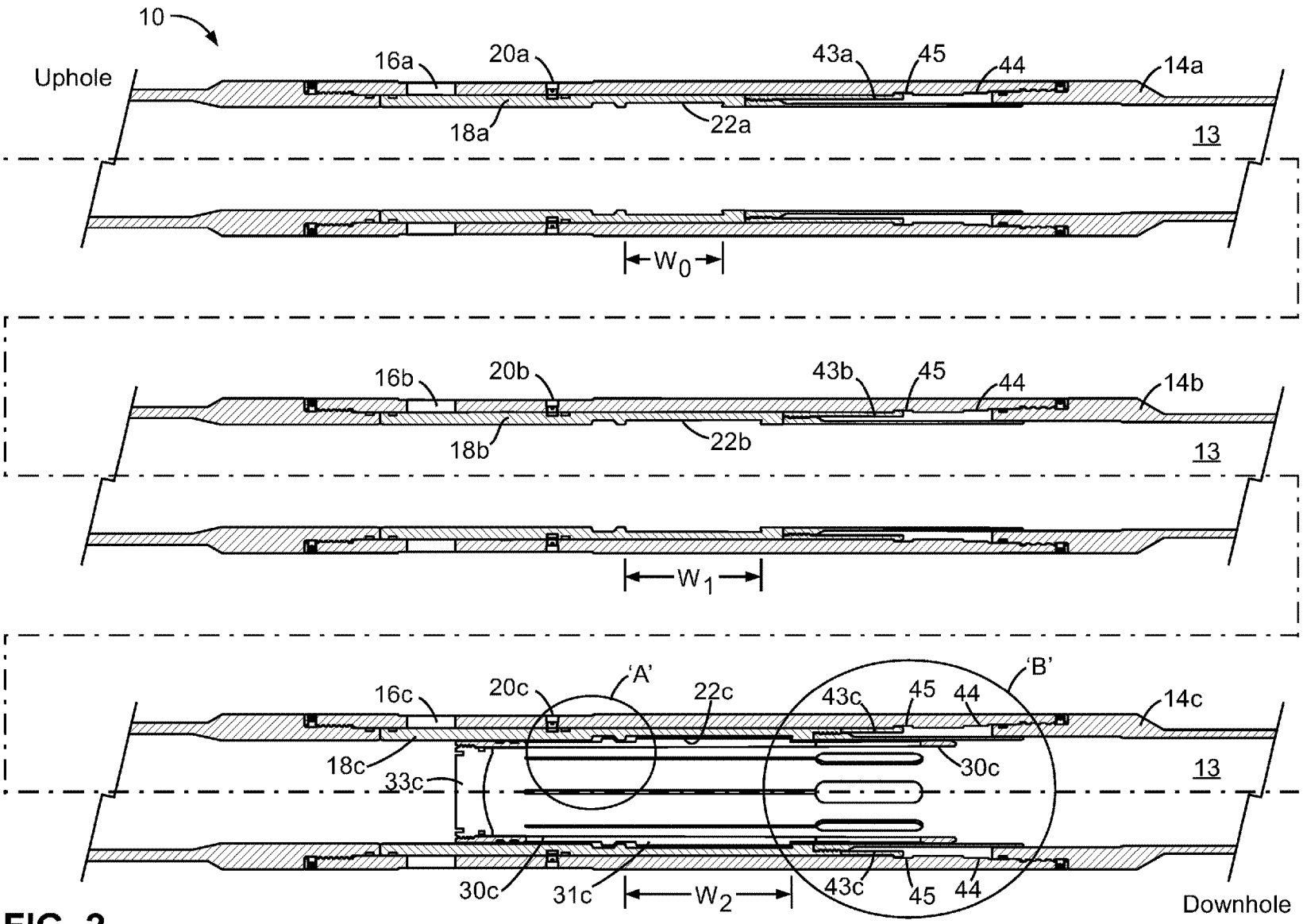
Figure 11:
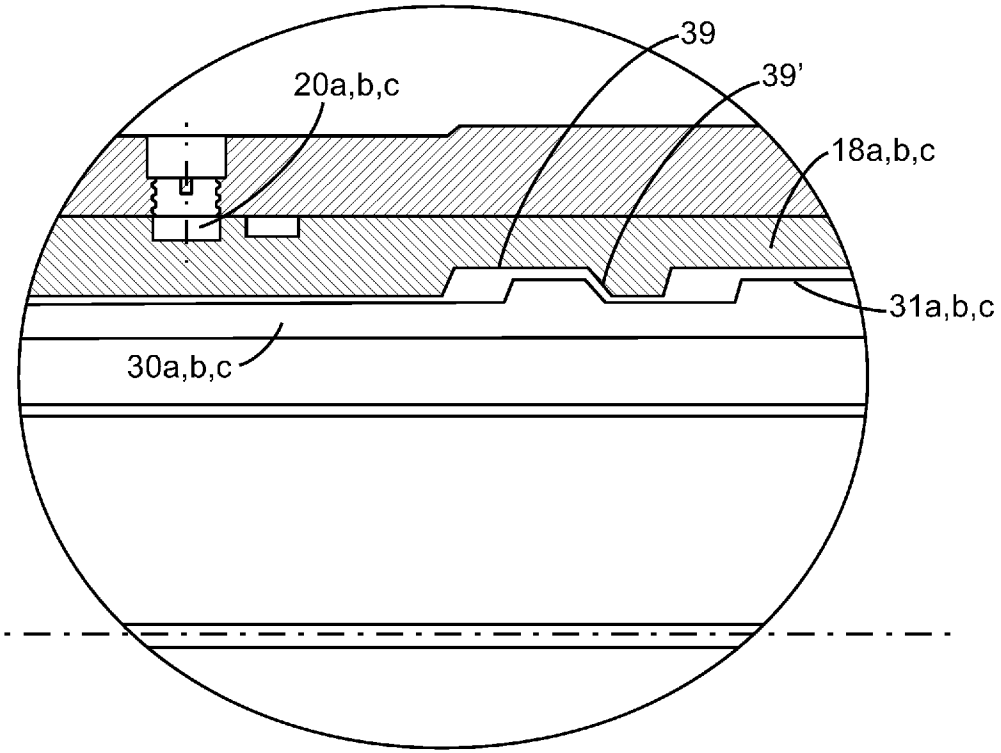
FIG. 11 is an enlarged view of region 'A' of FIG. 2, FIG. 5, and FIG. 8.
Figure 15A:
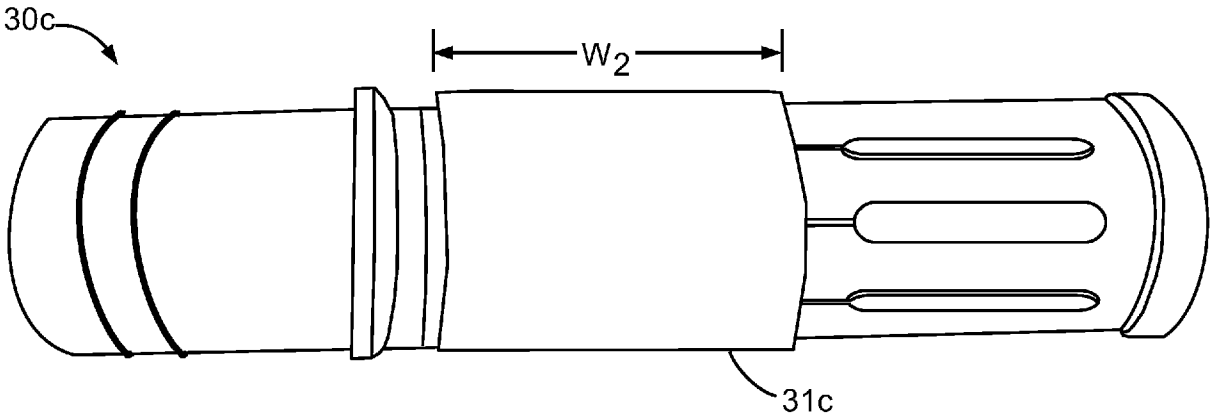
FIG. 15*a* is an enlarged view of the first actuation member, shown for example in FIG. 2, having a radially outwardly biased protuberance having a profile of width "$W_2$"
Figure 15B:
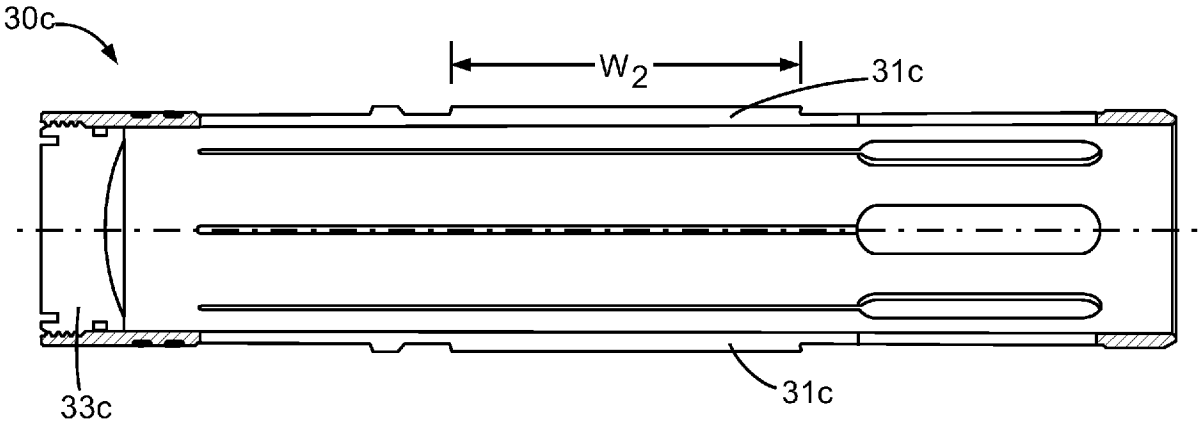
FIG. 15*b* is a cross section through the first actuation member of FIG. 15*a*, with the burst plate on the first actuation member still intact.

FIG. 2 shows a further successive step in the system/method 10, wherein a first actuation member 30*c* [as best shown in enlarged (perspective) view in FIG. 15*a* and in enlarged cross-sectional view in FIG. 15*b*] and having a frangible burst disk or a dissolvable disk 33*c* at an uphole side thereof, is flowed down tubing liner 12 and through discrete sections 14*a*, 14*b*, to 14*c* by applying a pressurized fluid to an uphole side of actuation member 30*c*. Due to radially outwardly biased protuberance 31*c* having a unique profile/width $W_2$ which only matingly engages the interior circumferential groove profile 22*c* of similar or greater width $W_2$ on most downhole section 14*c*, only sliding sleeve member 18*c* is engaged by actuation member 30*c*. Circled area 'A', shown in enlarged view in FIG. 11, depicts shear member 20*c*, prior to being sheared, securing sliding sleeve member 18*c* to tubular liner segment 14*c*, and shows annular groove 39 in sliding sleeve member 18*c* having bevelled edge 39' thereon to allow the radially outwardly biased protuberance 31*c* of actuation member 30*c* to pass over annular groove 39 and engage interior circumferential groove profile 22*c* on sliding sleeve member 18*c*.

Figure 3:
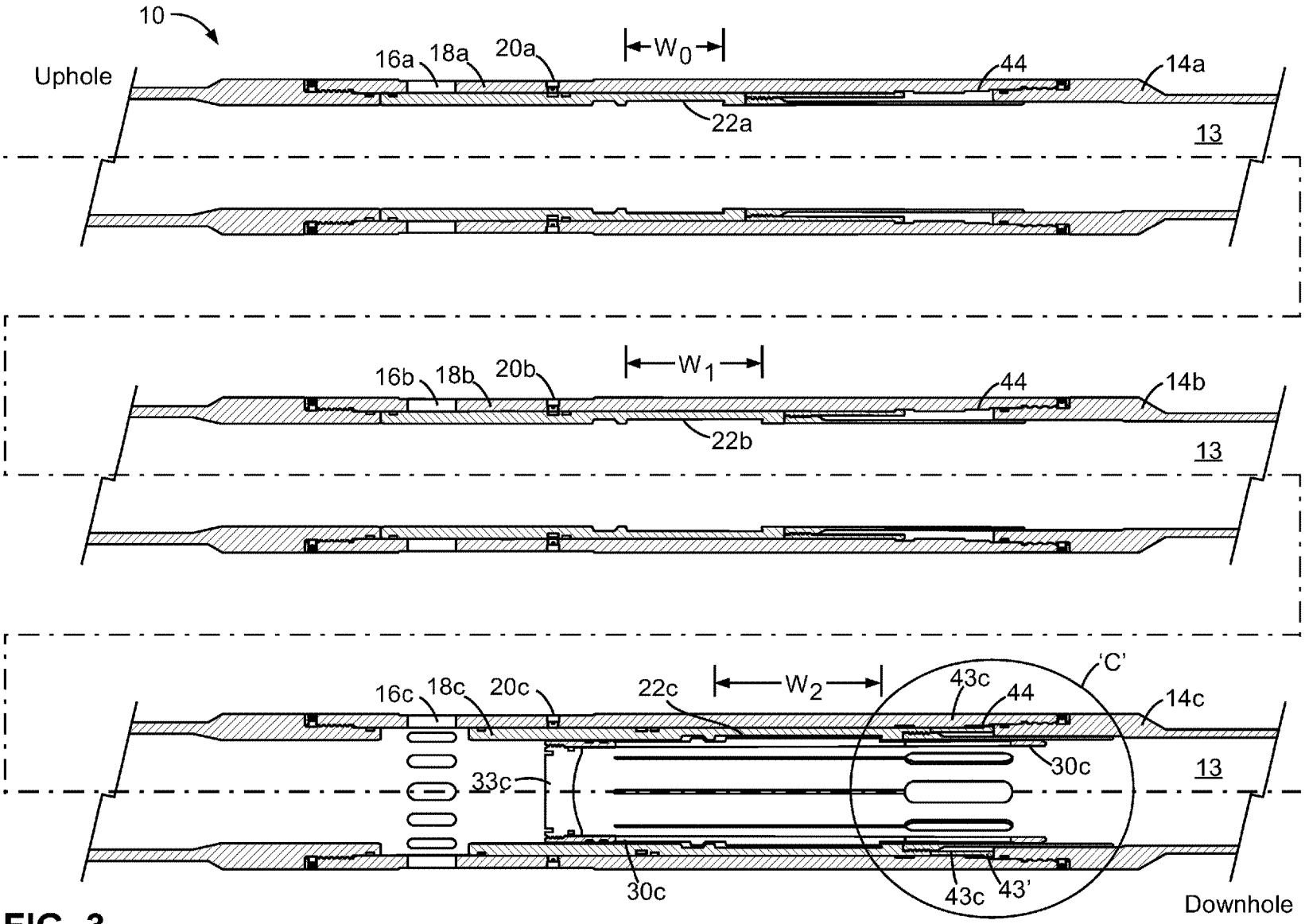
Figure 12:
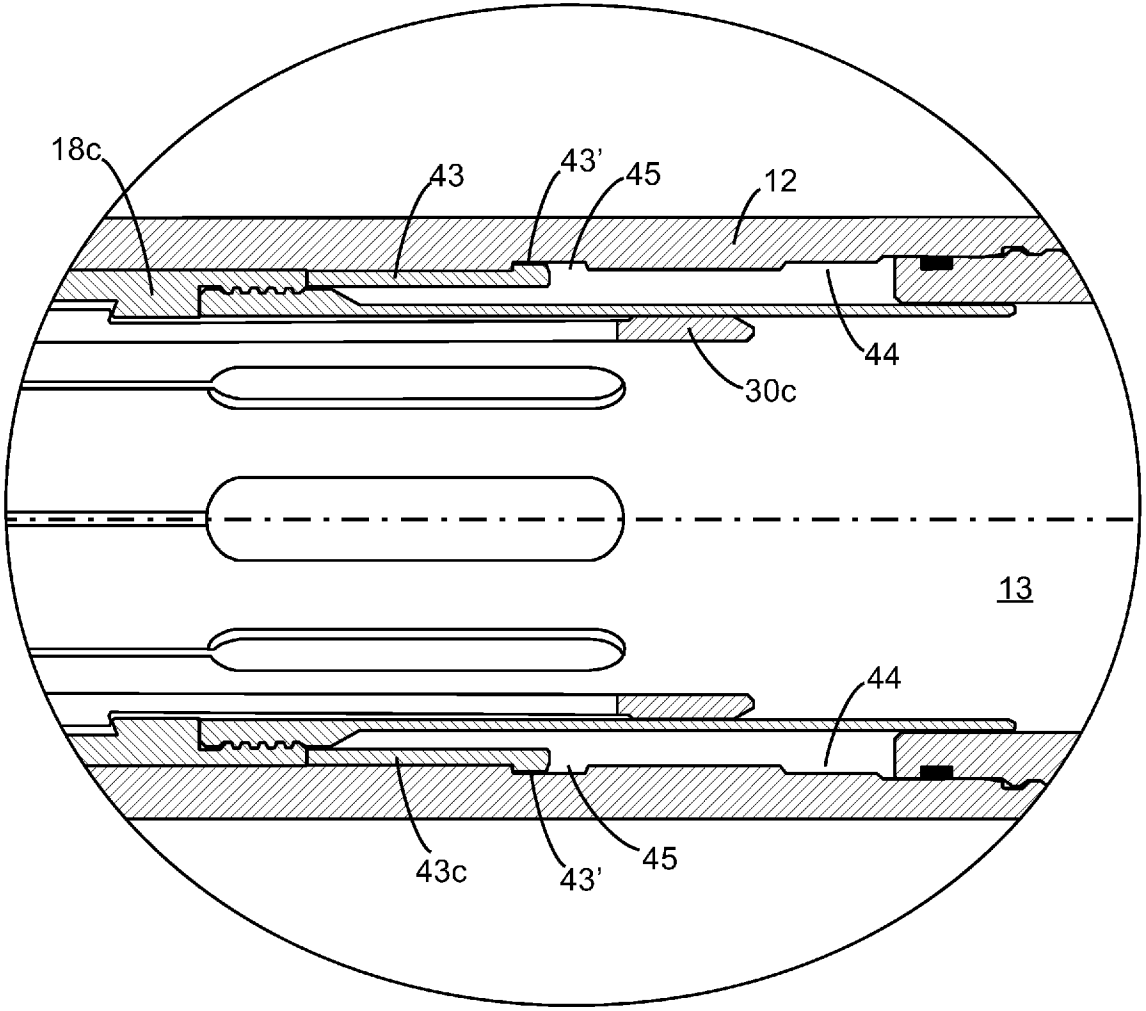
FIG. 12 is an enlarged view of region 'B' of FIG. 2.

As may be seen in circled area "B" in FIG. 2 and as shown enlarged in FIG. 12, a downhole end of sliding sleeve member 18*c* comprises a plurality of longitudinally-extending collet fingers 43*c*, radially outwardly biased, each adapted at distal ends 43' thereof to matingly engage with at least one annular circumferential ring 44 on tubular liner 12, when slidable sleeve member 18*c* is moved to the open position uncovering frac/production ports (see FIG. 3, as described below). When sliding sleeve members are in the closed position, distal ends 43' thereof may matingly engage a more uphole annular circumferential ring 45, as shown in FIG. 2 in circled area "B" and enlarged in FIG. 12. In such manner the shearable members 20*a*, 20*b*, 20*c* are assisted in the temporary securement of slidable sleeve members 18*a*, 18*b*, 18*c* to respective sections 14*a*, 14*b*, 14*c* of tubing liner 12.

Figure 13:
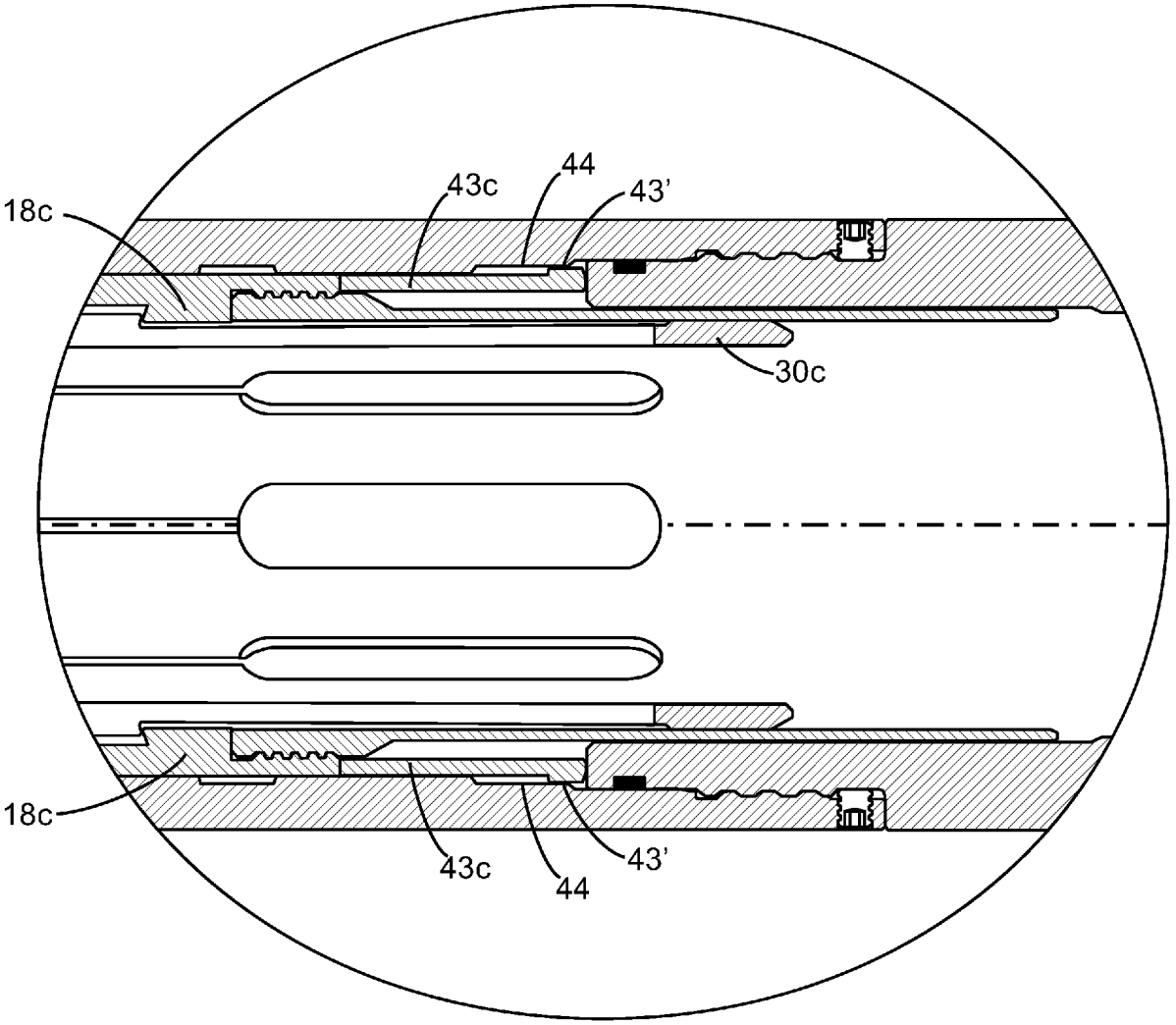
FIG. 13 is an enlarged view of region 'C' of FIG. 2.

As may be seen from the subsequent configuration of the system/method 10 depicted in FIG. 3, continued injection of pressurized fluid within tubing liner 12 has caused continued force to be applied to an uphole side of actuation member 30*c*, namely against frangible burst disk or a dissolvable disk 33*c*, causing actuation member 30*c* lockingly engaged with sliding sleeve member 18*c* to together slidably move downhole whereby frac/production port 16*c* becomes uncovered and thus opened to fluid communication with interior bore 13 of tubing liner 12. As may further be seen in circled area "C" of FIG. 3 and as best seen enlarged in FIG. 13, and in comparison to area "B" in FIG. 2, the plurality of collet fingers 43*c* on sliding sleeve member 18*c*, at the distal end 43' thereof, has due to downhole displacement of slidable sleeve member 18*c*, matingly engaged annular circumferential ring 45 in tubular liner 12. As best shown in FIG. 13, sliding sleeve member 18*c* has accordingly then been lockingly fixed in position and prevented from not only further progression downhole but also from returning to a closed position covering frac port 16*c*.

Fracking of the reservoir, at the particular location of the opened frac port 16*c*, is carried out at this point in the method/system 10.

Figure 3A:
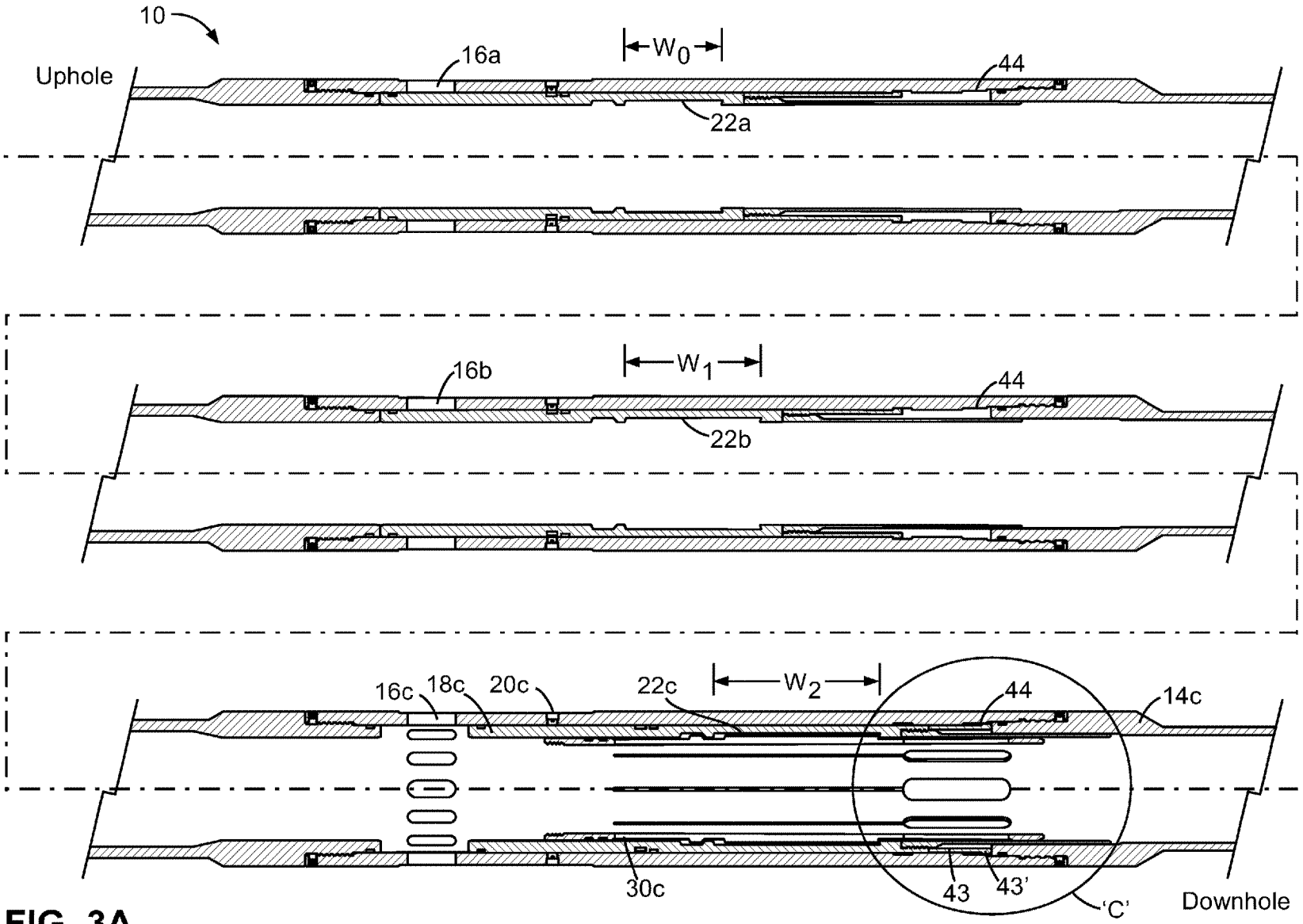
FIG. 3A is a subsequent view of the tubing liner of FIG. 3, wherein fluid applied uphole has caused bursting and subsequent disappearance of, or corrosive dissolution of, a plug member on an uphole side of said actuation member.

Thereafter, as may be seen from the subsequent configuration of the system/method 10 depicted in FIG. 3A, one of either two things has occurred-either a pulse of high pressure fluid has been applied to the uphole side of a frangible disk 33*c* on actuation member 30*c* so as to cause disk 33*c* thereof to rupture and disintegrate, or if disk 33*c* is of a dissolvable type upon application of a corrosive fluid (not shown), a corrosive fluid has been flowed downhole to dissolve disk 33*c*.

Figure 4:
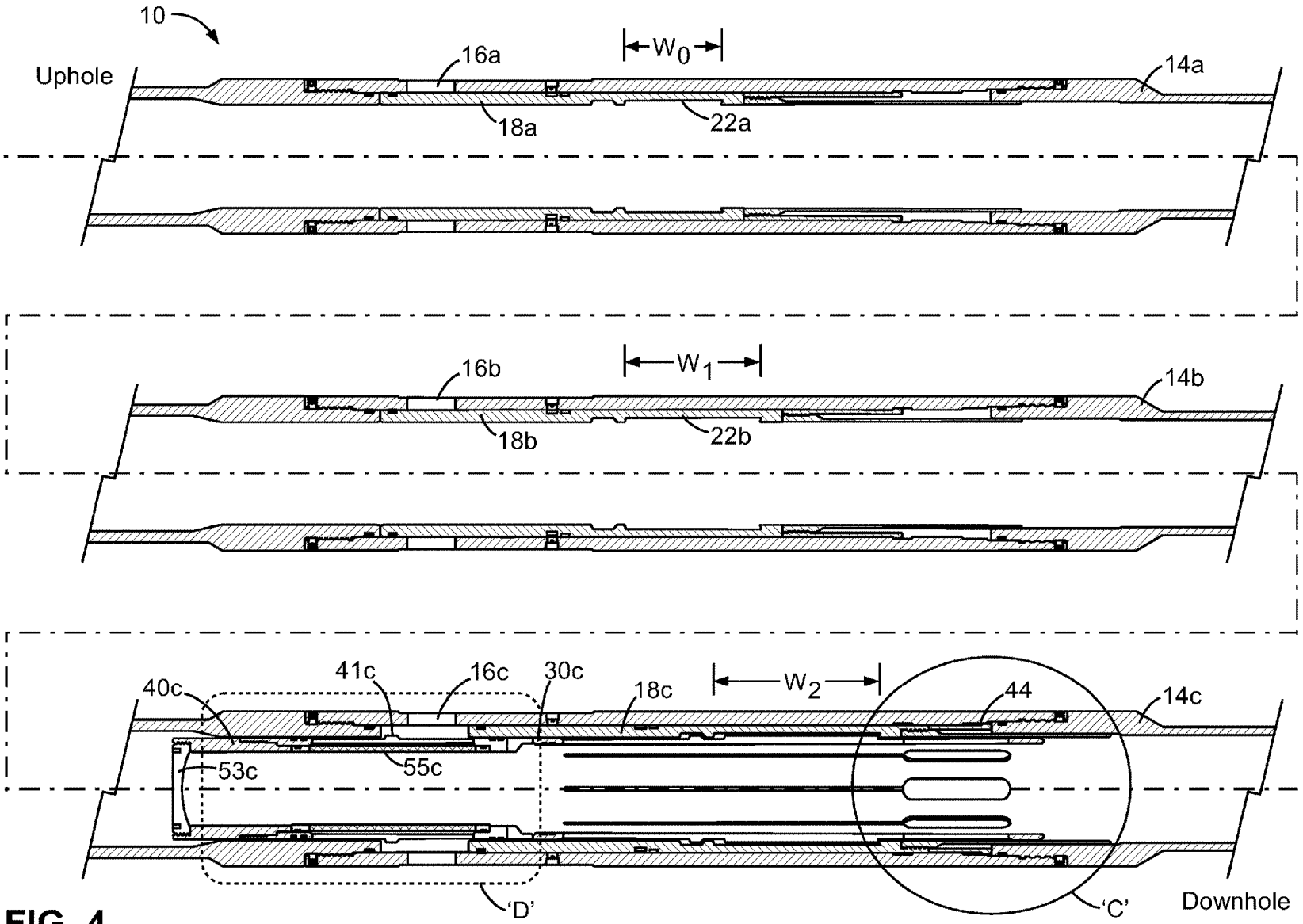

As may be seen from the subsequent configuration of the system/method 10 depicted in FIG. 4, a sand screen sub 40*c* (as shown in area "D" of FIG. 4 and in enlarged view in FIG. 14) has been flowed downhole in tubing liner 12 and come to rest against actuation member 30*c* which is now lockingly engaged with tubing liner 12.

Sand screen sub 40*c* comprises a cylindrical hollow portion 51*c*, having at an uphole end thereof a dissolvable plug member or burst plate 53*c*, which at least for a limited time substantially obstructs passage of fluid within interior bore 13 and causes pressurized fluid injected downhole in tubing liner 12 to force sand screen sub 51*c* downhole into a position abutting an uphole end of actuation member 30*c*.

Importantly, sand screen sub 40*c* is provided with a cylindrical, longitudinally extending oil-permeable screen mesh 55*c* forming part of an outer periphery thereof. Screen mesh 55*c* when sand screen sub 40*c* is flowed into the above position shown in FIG. 4, abutting actuation member 30*c*, prevents ingress of sand into interior bore 13 of tubing liner 12 but permits ingress of oil from a hydrocarbon formation (not shown) into interior bore 13 of tubing liner 12 via opened frac port 16*c*.

When sand screen sub 40*c* is flowed into position as shown in FIG. 4, namely whereby screen mesh 55*c* underlies opened frac port 16*c*, a resiliently outwardly-biased retaining member 41*c* extends radially outwardly into an annular region 50*c* formed within tubing liner 12, thereby then preventing any subsequent uphole displacement of sand screen sub 40*c* within tubing liner 12.

Figure 14:
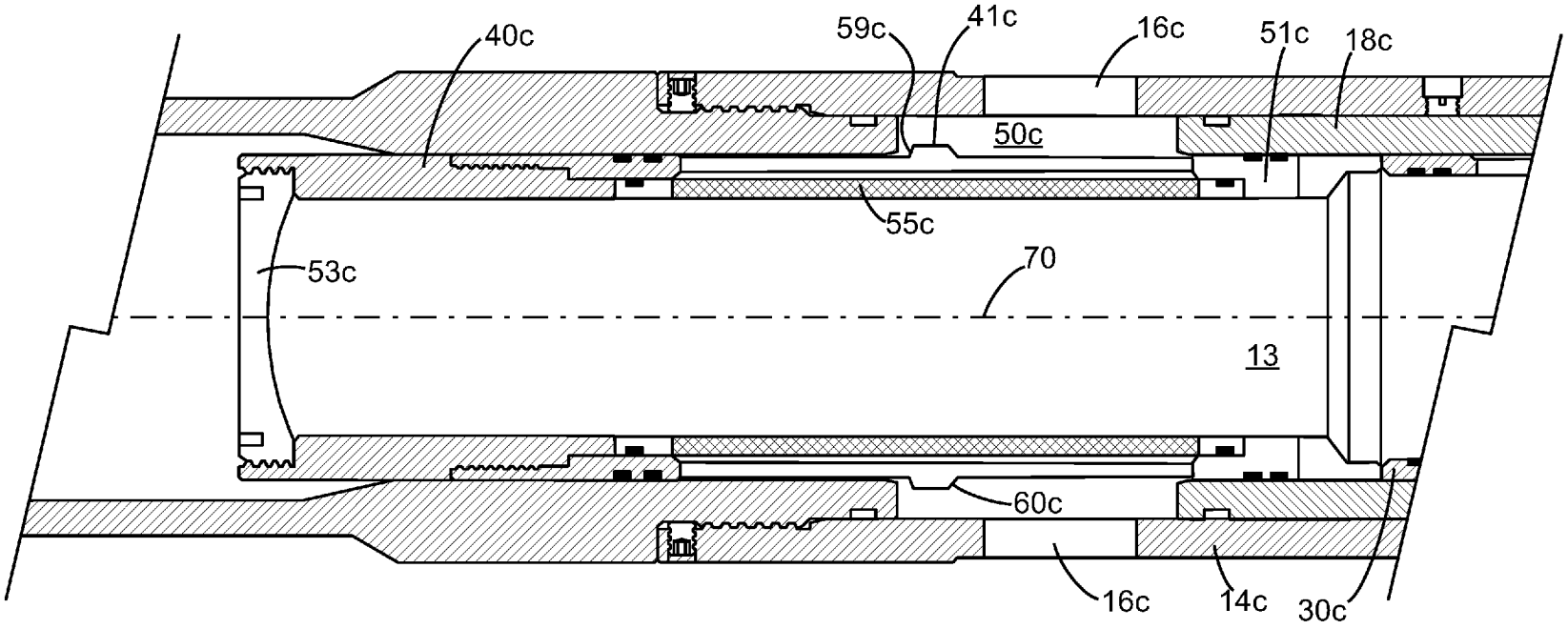
FIG. 14 is an enlarged view of region 'D' of FIG. 4.

As best seen in FIG. 14, retaining member 41*c* is provided with a chamfer 60*c* on a downhole side edge thereof and a substantially flat face 59*c* on an uphole side edge thereof perpendicularly disposed to a longitudinal axis 70 of tubular liner 12. Downhole movement of sand screen sub 40*c* within tubing liner 12 is thereby allowed by chamfer 60*c* causing outwardly-biased retaining member 41*c* to be radially depressed upon engagement with abutting edges of circumferential interior groove profiles 22*a*, 22*b* in tubing liner 12, thereby allowing passage of sand screen sub 41*c* downhole past said circumferential interior groove profiles 22*a*, 22*b* in tubing liner 12 and allow sand screen sub 41*c* to flow downhole to a position abutting actuation member 30*c* and where screen mesh 55*c* thereof underlies opened frac port 16*c*. Any subsequent uphole displacement of sand screen sub 41*c* from the aforesaid position is prevented by flat face 59*c* engaging, directly or indirectly, annular region 50*c* in tubing liner 12, namely by contacting an uphole edge of annular region 50*c*, as shown in FIG. 14.

Figure 4A:
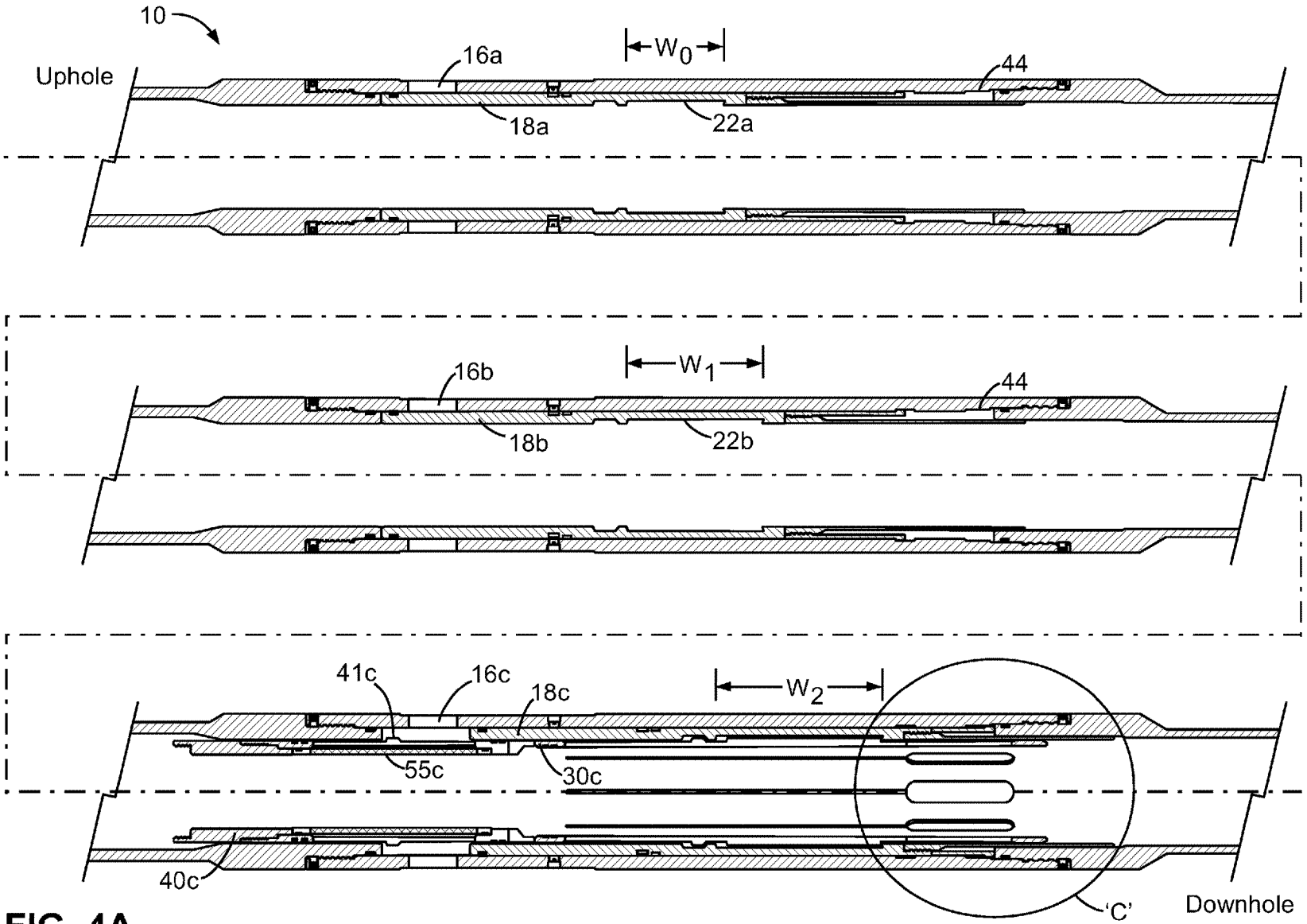
FIG. 4A is a subsequent view of the tubing liner of FIG. 4 wherein fluid applied uphole has caused bursting and subsequent disappearance of, or corrosive dissolution of, a plug member on an uphole side of said first sand screen sub.

Thereafter, as may be seen from the subsequent configuration of the system/method 10 depicted in FIG. 4A, one of either two things has occurred-either a pulse of high pressure fluid has been applied to the uphole side of a frangible disk 53*c* of sand screen sub 40*c* so as to cause disk 53*c* to rupture and disintegrate, or if disk 53*c* is of a dissolvable type upon application of a corrosive fluid (not shown), a corrosive fluid has been flowed downhole to dissolve disk 53*c*.

The same system and series of steps in the method 10 is provided/carried out for installing sand screen subs 40*b*, and subsequently 40*a*, in positions underlying then-opened uphole frac/production ports, such as frac production ports 16*b* and 16*a*, respectively, as depicted in remaining FIGS. 5-10.

Figure 5:
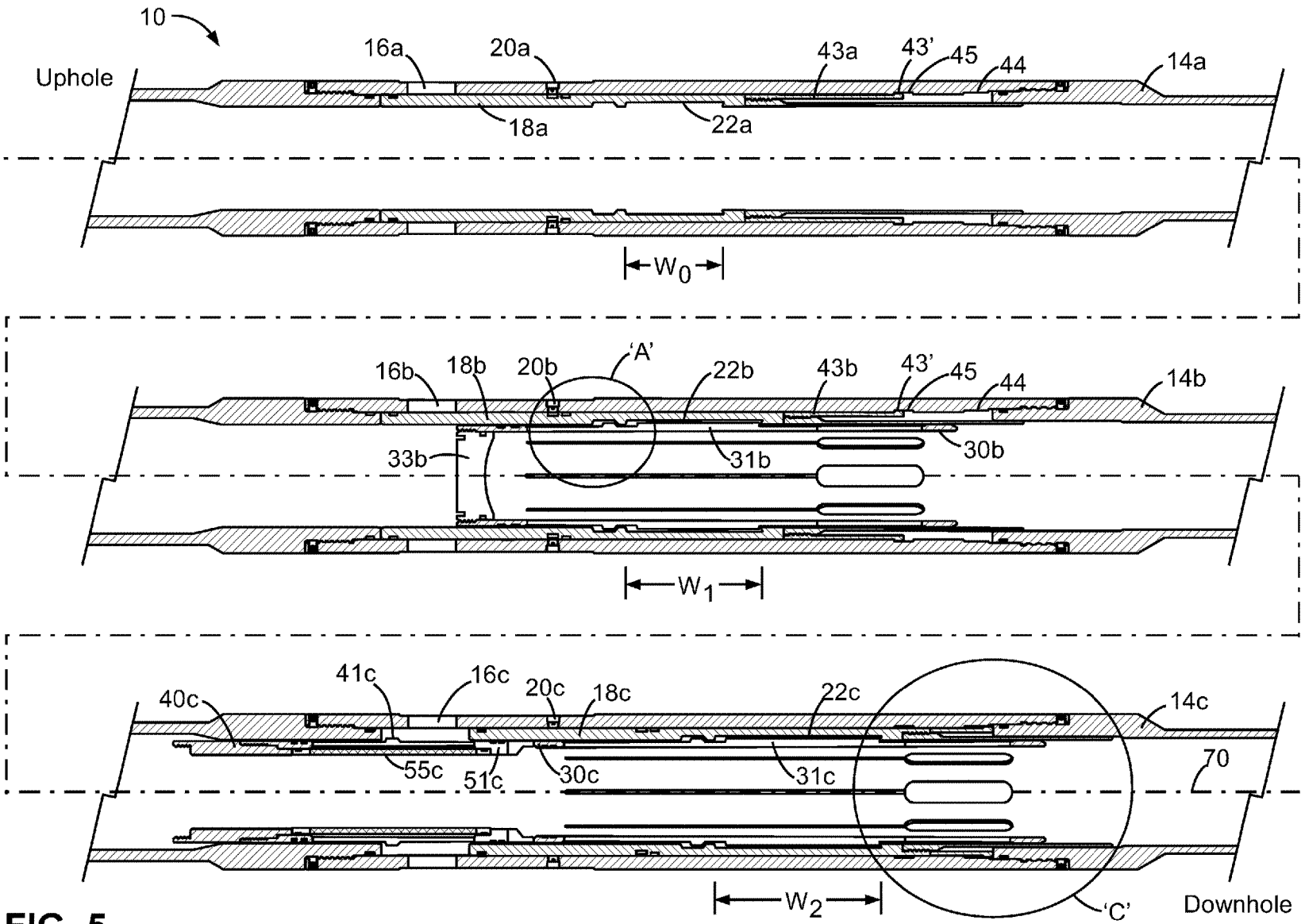
Figure 15C:
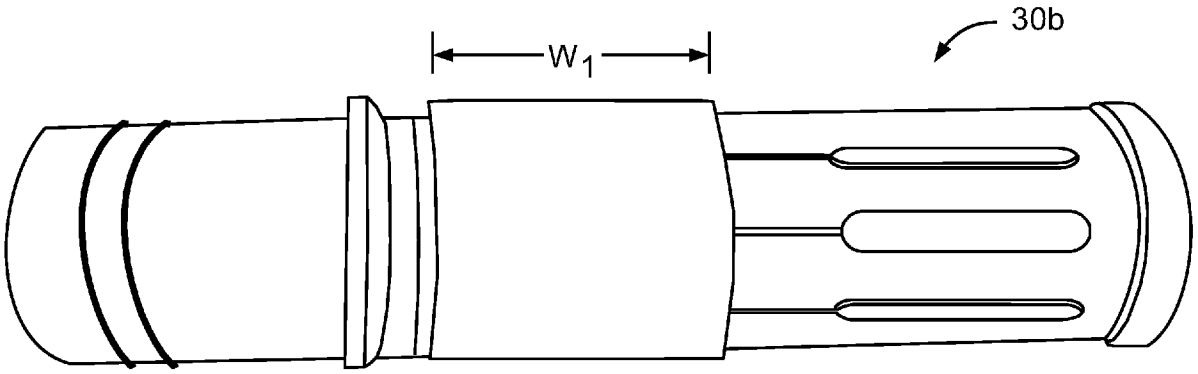
FIG. 15*c* is an enlarged view of the second actuation member, shown for example in FIG. 5, having a radially outwardly biased protuberance having a profile of width "$W_1$"
Figure 15D:
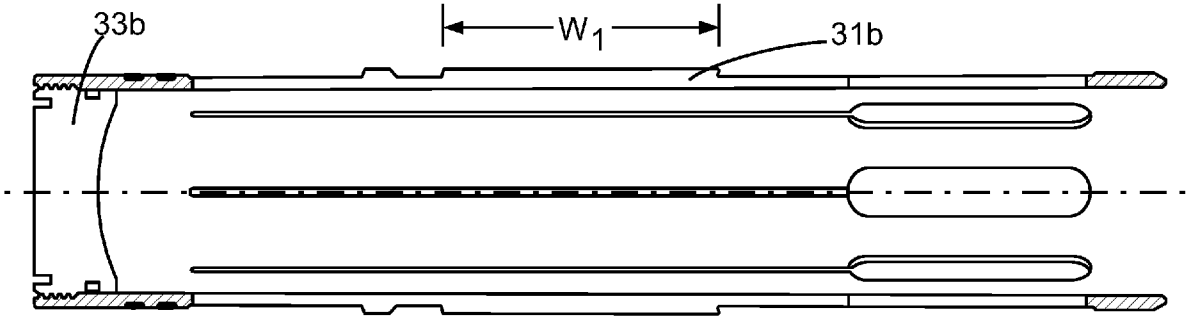
FIG. 15*d* is a cross section through the second actuation member of FIG. 15*c*, with the burst plate on the second actuation member still intact.

Specifically, FIG. 5 shows a further successive step in the system/method 10, wherein a second actuation member 30*b* [as best shown in enlarged (perspective) view in FIG. 15*c* and in enlarged cross-sectional view in FIG. 15*d*] and having a frangible burst disk or a dissolvable disk 33*b* at an uphole side thereof, is flowed down tubing liner 12 and through discrete section 14*a* to discrete section 14*b* by applying a pressurized fluid to an uphole side of actuation member 30*b*. Due to radially outwardly biased protuberance 31*b* having a unique profile/width $W_1$ which only matingly engages the interior circumferential groove profile 22*b* of similar or greater width $W_1$ on most downhole section 14*b*, only sliding sleeve member 18*b* is engaged by actuation member 30*b*. Circled area 'A', shown in enlarged view in FIG. 11, depicts shear member 20*b*, prior to being sheared, securing sliding sleeve member 18*b* to tubular liner segment 14*b*, and shows annular groove 39 in sliding sleeve member 18*b* having bevelled edge 39' thereon to allow the radially outwardly biased protuberance 31*b* of actuation member 30*c* to pass over annular groove 39 and engage interior circumferential groove profile 22*b* on sliding sleeve member 18*b*.

Similar to the configuration of sliding sleeve member 18*c*, a downhole end of sliding sleeve member 18*b* comprises a plurality of longitudinally-extending collet fingers 43*b*, radially outwardly biased, each adapted at distal ends 43' thereof to matingly engage with at least one annular circumferential ring 44 on tubular liner 12, when slidable sleeve member 18*b* is moved to the open position uncovering frac/production port 16*b* (see FIG. 6, as described below). When sliding sleeve member 18*b* is initially in the closed position, distal ends 43' thereof may matingly engage a more uphole annular circumferential ring 45. In such manner the shearable member 20*b* is assisted in the temporary securement of slidable sleeve member 18*b* to discrete section 14*b* of tubing liner 12.

Figure 6:
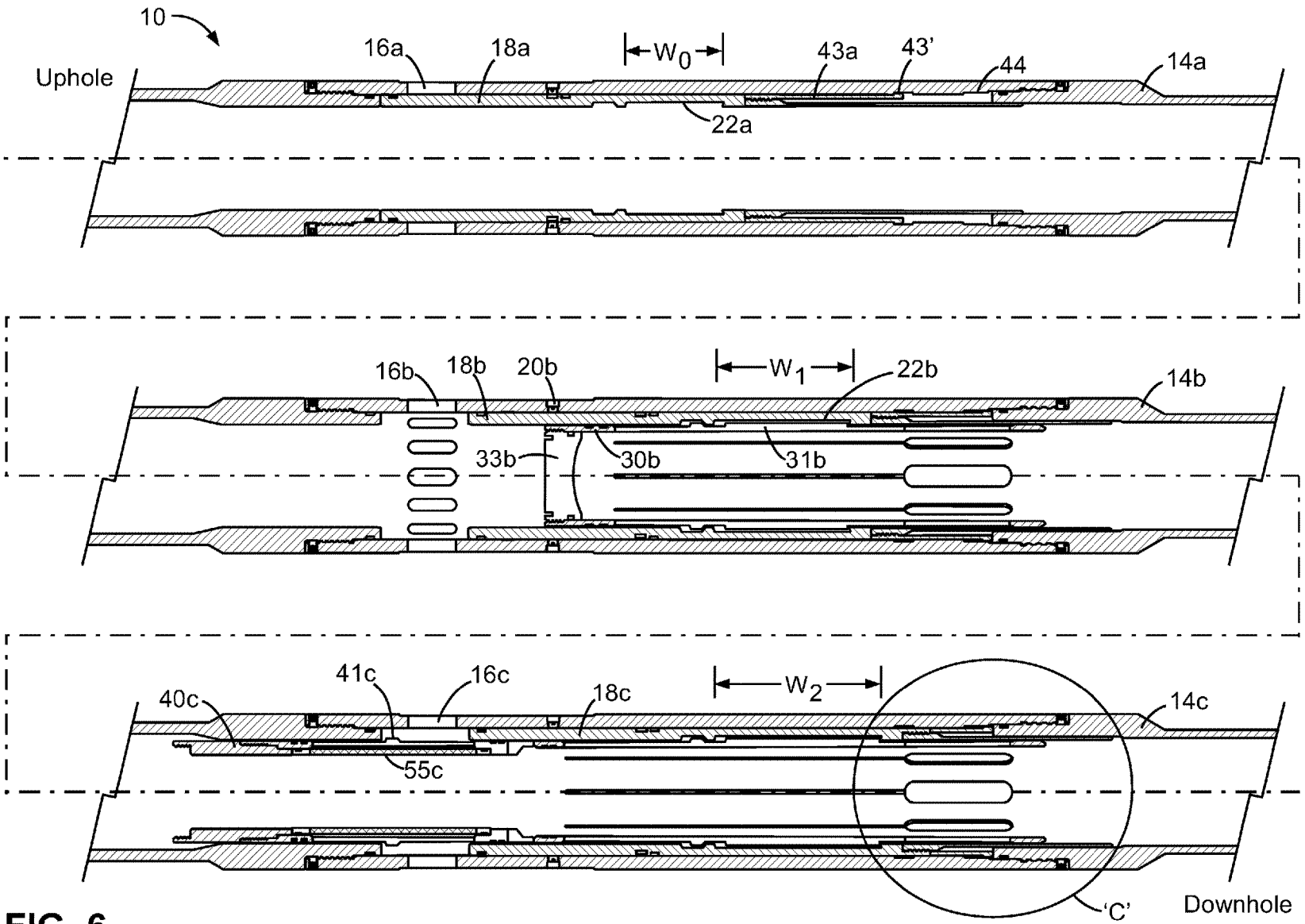

As may be seen from the subsequent configuration of the system/method 10 depicted in FIG. 6, continued injection of pressurized fluid within tubing liner 12 has caused continued force to be applied to an uphole side of actuation member 30*b*, namely against frangible burst disk or a dissolvable disk 33*b* thereof, causing actuation member 30*b* which is lockingly engaged with sliding sleeve member 18*b* to together slidably move downhole whereby frac/production port 16*b* becomes uncovered and thus opened to fluid communication with interior bore 13 of tubing liner 12. Similar to the configuration shown in FIG. 13 in regard to sliding sleeve member 18*c*, the plurality of collet fingers 43*b* on sliding sleeve member 18*b*, at the distal end 43' thereof, has due to downhole displacement of slidable sleeve member 18*b* matingly engaged annular circumferential ring 45 in tubular liner 12. Similar to the configuration shown in FIG. 13 as regards sliding member 18*c*, sliding sleeve member 18*b* has accordingly then been lockingly fixed in position and prevented from not only further progression downhole but also from returning to a closed position covering frac port 16*b*.

Further fracking of the reservoir, at the particular location of the now-opened frac port 16*b*, is carried out at this point in the method/system 10.

Figure 6A:
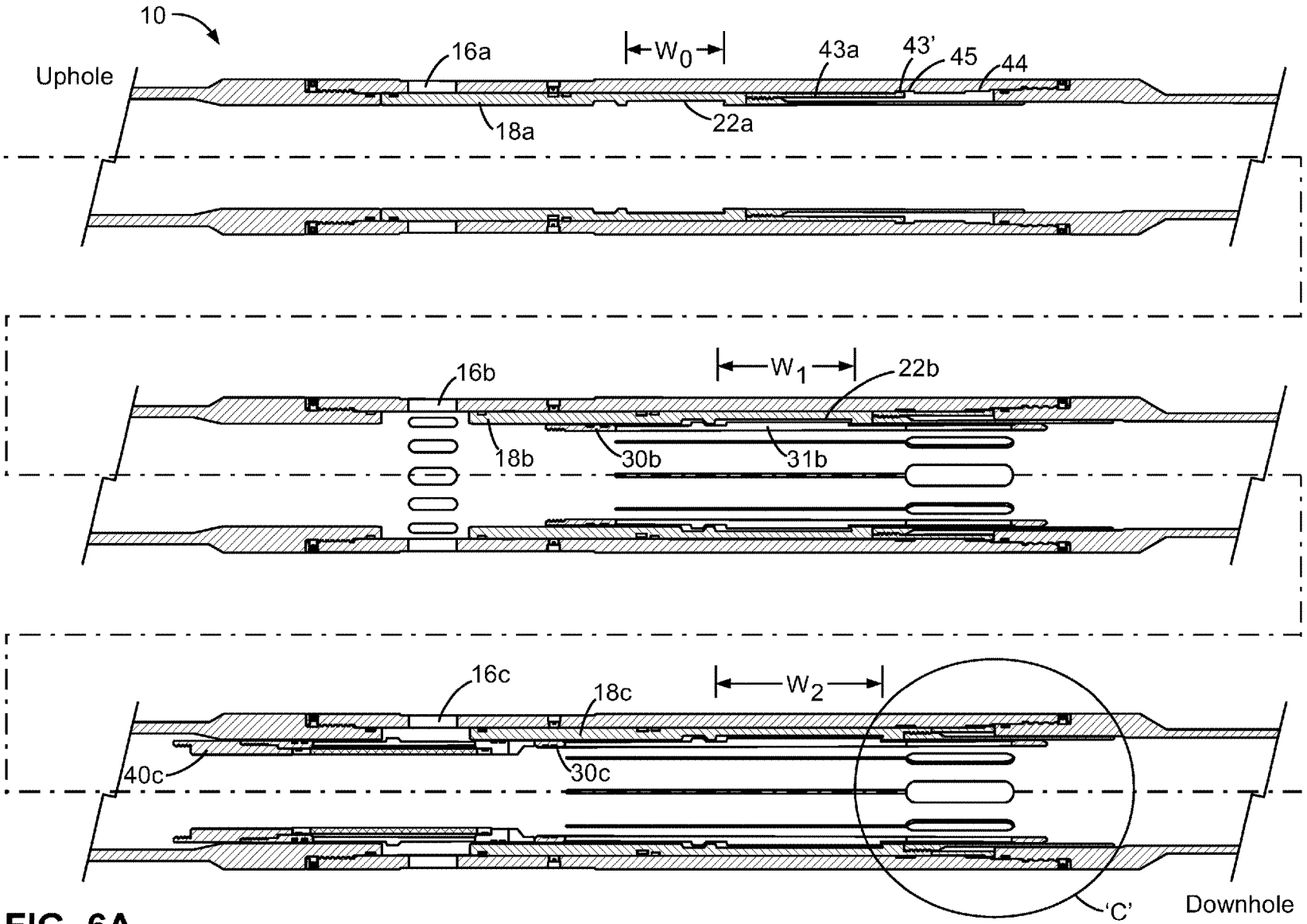
FIG. 6A is a subsequent view of the tubing liner of FIG. 6, wherein fluid applied uphole has caused bursting and subsequent disappearance of, or corrosive dissolution of, a plug member on an uphole side of the sand screen sub.

Thereafter, as may be seen from the subsequent configuration of the system/method 10 depicted in FIG. 6A, one of either two things has occurred-either a pulse of high pressure fluid has been applied to the uphole side of a frangible disk 33*b* of actuation member 30*b* so as to cause disk 33*b* to rupture and disintegrate, or if disk 33*b* is of a dissolvable type upon application of a corrosive fluid (not shown), a corrosive fluid has been flowed downhole to dissolve disk 33*b*.

Figure 7:
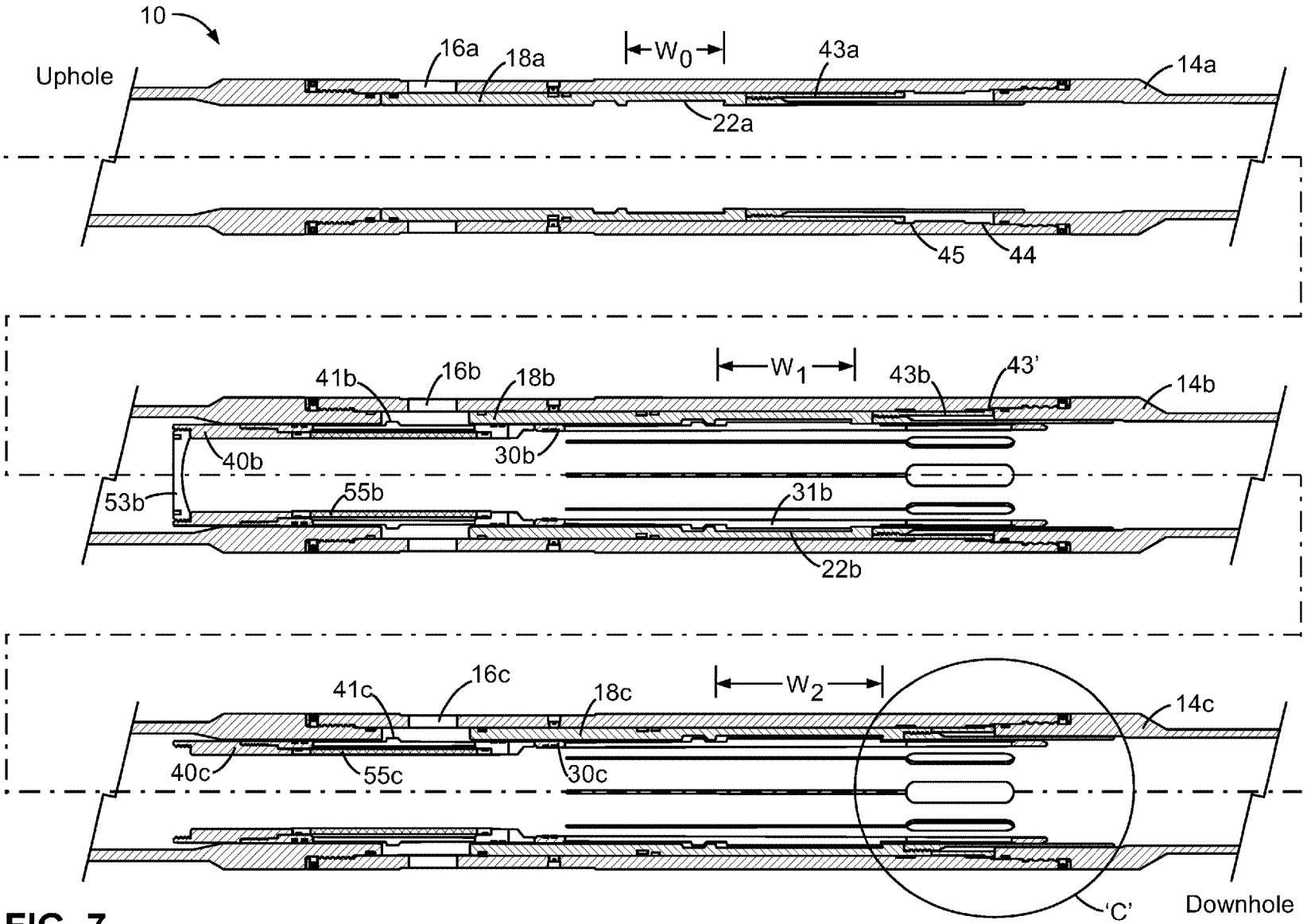

As may be seen from the subsequent configuration of the system/method 10 depicted in FIG. 7, a sand screen sub 40*b* (identical to sand screen sub 40*c*, as depicted in area "D" of FIG. 4 and in enlarged view in FIG. 14) has been flowed downhole in tubing liner 12 and come to rest against actuation member 30*b* which is now lockingly engaged with tubing liner 12.

Sand screen sub 40*b* likewise comprises a cylindrical hollow portion 51*b*, having at an uphole end thereof a dissolvable plug member or burst plate 53*b*, which at least for a limited time substantially obstructs passage of fluid within interior bore 13 and causes pressurized fluid injected downhole in tubing liner 12 to force sand screen sub 51*b* downhole into a position abutting an uphole end of actuation member 30*b*.

Importantly, sand screen sub 40*b* is provided with a cylindrical, longitudinally extending oil-permeable screen mesh 55*b* forming part of an outer periphery thereof. Screen mesh 55*b* when sand screen sub 40*b* is flowed into the above position abutting actuation member 30*b*, prevents ingress of sand into interior bore 13 of tubing liner 12 but permits ingress of oil from a hydrocarbon formation (not shown) into interior bore 13 of tubing liner 12 via opened frac port 16*b*.

When sand screen sub 40*b* is flowed into position as shown in FIG. 7, namely whereby screen mesh 55*b* underlies opened frac port 16*b*, a resiliently outwardly-biased retaining member 41*b* extends radially outwardly into an annular region 50*b* formed within tubing liner 12, thereby then preventing any subsequent uphole displacement of sand screen sub 40*b* within tubing liner 12.

Similar to the configuration shown in FIG. 14 as regards sand screen sub 40*c*, as regards sand screen sub 40*b*, retaining member 41*b* thereon is provided with a chamfer 60*b* on a downhole side edge thereof and a substantially flat face 59*b* on an uphole side edge thereof perpendicularly disposed to a longitudinal axis 70 of tubular liner 12. Downhole movement of sand screen sub 40*b* within tubing liner 12 is thereby allowed by chamfer 60*b* causing outwardly-biased retaining member 41*b* to be radially depressed upon engagement with abutting edges of circumferential interior groove profile 22*a* in tubing liner 12, thereby allowing passage of sand screen sub 41*b* downhole past said circumferential interior groove profile 22*a* in tubing liner 12 and allow sand screen sub 41*b* to flow downhole to a position abutting actuation member 30*b* and where screen mesh 55*b* thereof underlies opened frac port 16*b*. Any subsequent uphole displacement of sand screen sub 41*b* from the aforesaid position is prevented by flat face 59*b* engaging, directly or indirectly, annular region 50*b* in tubing liner 12, namely by contacting an uphole edge of annular region 50*b*, as shown in FIG. 7.

Figure 7A:
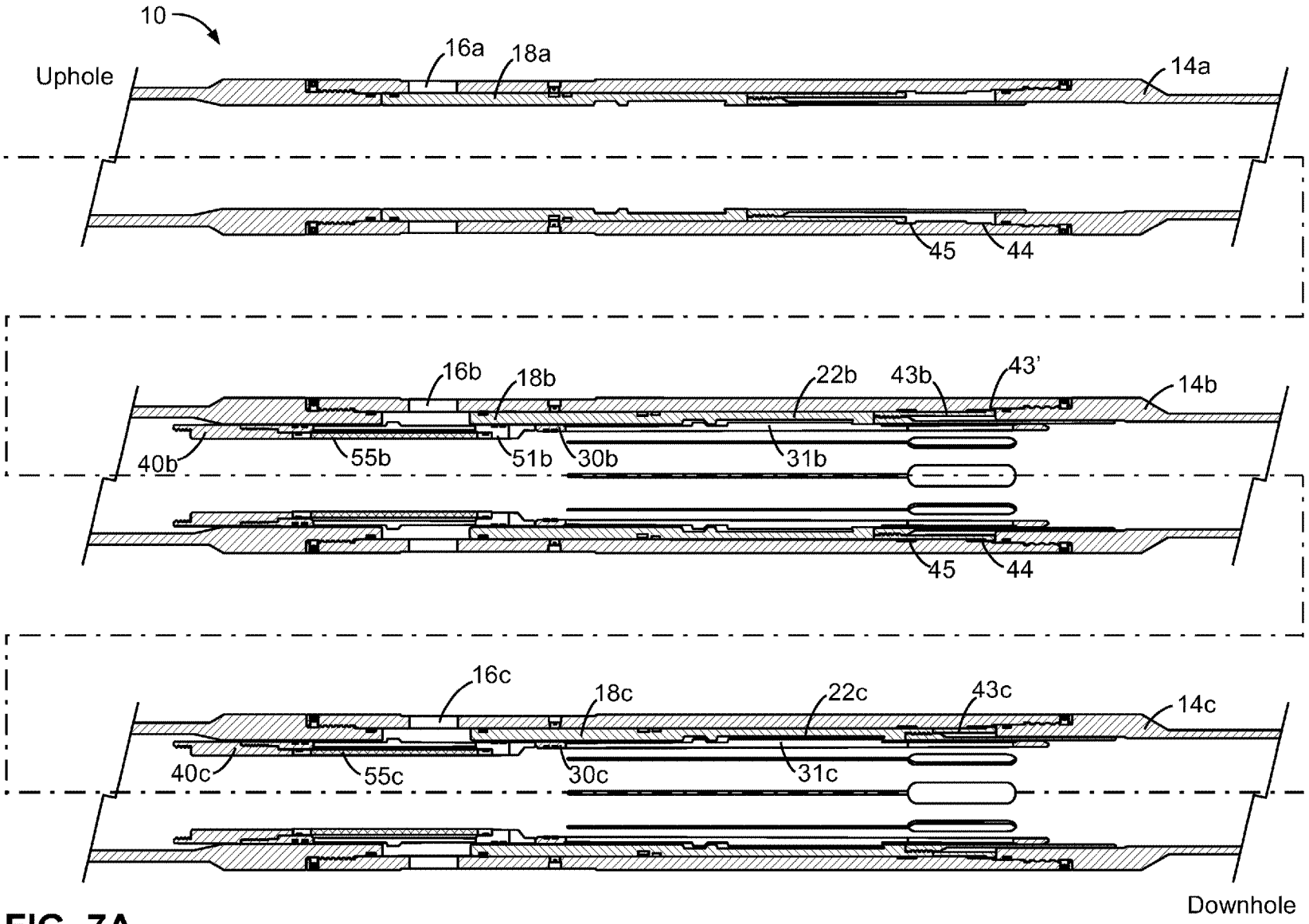
FIG. 7A is a subsequent view of the tubing liner of FIG. 7 wherein fluid applied uphole has caused bursting and subsequent disappearance of, or corrosive dissolution of, a plug member on an uphole side of said second sand screen sub.

Thereafter, as may be seen from the subsequent configuration of the system/method 10 depicted in FIG. 7A, one of either two things has occurred-either a pulse of high pressure fluid has been applied to the uphole side of a frangible disk 53*b* of sand screen sub 40*b* so as to cause disk 53*b* to rupture and disintegrate, or if disk 53*b* is of a dissolvable type upon application of a corrosive fluid (not shown), a corrosive fluid has been flowed downhole to dissolve disk 53*b*.

Figure 8:
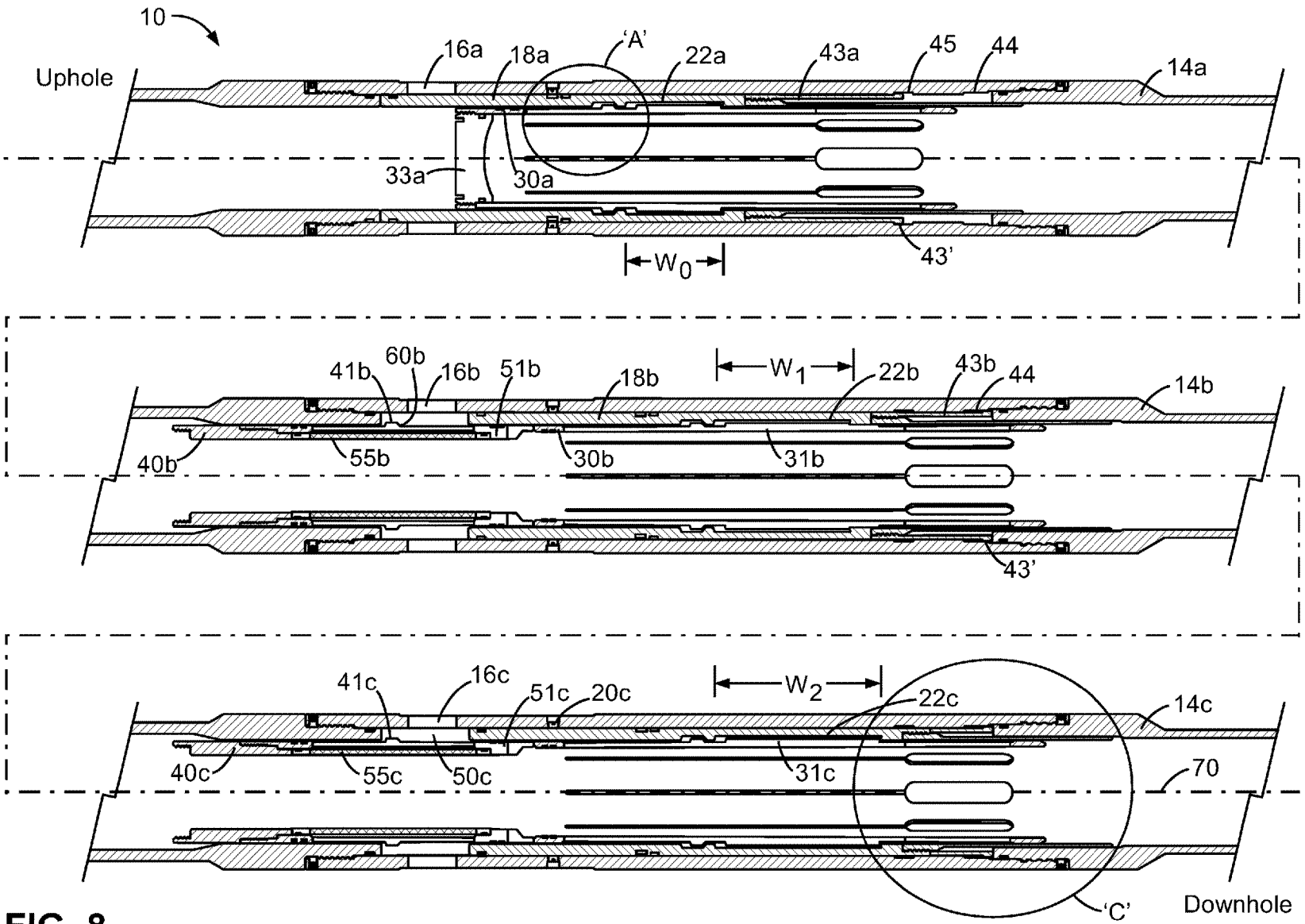
Figure 15E:
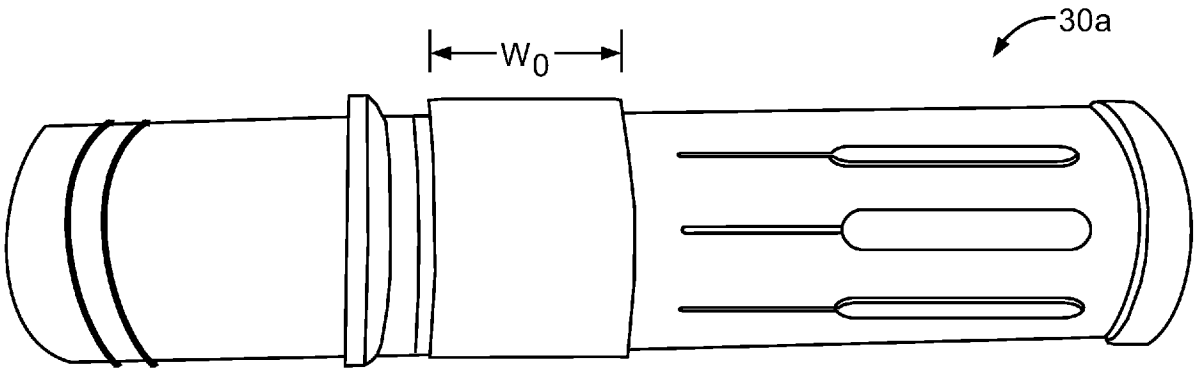
FIG. 15*e* is an enlarged view of the third actuation member, shown for example in FIG. 8, having a radially outwardly biased protuberance having a profile of width "$W_0$"
Figure 15F:
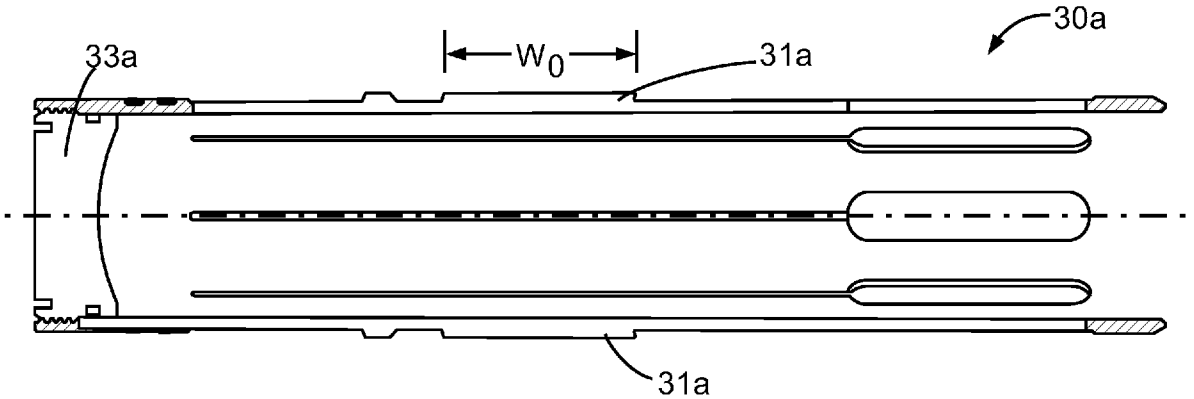
FIG. 15*f* is a cross section through the second actuation member of FIG. 15*e*, with the burst plate on the third actuation member still intact.

FIG. 8 shows a further successive step in the system/method 10, wherein a third actuation member 30*a* [as best shown in enlarged (perspective) view in FIG. 15*e* and in enlarged cross-sectional view in FIG. 15*f*] and having a frangible burst disk or a dissolvable disk 33*a* at an uphole side thereof, is flowed down tubing liner 12 and to discrete section 14*a* by applying a pressurized fluid to an uphole side of actuation member 30*a*. Due to radially outwardly biased protuberance 31*a* having a unique profile/width $W_0$ which only matingly engages the interior circumferential groove profile 22*a* of width $W_1$, only sliding sleeve member 18*a* is engaged by actuation member 30*a*. Circled area 'A', shown in enlarged view in FIG. 11, depicts shear member 20*a*, prior to being sheared, securing sliding sleeve member 18*a* to tubular liner segment 14*a*, and shows annular groove 39 in sliding sleeve member 18*a* having bevelled edge 39' thereon to allow the radially outwardly biased protuberance 31*a* of actuation member 30*a* to pass over annular groove 39 and engage interior circumferential groove profile 22*a* on sliding sleeve member 18*a*.

Similar to the configuration of sliding sleeve member 18*b* and 18*c*, a downhole end of sliding sleeve member 18*a* comprises a plurality of longitudinally-extending collet fingers 43*a*, radially outwardly biased, each adapted at distal ends 43' thereof to matingly engage with at least one annular circumferential ring 44 on tubular liner 12, when slidable sleeve member 18*a* is moved to the open position uncovering frac/production port 16*a* (see FIG. 9, as described below). When sliding sleeve member 18*a* is initially in the closed position, distal ends 43' thereof may matingly engage a more uphole annular circumferential ring 45. In such manner the shearable member 20*a* is assisted in the temporary securement of slidable sleeve member 18*a* to discrete section 14*a* of tubing liner 12.

Figure 9:
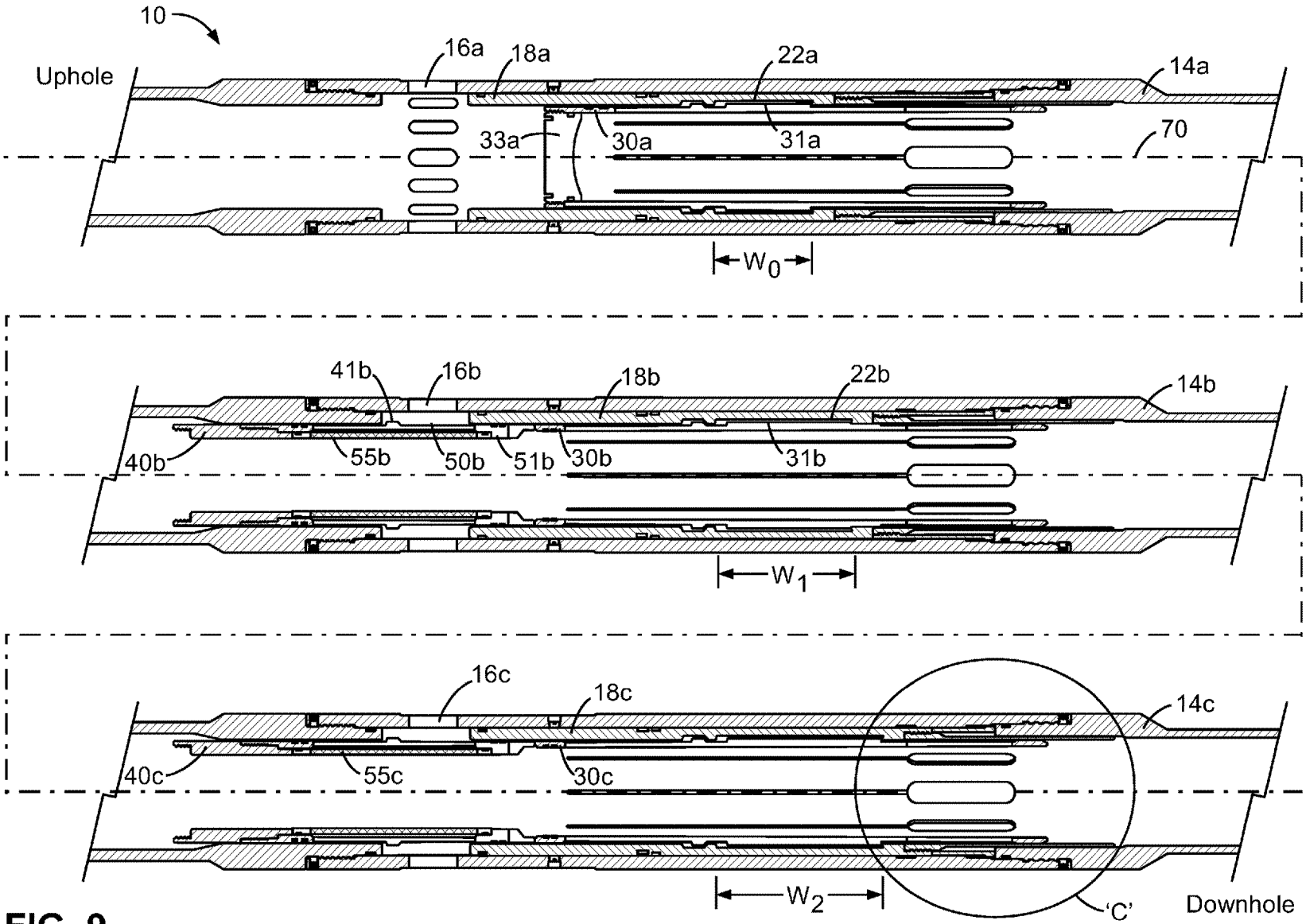

As may be seen from the subsequent configuration of the system/method 10 depicted in FIG. 9, continued injection of pressurized fluid within tubing liner 12 has caused continued force to be applied to an uphole side of actuation member 30*a*, namely against frangible burst disk or a dissolvable disk 33*a*, causing actuation member 30*a* which is lockingly engaged with sliding sleeve member 18*a*, to together slidably move downhole whereby frac/production port 16*a* becomes uncovered and thus opened to fluid communication with interior bore 13 of tubing liner 12. Similar to the configuration shown in FIG. 13 in regard to sliding sleeve member 18*c*, the plurality of collet fingers 43*a* on sliding sleeve member 18*a*, at the distal end 43' thereof, has due to downhole displacement of slidable sleeve member 18*a* matingly engaged annular circumferential ring 45 in tubular liner 12. Similar to the configuration shown in FIG. 13 as regards sliding member 18*c*, sliding sleeve member 18*a* has accordingly then been lockingly fixed in position and prevented from not only further progression downhole but also from returning to a closed position covering frac port 16*a*.

Further fracking of the reservoir, at the particular location of the now-opened frac port 16*a*, is carried out at this point in the method/system 10.

Figure 9A:
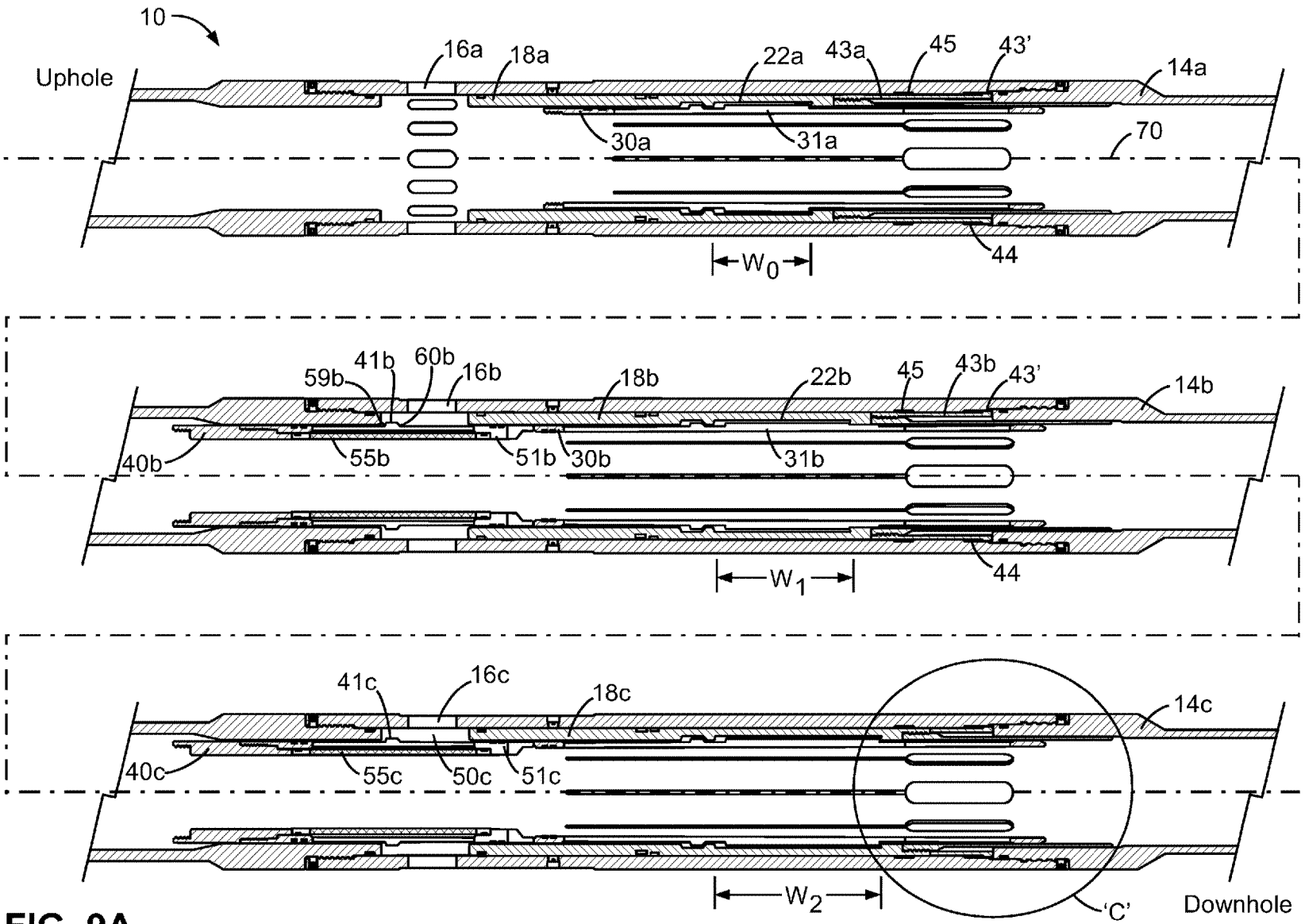
FIG. 9A is a subsequent view of the tubing liner of FIG. 6, wherein fluid applied uphole has caused bursting and subsequent disappearance of, or corrosive dissolution of, a plug member on an uphole side of the third sand screen sub.

Thereafter, as may be seen from the subsequent configuration of the system/method 10 depicted in FIG. 9A, one of either two things has occurred-either a pulse of high pressure fluid has been applied to the uphole side of a frangible disk 33*a* of actuation member 30*a* so as to cause disk 33*a* to rupture and disintegrate, or if disk 33*a* is of a dissolvable type upon application of a corrosive fluid (not shown), a corrosive fluid has been flowed downhole to dissolve disk 33*a*.

Figure 10:
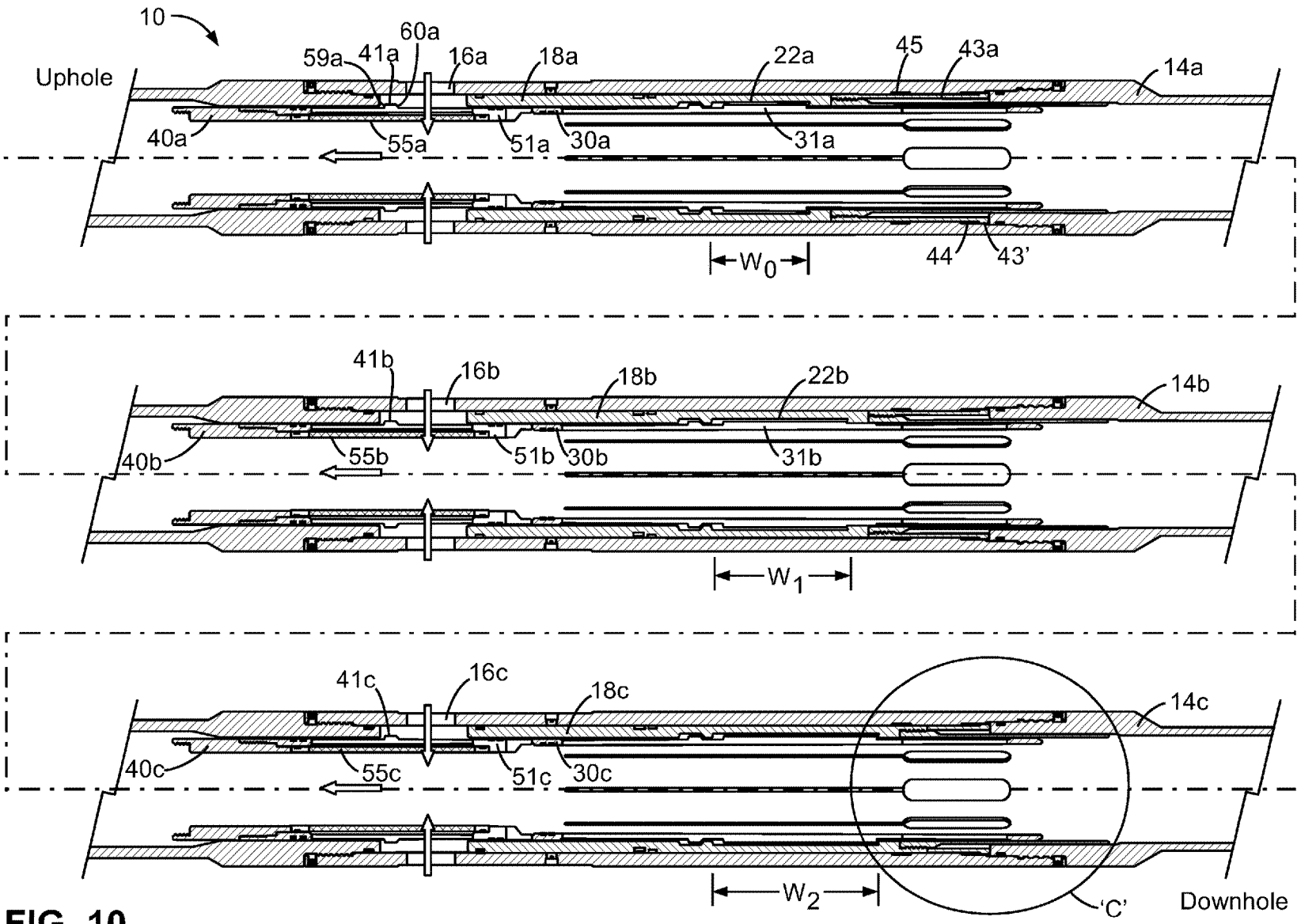
Figure 16A:
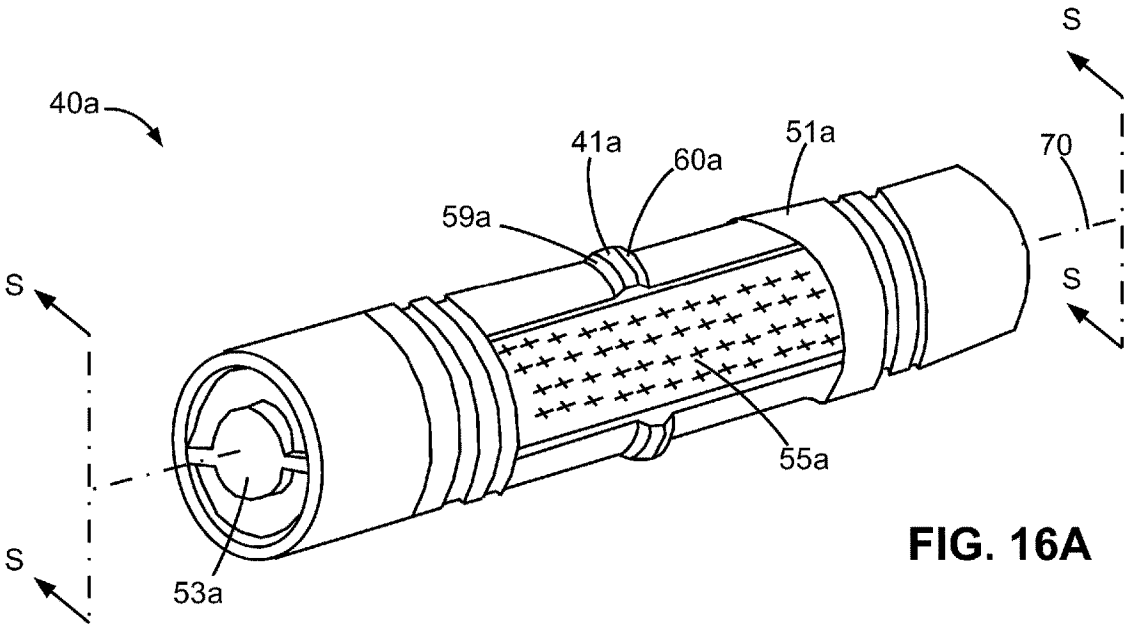
FIG. 16*a* is a perspective view of a sand screen sub, having a resiliently outwardly biased retaining member thereon.
Figure 16B:
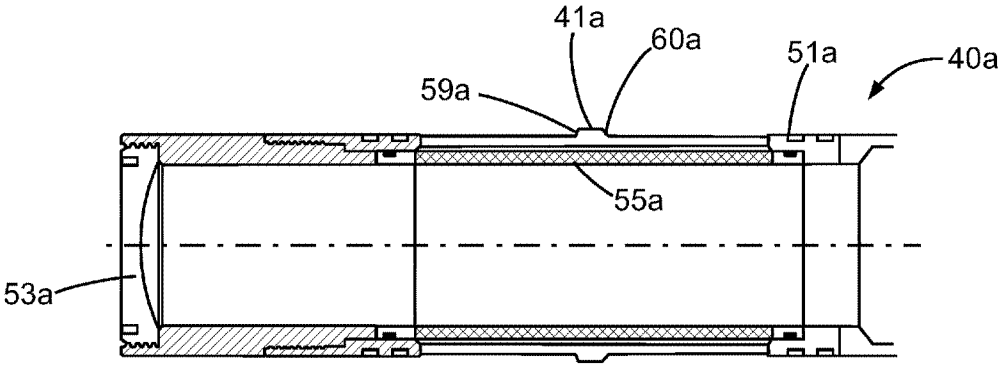
FIG. 16*b* is a cross-section of the sand screen sub shown in FIG. 16*a*, taken along plane 'S'-'S'.

As may be seen from the subsequent configuration of the system/method 10 depicted in FIG. 10, a sand screen sub 40*a* (identical to sand screen sub 40*c* as depicted in area "D" of FIG. 4 and in enlarged view in FIG. 14), and as shown in FIG. 16*a* (perspective view) and in FIG. 16*b* (cross-section) has been flowed downhole in tubing liner 12 and come to rest against actuation member 30*a* which is now lockingly engaged with tubing liner 12.

As best seen from FIGS. 16*a*, 16*b*, sand screen sub 40*a* likewise comprises a cylindrical hollow portion 51*a*, having at an uphole end thereof a dissolvable plug member or burst plate 53*a*, which at least for a limited time substantially obstructs passage of fluid within interior bore 13 and causes pressurized fluid injected downhole in tubing liner 12 to force sand screen sub 51*b* downhole into a position abutting an uphole end of actuation member 30*a*.

Importantly, sand screen sub 40*a* is provided with a cylindrical, longitudinally extending oil-permeable screen mesh 55*a* forming part of an outer periphery thereof. Screen mesh 55*a* when sand screen sub 40*a* is flowed into the above position abutting actuation member 30*a*, prevents ingress of sand into interior bore 13 of tubing liner 12 but permits ingress of oil from a hydrocarbon formation (not shown) into interior bore 13 of tubing liner 12 via opened frac port 16*a*.

When sand screen sub 40*a* is flowed into position as shown in FIG. 10, namely whereby screen mesh 55*a* underlies opened frac port 16*a*, a resiliently outwardly-biased retaining member 41*a* extends radially outwardly into an annular region 50*a* formed within tubing liner 12, thereby then preventing any subsequent uphole displacement of sand screen sub 40*a* within tubing liner 12.

Similar to the configuration shown in FIG. 14 as regards sand screen sub 40*c*, as regards sand screen sub 40*a*, retaining member 41*a* thereon is provided with a chamfer 60*a* on a downhole side edge thereof and a substantially flat face 59*a* on an uphole side edge thereof perpendicularly disposed to a longitudinal axis 70 thereof and of tubular liner 12. Downhole movement of sand screen sub 40*a* within tubular liner 12 is thereby allowed by chamfer 60*a* causing outwardly-biased retaining member 41*a* to be radially depressed upon engagement with any abutting edges of circumferential interior groove profiles in tubing liner 12, thereby allowing passage of sand screen sub 41*a* downhole past said circumferential interior groove profiles in tubing liner 12 and allowing sand screen sub 41*a* to flow downhole to a position abutting actuation member 30*a* and where screen mesh 55*a* thereof underlies opened frac port 16*a*. Any subsequent uphole displacement of sand screen sub 41*a* from the aforesaid position is prevented by flat face 59*a* engaging, directly or indirectly, annular region 50*a* in tubing liner 12, namely by contacting an uphole edge of annular region 50*a* as shown in FIG. 10.

A pulse of high pressure fluid has been applied to the uphole side of a frangible disk 53*a* of sand screen sub 40*a* so as to cause disk 53*a* to rupture and disintegrate, or if disk 53*a* is of a dissolvable type upon application of a corrosive fluid (not shown), a corrosive fluid has been flowed downhole to dissolve disk 53*a*.

Production from the tubing liner may then proceed, as shown in FIG. 10 via all opened frac/production ports 16*a*, 16*b*, 16*c*, each of which is provided with an underlying respective screen sub 40*a*, 40*b*, 40*c*, with a respective screen mesh 55*a*, 55*b*, 55*c* immediately underlying the respective frac/production port 16*a*, 16*b*, 16*c*.

Operation of the Method/System 10 Depicted in FIGS. 1-10

The first step of the system/method of FIG. 1-10, as shown in FIG. 1, comprises locating a tubular liner 12 having:

a hollow interior bore 13;

a plurality of frac ports 16*a*, 16*b*, 16*c* spaced along a periphery of tubular liner 12;

a corresponding plurality of sliding sleeve members 18*a*, 18*b*, 18*c* respectively initially covering each of said frac ports 16*a*, 16*b*, 16*c*; Within a wellbore (not shown)

The second step of the method of FIG. 1-10 is depicted as a series of sub-steps shown in FIGS. 2-3A, and comprises;

situating a first actuation member 30*c* having a resiliently outwardly biased protuberance 31*c* of a first profile W2, within said tubular liner 12; and applying a pressurized fluid to an uphole end of said first actuation member 30*c* and causing said first actuation member 30*c* to flow downhole and to a position in said tubular liner 12 where said radially outwardly-biased protuberance 31*c* thereon engages a mating profile 22*c* on sliding sleeve member 18*c* (FIG. 2);

continuing to apply said pressurized fluid to said tubular liner 12 and causing said one sliding sleeve member 18*c* and actuation member 30*c* to together move downhole and uncover and thereby open an associated of said frac ports 16*c* in said tubular liner 12 and thereby allow fluid communication from said interior bore 13 to an exterior of said tubular liner 12 via the opened associated frac port 16*c*, and injecting a fracking fluid under pressure into said tubular liner 12 and causing said frac fluid to flow into the hydrocarbon formation via the opened frac port (FIG. 3); and introducing a fracking fluid (not shown) under still higher pressure, or injecting a corrosive fluid, so as to burst or dissolve, respectively a plug member 33*c* on an uphole side of actuation member 30*c* (FIG. 3A).

A subsequent step in the system/method 10, as shown in FIGS. 4 & 4A, comprises:

inserting a first sand screen sub 30*c* into said tubular liner 12, said first sand screen sub 30*c* having:

a resiliently-outwardly biased protuberance 41*c* having a given profile; and an annular screen mesh 55*c* about an outer periphery of said first sand screen sub 40*c*; and applying a pressurized fluid to an uphole end of first sand screen sub 40*c* and causing the first sand screen sub 40*c* to flow downhole to a position in said tubular liner 12 where said annular screen mesh 55*c* thereof underlies the open frac port 16*c* and causing said profile of said resiliently-outwardly biased protuberance 41*c* thereon to engage a mating profile 50*c* on an interior of said tubular liner 12, namely an annular region 50*c* thereof, so as to retain the first sand screen sub 40*c* in a position where the annular screen mesh 55*c* thereof underlies said open frac port 16*c*.

The above steps of the method described may be repeated using a second actuation member 30*b* to open uphole frac/production port 16*b* and insert a second sand screen sub 40*b* immediately underlying the opened frac/production port 16*b*, as shown in FIGS. 5-7A, varying only that the second actuation member 30*b* used has a radially outwardly biased protuberance 31*b* thereon of a width W1, where width W1<W2, so as to only engage a corresponding interior circumferential groove profile 22*b* on a corresponding sliding sleeve member 18*b*.

Likewise, the above steps may be repeated to open a further uphole frac/production port 16*a* using a third actuation member 30*a* and insert a third sand screen sub 40*a* immediately underlying the opened frac/production port 16*a*, as shown in remaining FIGS. 8-10, varying only that a third actuation member 30*a* used has a radially outwardly biased protuberance 31*a* thereon of a width W0, where width W0<W1, so as to only engage a corresponding interior circumferential groove profile 22*a* on a corresponding sliding sleeve member 18*a*.

Description of Related Method/System 100

FIGS. 17-24A depict successive steps and configuration of a related but somewhat different method/system 100 of the present invention.

Specifically, method/system 100 like method/system 10 utilizes not only a plurality of configurationally-different actuation members 30*a*, 30*b*, 30*c* as per method/system 10, but in addition utilizes a corresponding plurality of configurationally-different sand screen subs 140*a*, 140*b*, and 140*c*.

Figure 17:
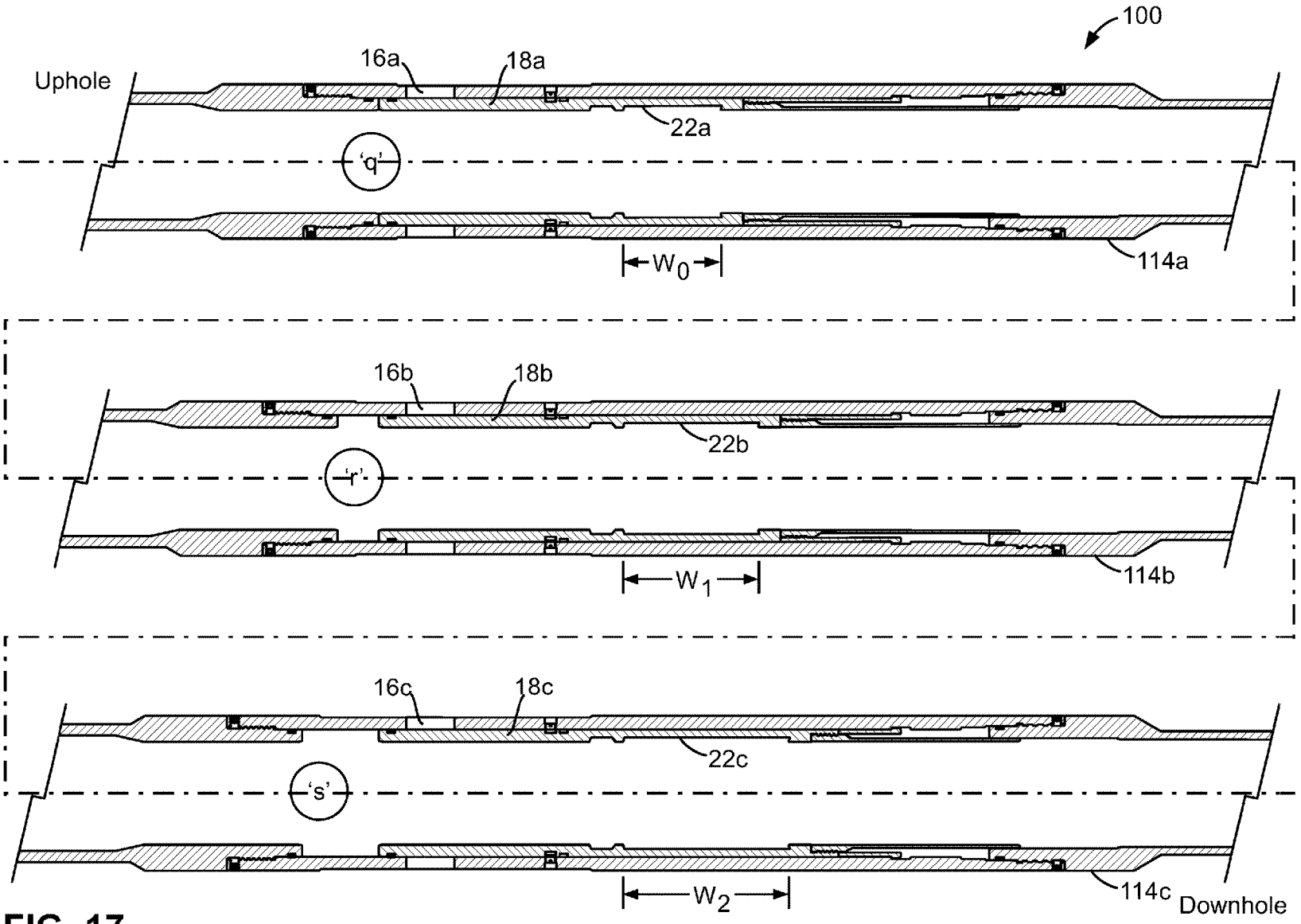

As seen from FIG. 17, the tubular liner 12 of method/system 100 comprises, like method/system 10, a plurality of individually different segments 114*a*, 114*b*, and 114*c*, each with a corresponding frac/production port 16*a*, 16*b*, 16*c*. Similar to method/system 10, each discrete segment 114*a*, 114*b*, 114*c*, has a slidable sleeve member 18*a*, 18*b*, 18*c* wherein the interior circumferential groove profile 22*a*, 22*b*, 22*c* of each is of a different width/profile W0, W1, W2, where W0<W1<W2, with the most downhole interior circumferential groove profile 22*c* on the most downhole sliding sleeve member 18*c* being the largest width.

Notably, however, in comparison to the discrete segments 14*a*, 14*b*, 14*c* of method/system 10, discrete segments 114*a*, 114*b*, and 114*c* of the method/system 100 are configurationally different in region "q", 'r', and 's', to provide the advantage of being able to individually matingly engage particular sand screen subs 140*a*, 140*b*, and 140*c* at a particular desired location along tubular liner 12, in the manner hereinafter explained and depicted in FIGS. 20, 22, and 24.

Figure 18:
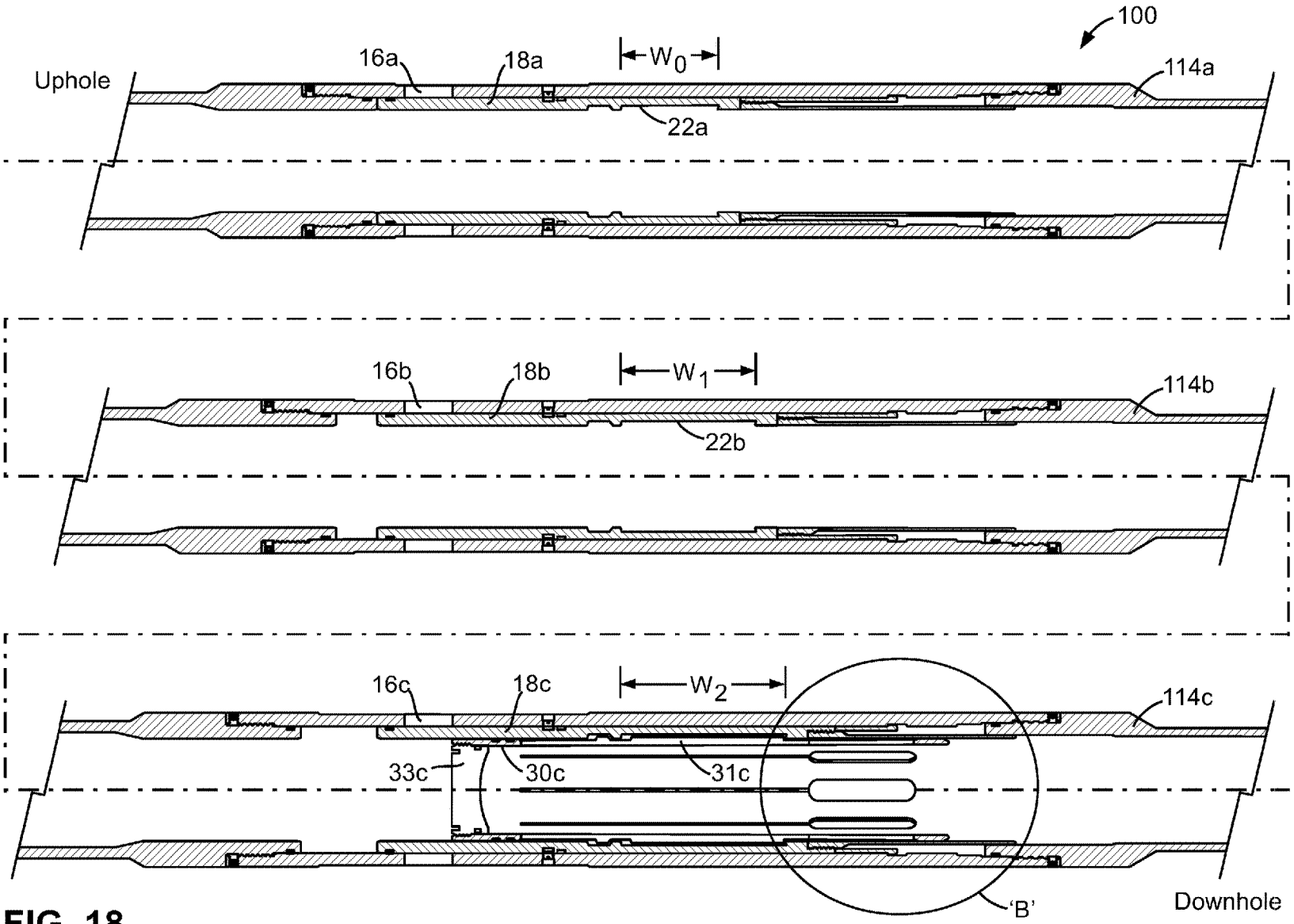

FIG. 18 shows a further successive step in the system/method 100, where an actuation member 30*c* having a radially outwardly biased protuberance 31*c* thereon of width/profile W2, is flowed down tubing liner 12, until radially outwardly biased protuberance 31*c* thereon matingly engages interior circumferential groove profile 22*c* on corresponding sliding sleeve member 18*c*.

Figure 19:
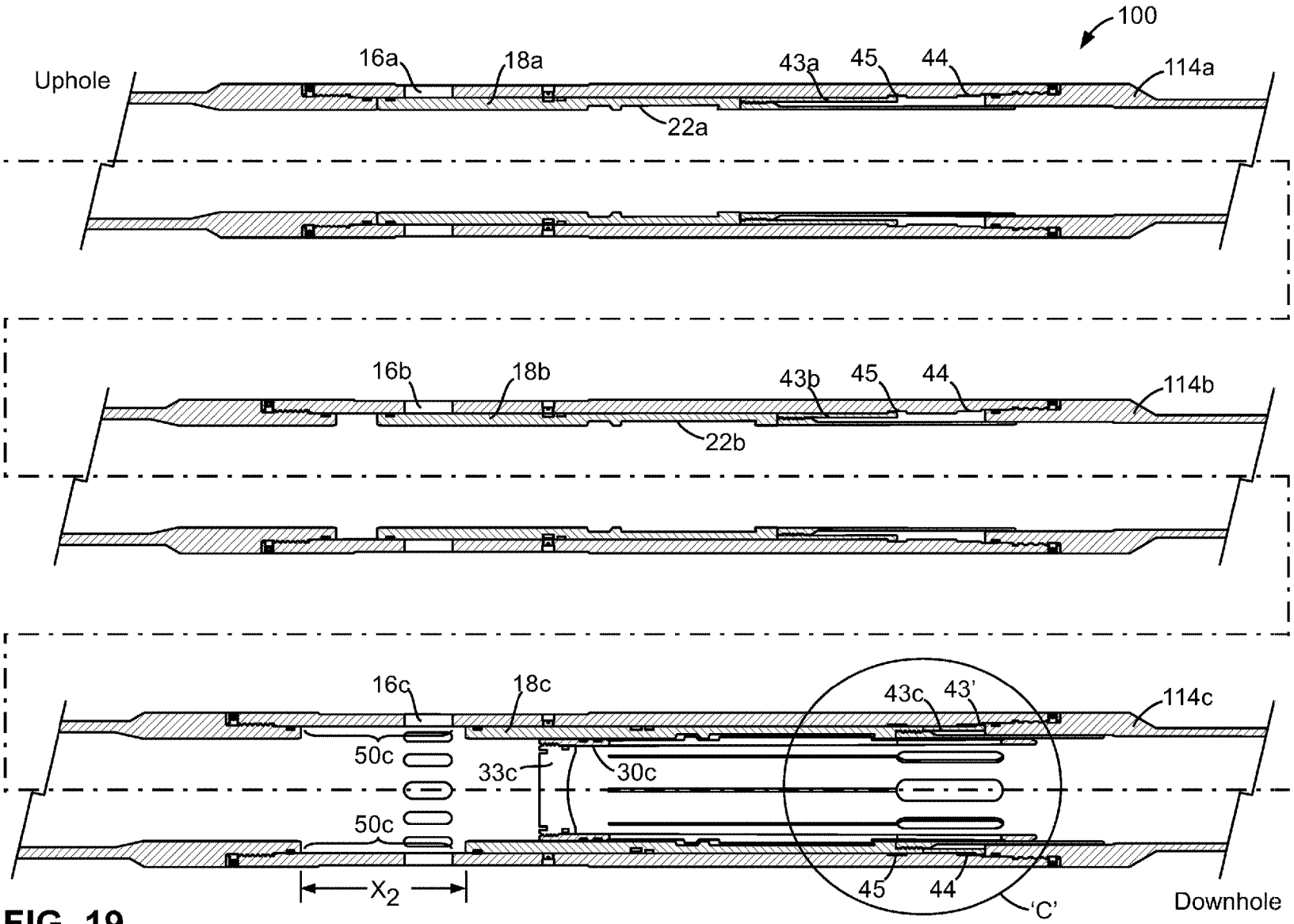

FIG. 19 shows a further successive step in the system/method 100, where actuation member 30*c*, due to fluid pressure being supplied at an uphole side thereof, is caused along with corresponding slidable sleeve member 18*c* to be forced downhole, thereby causing frac/production port 16*c* to be opened and collet fingers 43*c* on sliding sleeve member to lockingly engage annular ring 44 on tubular liner 12. Notably, by sliding sleeve member 18*c* being repositioned in tubing liner 12 in the aforementioned manner, an annular region 50*c* is thereby created immediately below opened frac/production 16*c*, of a width 'X2'.

Figure 19A:
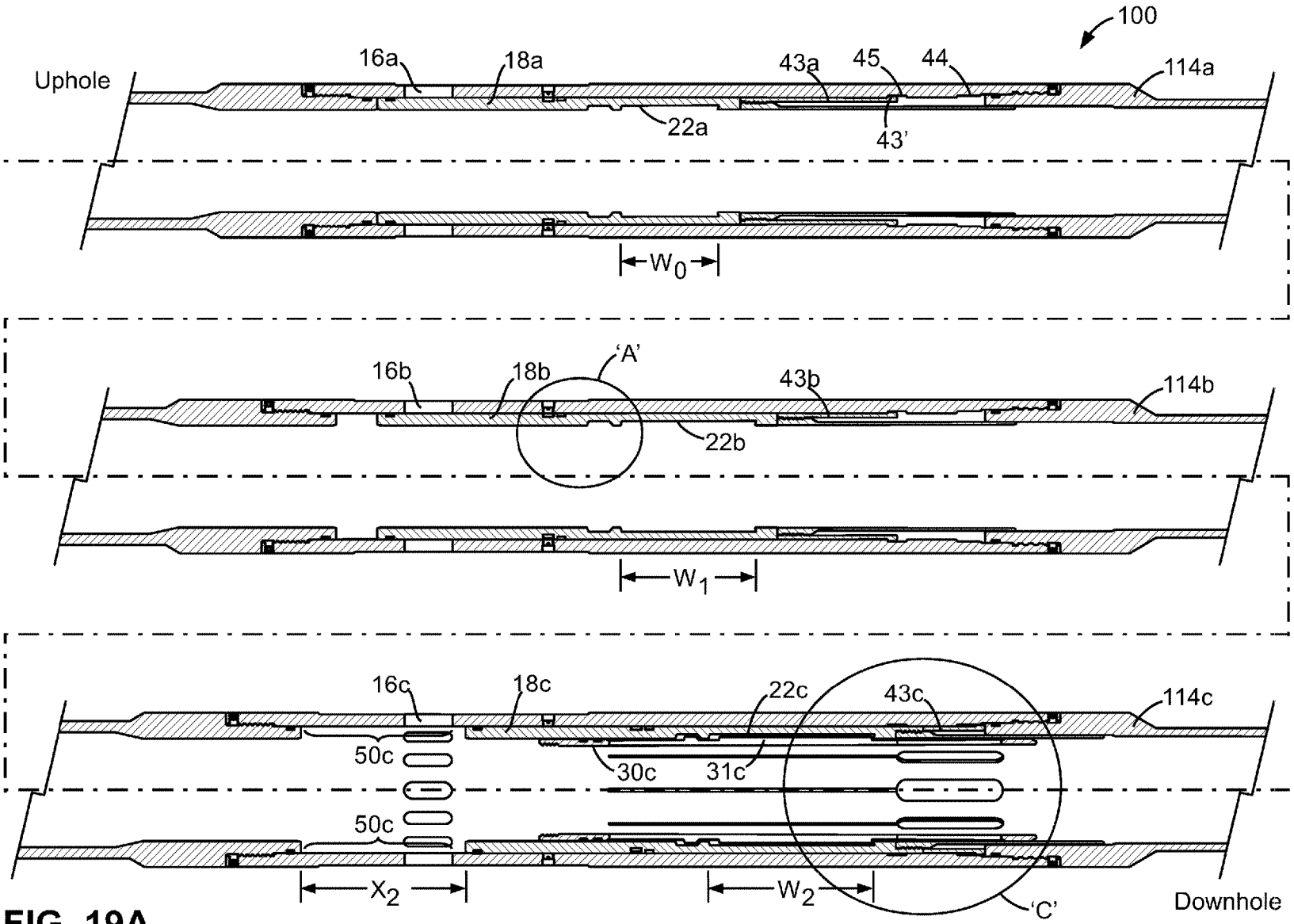
FIG. 19A is a subsequent view of the tubing liner of FIG. 19, wherein fluid applied uphole has caused bursting and subsequent disappearance of, or corrosive dissolution of, a plug member on an uphole side of said actuation member.

FIG. 19A shows a further successive step in the system/method 100, where one of either two things has occurred-either a pulse of high pressure fluid has been further applied to the uphole side of a frangible disk 33*c* of actuation member 30*c* so as to cause disk 33*c* to rupture and disintegrate, or if disk 33*c* is of a dissolvable type upon application of a corrosive fluid (not shown), a corrosive fluid has been flowed downhole to dissolve disk 33*c*.

Figure 20:
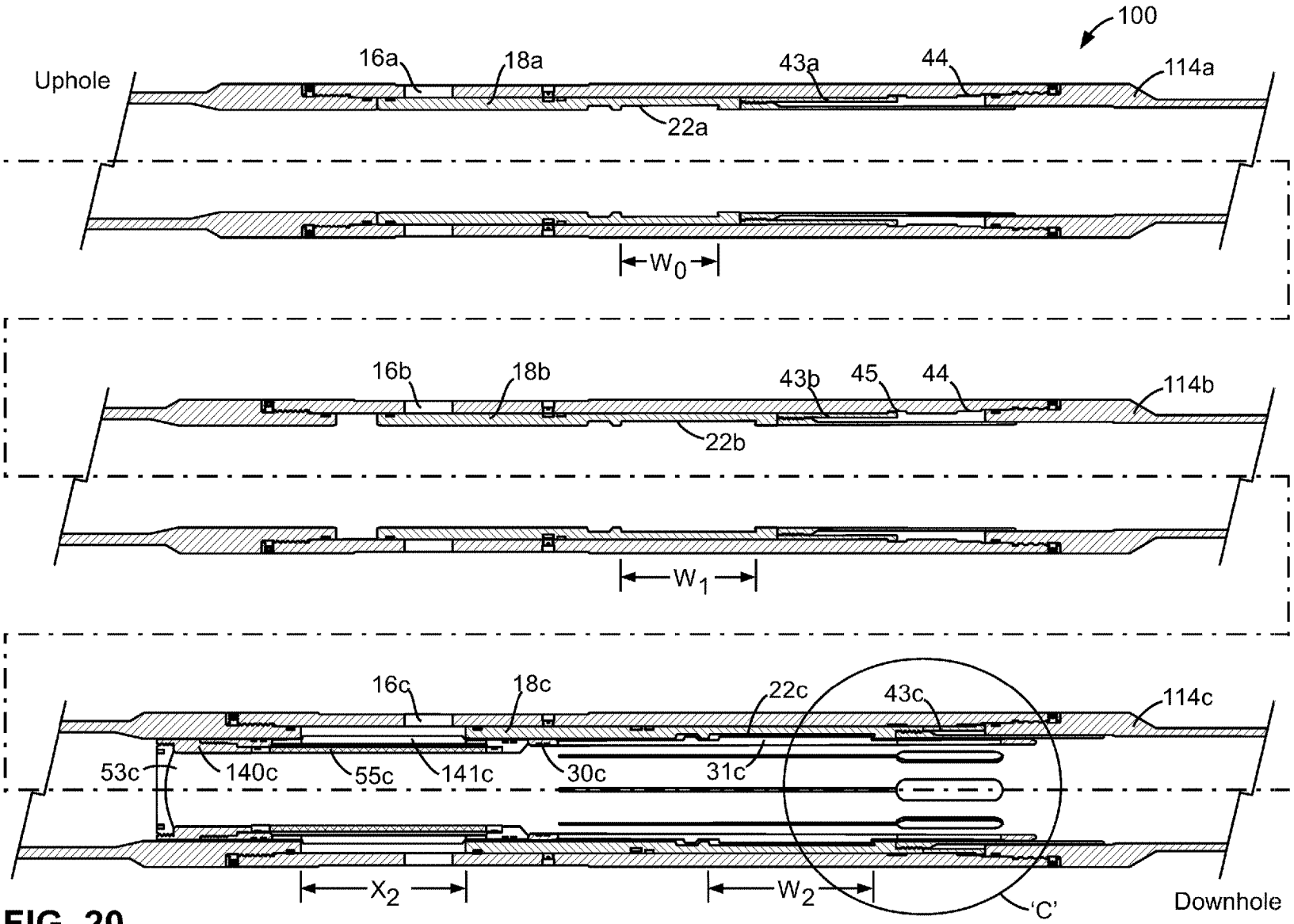
Figure 25A:
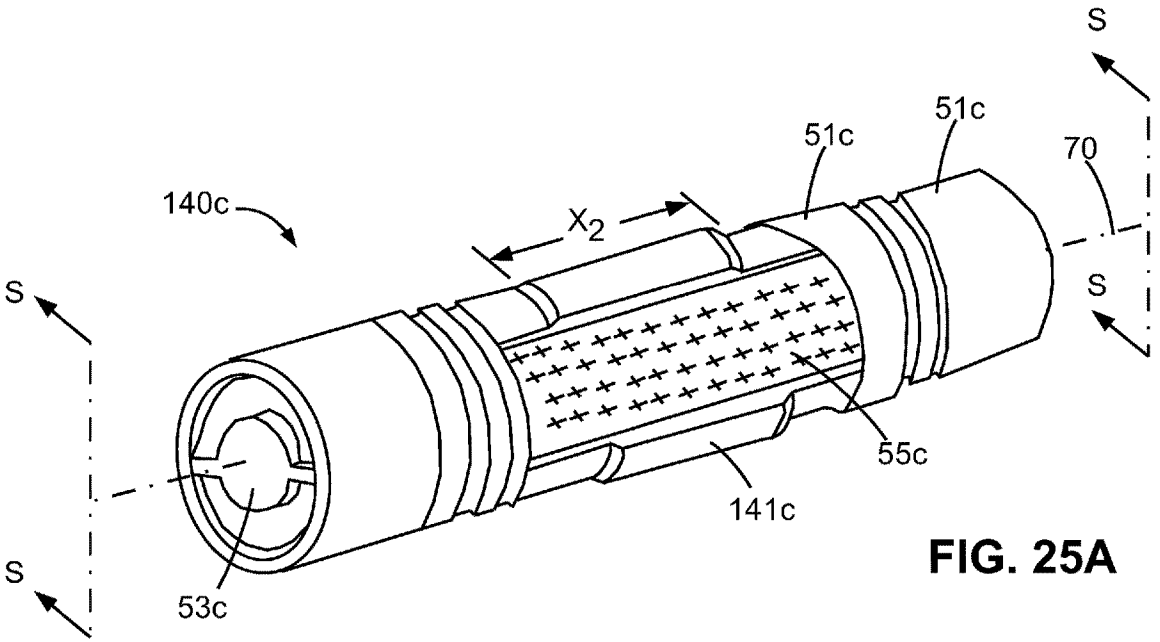
FIG. 25*a* is a perspective view of the first sand screen sub in the method of FIGS. 17-24A, having a resiliently outwardly biased retaining member thereon of width $X_2$.
Figure 25B:
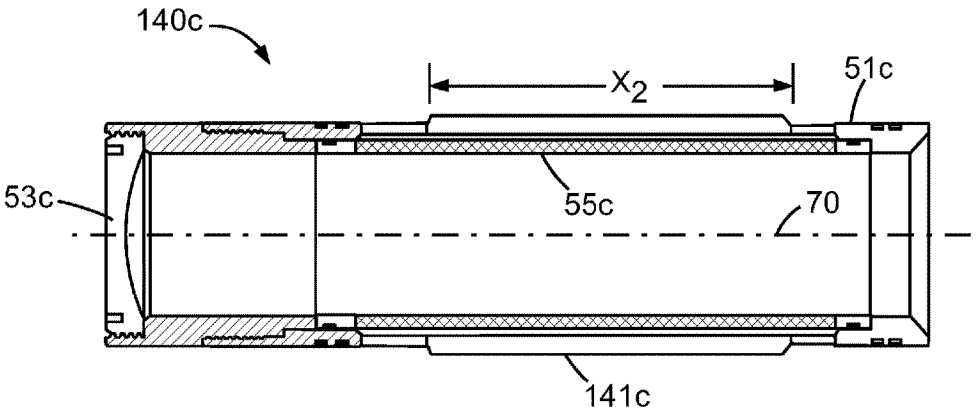
FIG. 25*b* is a cross-sectional view of the first sand screen sub of FIG. 25*a*, taken along plane 'S'-'S' of FIG. 25*a;*

FIG. 20 shows a further successive step in the system/method 100, where a first sand screen sub 140*c*, as best seen in FIGS. 25*a*, 25*b*, has been flowed downhole in tubing liner 12, and a radially outwardly biased retainer member 141*c* thereof, of width X2, has become lockingly engaged in annular region 50*c* of tubular liner 12, of similar width X2.

Figure 20A:
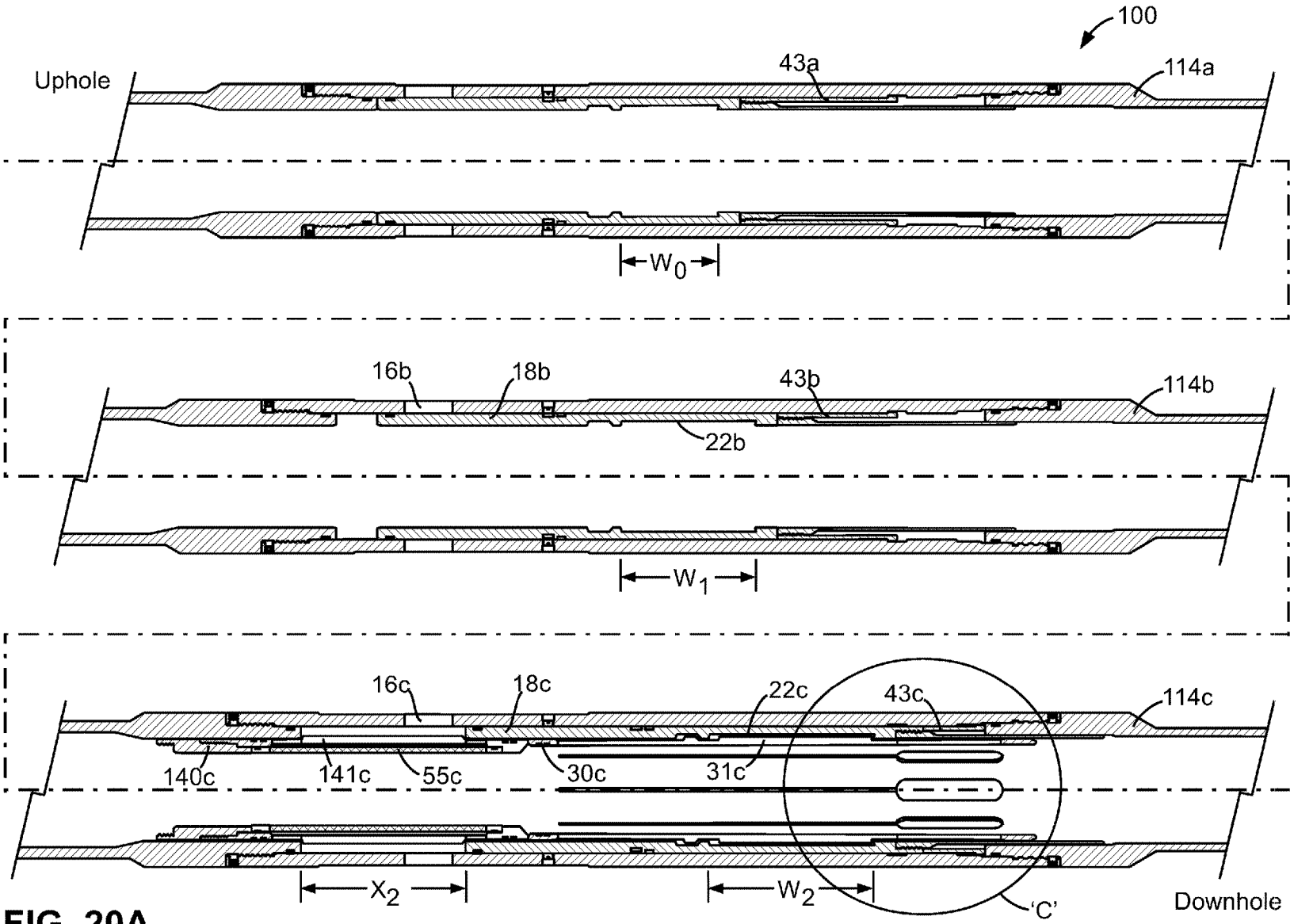
FIG. 20A is a subsequent view of the tubing liner of FIG. 20 wherein fluid applied uphole has caused bursting and subsequent disappearance of, or corrosive dissolution of, a plug member on an uphole side of said first sand screen sub.

FIG. 20A shows a further successive step in the system/method 100, where one of either two things has occurred-either a pulse of high pressure fluid has been further applied to the uphole side of a frangible disk 53*c* of sand screen sub 140*c* so as to cause disk 33*c* to rupture and disintegrate, or if disk 53*c* is of a dissolvable type upon application of a corrosive fluid (not shown), a corrosive fluid has been flowed downhole to dissolve disk 53*c*.

Figure 21:
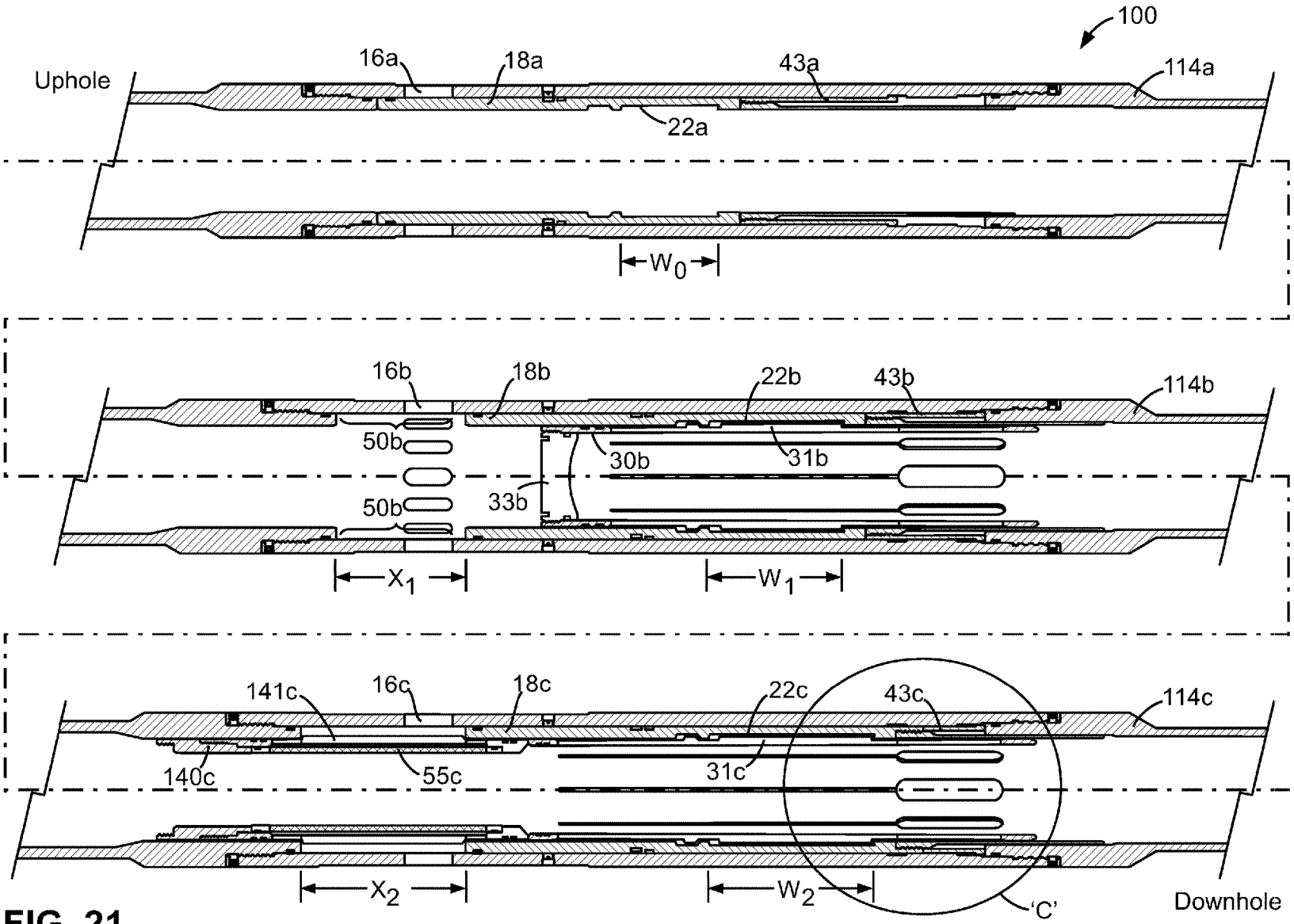

FIG. 21 shows a further successive step in the system/method 100, where a second actuation member 30*b* having a radially outwardly biased protuberance 31*b* thereon of width/profile W1, where W1<W2, is flowed down tubing liner 12 until radially outwardly biased protuberance 31*b* thereon matingly engages interior circumferential groove profile 22*b* of similar profile/width W1 on corresponding sliding sleeve member 18*b*.

Figure 21A:
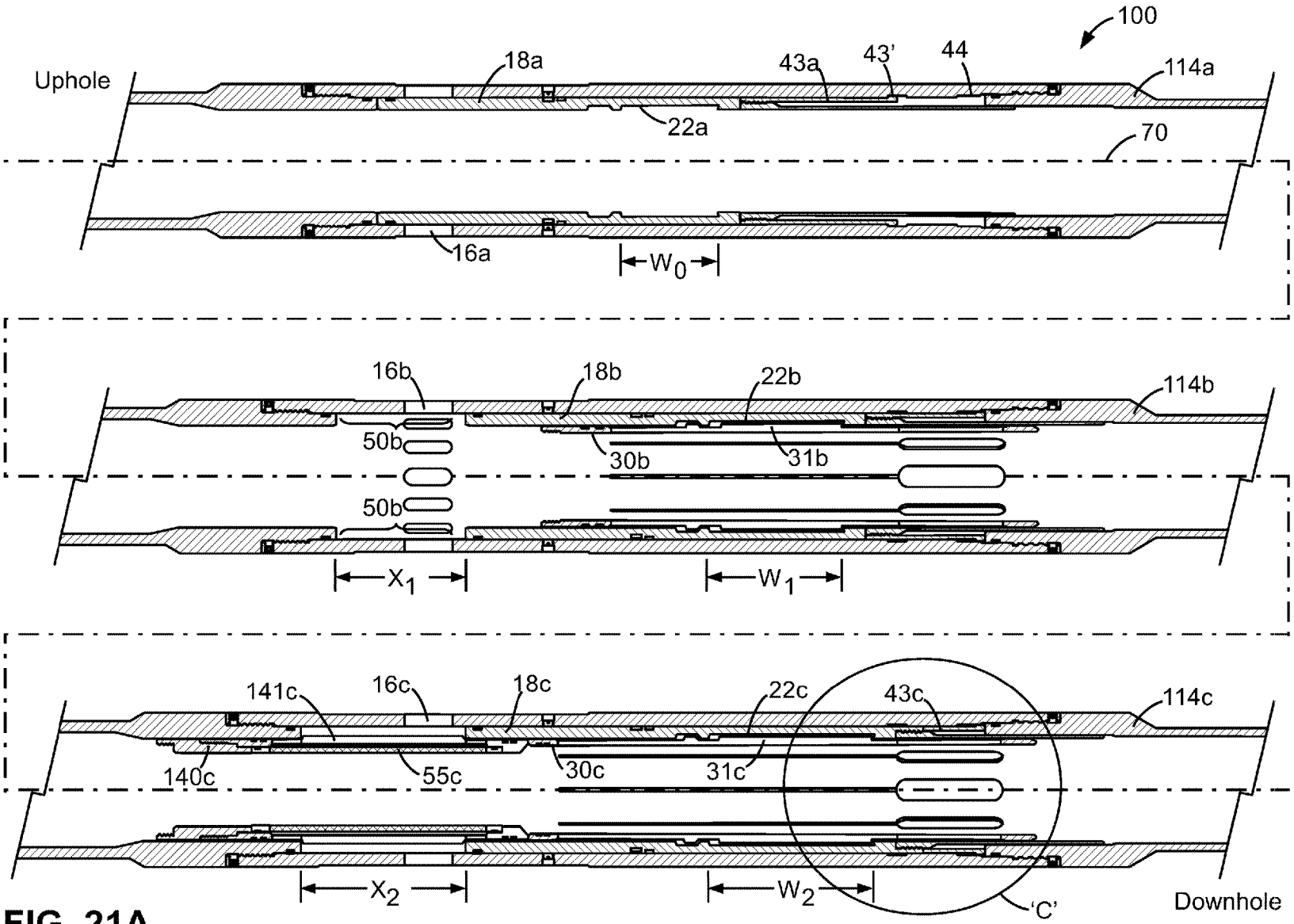
FIG. 21A is a subsequent view of the tubing liner of FIG. 21, wherein fluid applied uphole has caused bursting and subsequent disappearance of, or corrosive dissolution of, a plug member on an uphole side of the second sand screen sub.

FIG. 21A shows a further successive step in the system/method 100, where one of either two things has occurred-either a pulse of high pressure fluid has been further applied to the uphole side of a frangible disk 33*b* of second actuation member 30*b* so as to cause disk 33*b* to rupture and disintegrate, or if disk 33*b* is of a dissolvable type upon application of a corrosive fluid (not shown), a corrosive fluid has been flowed downhole to dissolve disk 33*b*.

Figure 22:
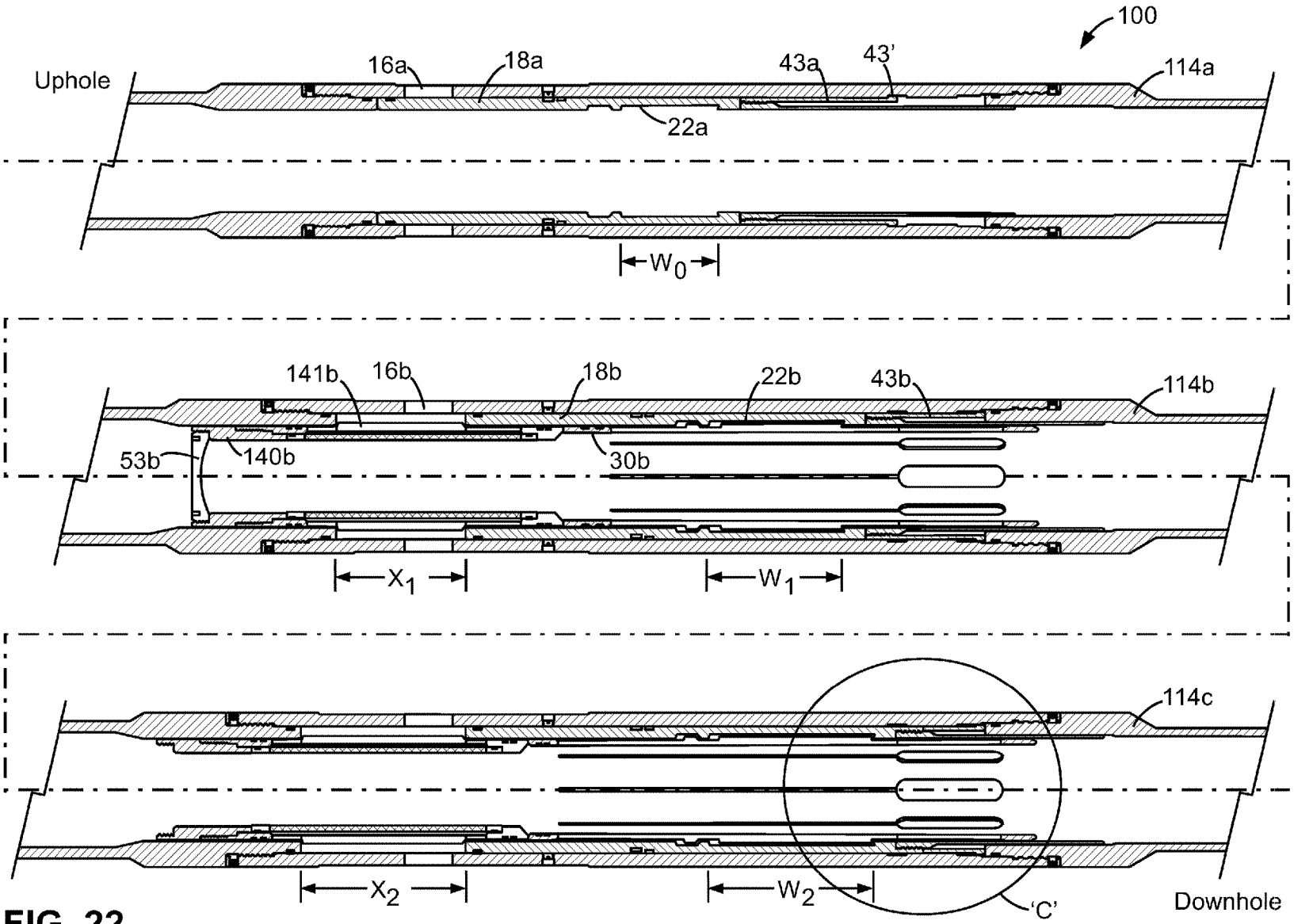
Figure 25C:
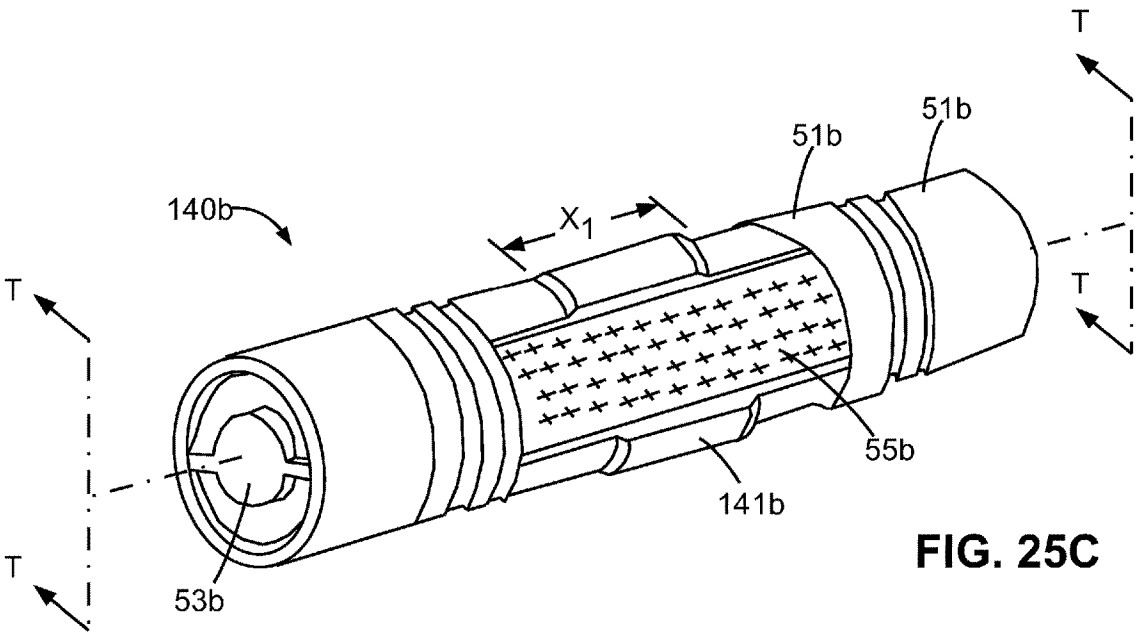
FIG. 25*c* is a perspective view of the second sand screen sub in the method of FIGS. 17-24A, having a resiliently outwardly biased retaining member thereon of width $X_1$.
Figure 25D:
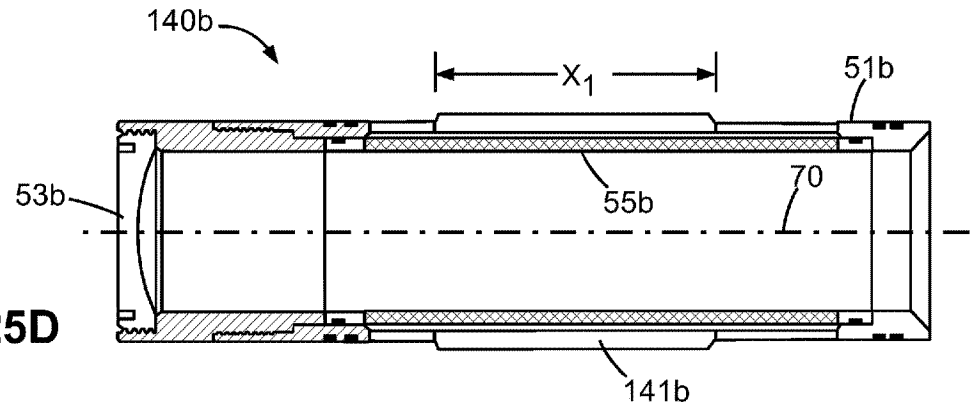
FIG. 25*d* is a cross-sectional view of the second sand screen sub of FIG. 26*a*, taken along plane 'T'-'T' of FIG. 25*c;*

FIG. 22 shows a further successive step in the system/method 100, where a second sand screen sub 140*b*, as best seen in FIGS. 25*c*, 25*d*, has been flowed downhole in tubing liner 12 and a radially outwardly biased retainer member 141*b* thereof, of width X1, has become lockingly engaged in annular region 50*b* of tubular liner 12, of similar width X1.

Figure 22A:
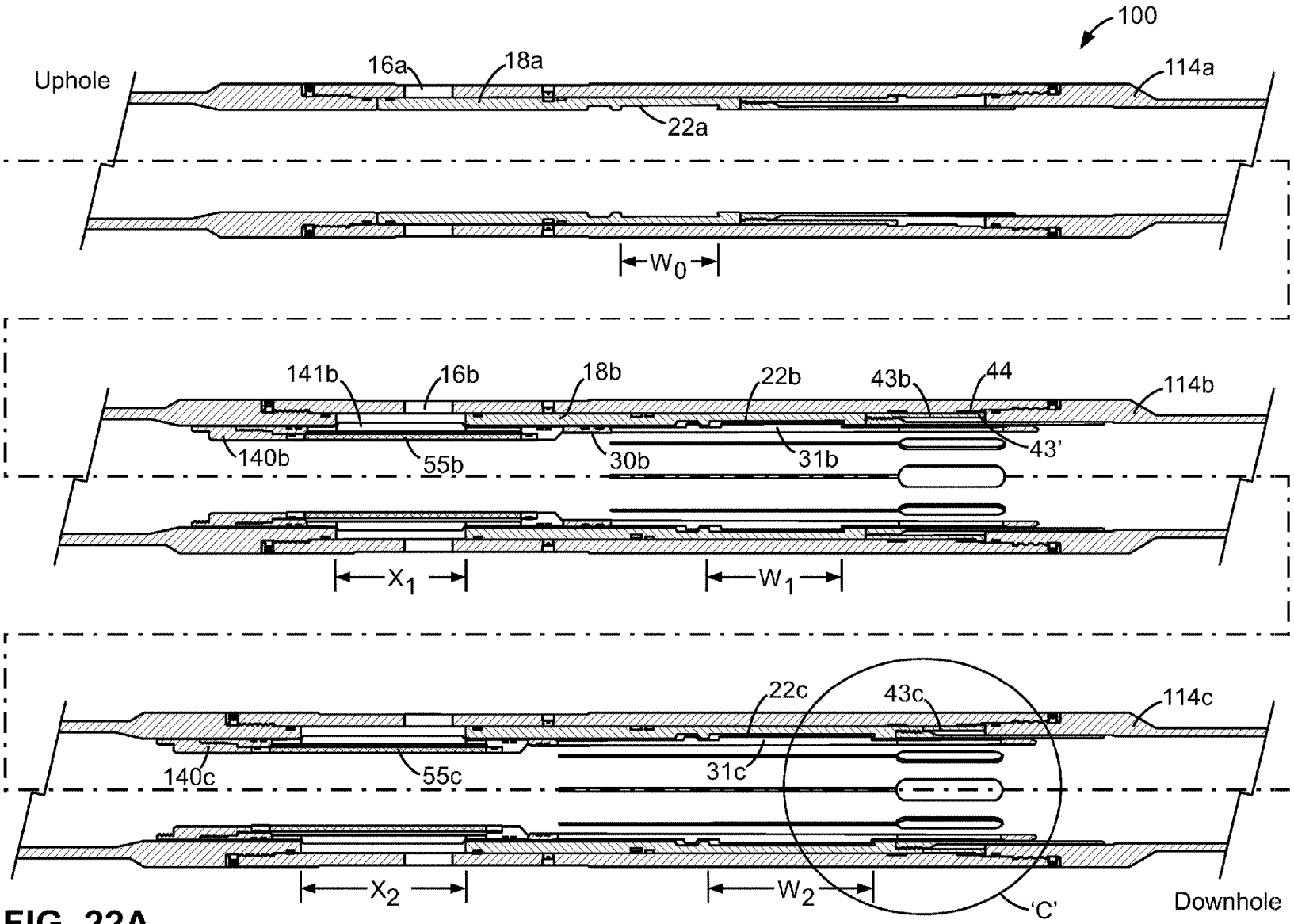
FIG. 22A is a subsequent view of the tubing liner of FIG. 22 wherein fluid applied uphole has caused bursting and subsequent disappearance of, or corrosive dissolution of, a plug member on an uphole side of said second sand screen sub.

FIG. 22A shows a further successive step in the system/method 100, where one of either two things has occurred-either a pulse of high pressure fluid has been further applied to the uphole side of a frangible disk 53*b* of sand screen sub 140*b* so as to cause disk 33*b* to rupture and disintegrate, or if disk 53*b* is of a dissolvable type upon application of a corrosive fluid (not shown), a corrosive fluid has been flowed downhole to dissolve disk 53*b*.

Figure 23:
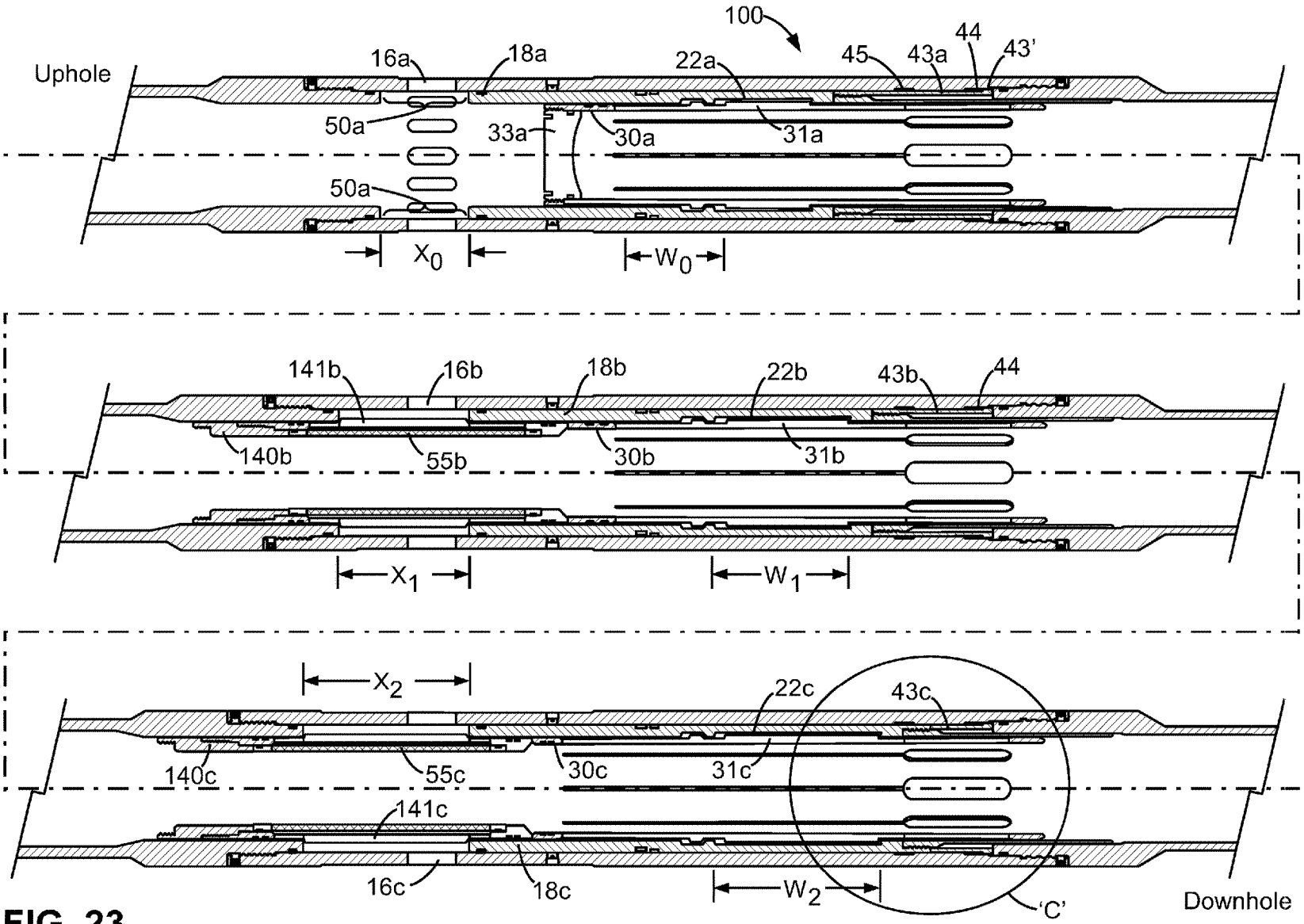

FIG. 23 shows a further successive step in the system/method 100, where a third actuation member 30*a* having a radially outwardly biased protuberance 31*a* thereon of width/profile W0, where W0<W1, is flowed down tubing liner 12 until radially outwardly biased protuberance 31*a* thereon matingly engages interior circumferential groove profile 22*a* of similar profile/width W0 on corresponding sliding sleeve member 18*a*.

Figure 23A:
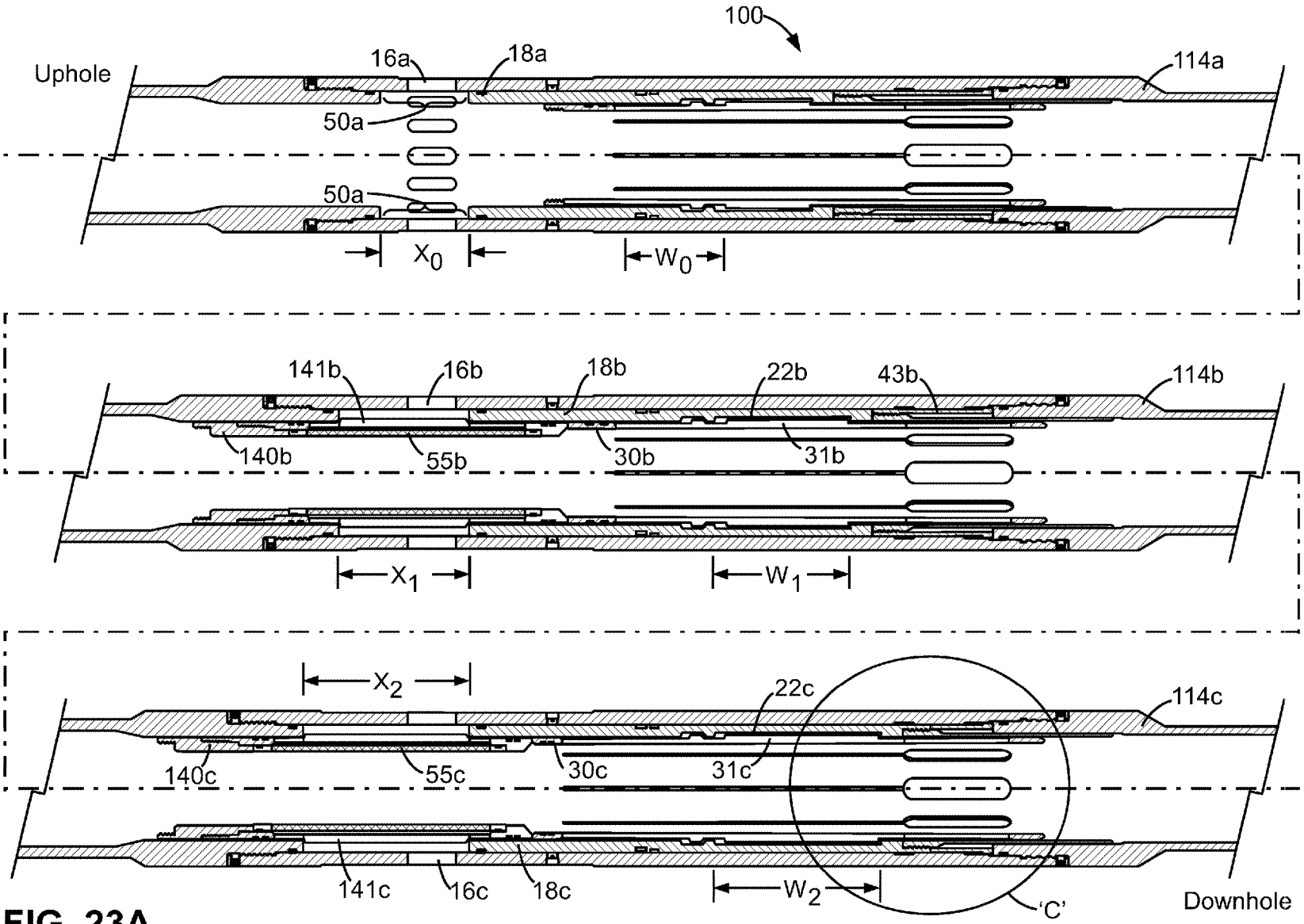
FIG. 23A is a subsequent view of the tubing liner of FIG. 23, wherein fluid applied uphole has caused bursting and subsequent disappearance of, or corrosive dissolution of, a plug member on an uphole side of the third actuation member.

FIG. 23A shows a further successive step in the system/method 100, where one of either two things has occurred-either a pulse of high pressure fluid has been further applied to the uphole side of a frangible disk 33*c* of third actuation member 30*c* so as to cause disk 33*c* to rupture and disintegrate, or if disk 33*c* is of a dissolvable type upon application of a corrosive fluid (not shown), a corrosive fluid has been flowed downhole to dissolve disk 33*c*.

Figure 24:
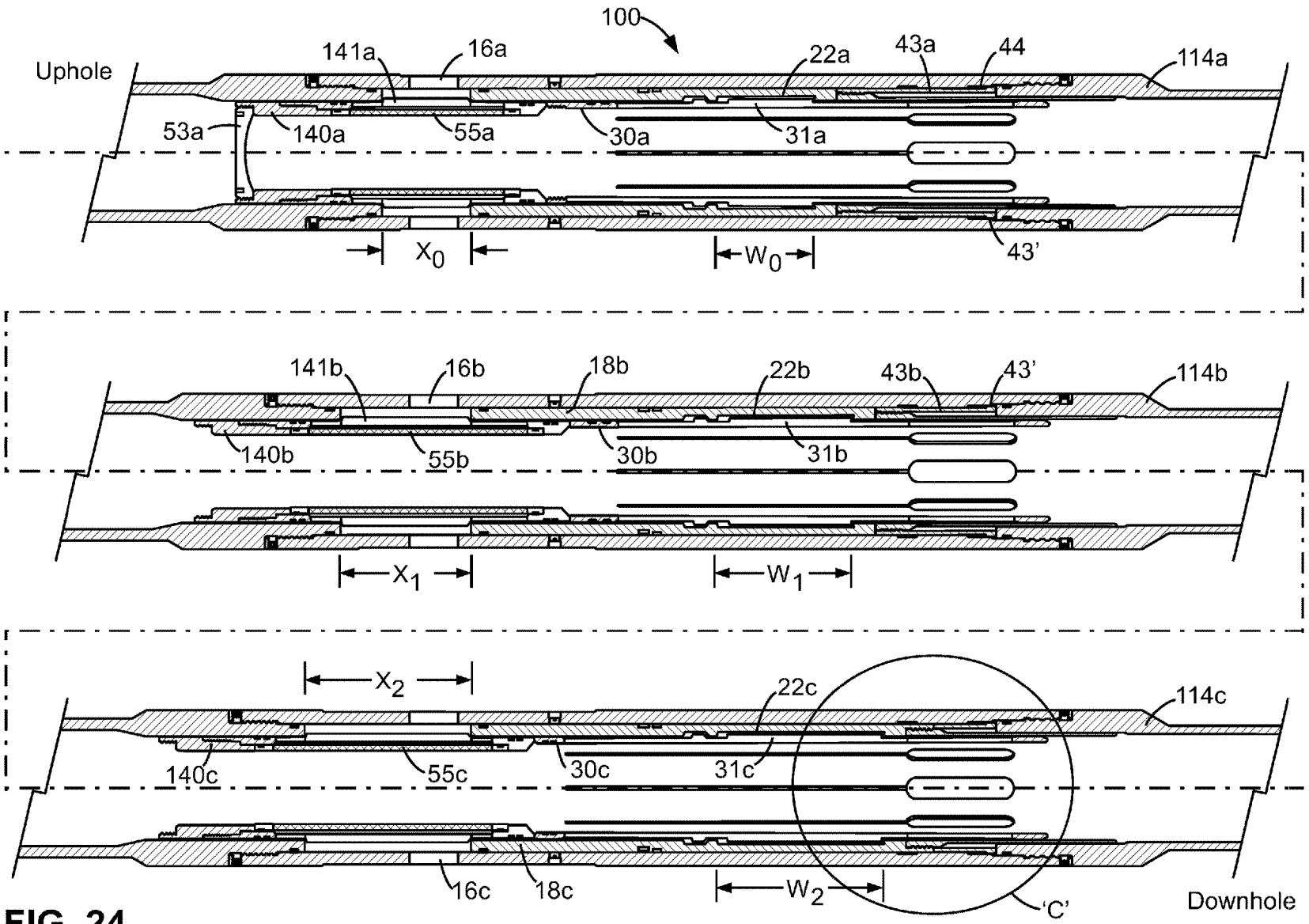
Figure 25E:
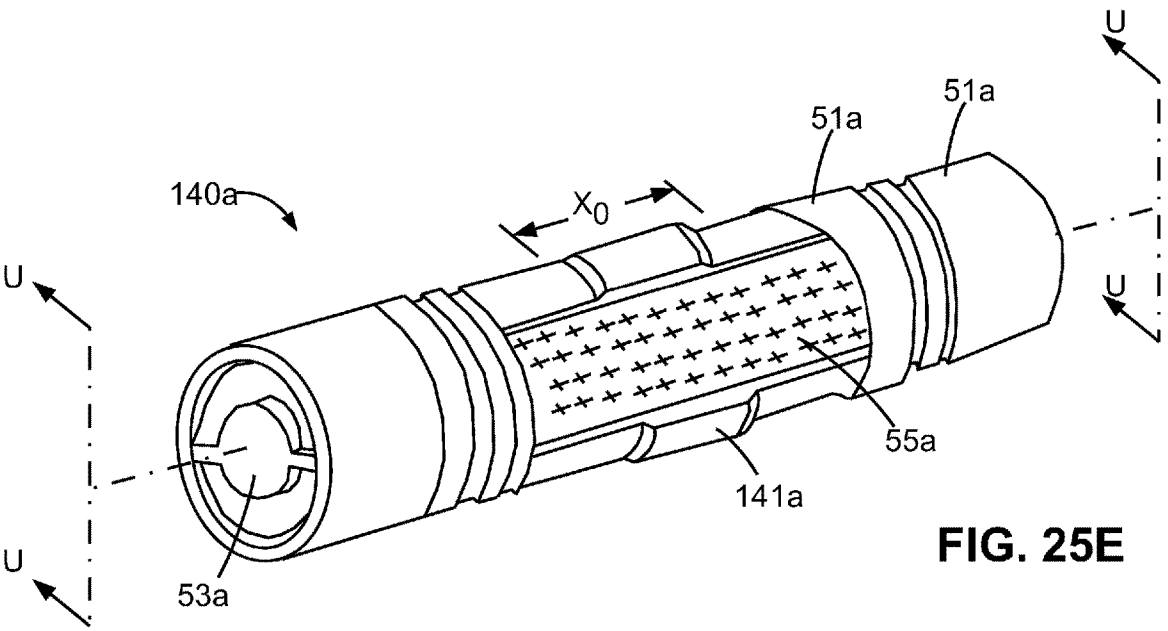
FIG. 25*e* is a perspective view of the first sand screen sub in the method of FIGS. 17-24A, having a resiliently outwardly biased retaining member thereon of width $X_0$.
Figure 25F:
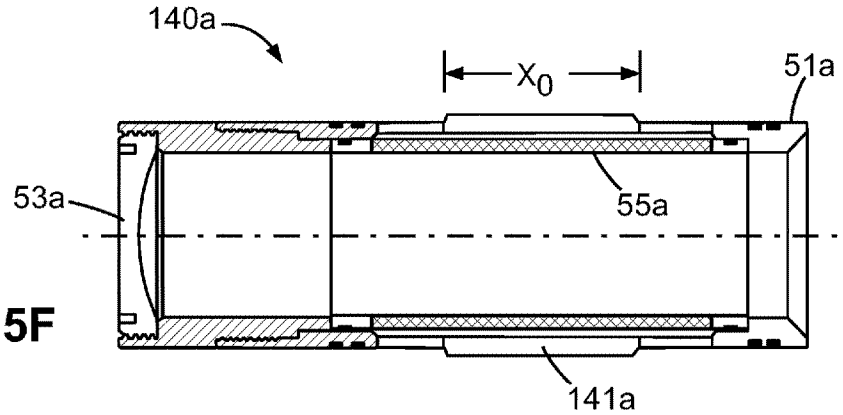
FIG. 25*f* is a cross-sectional view of the first sand screen sub of FIG. 27*a*, taken along plane 'U'-'U' of FIG. 25*e;*

FIG. 24 shows a further successive step in the system/method 100, where a third sand screen sub 140*a*, as best seen in FIGS. 25*e*, 25*f*, has been flowed downhole in tubing liner 12 and a radially outwardly biased retainer member 141*a* thereof, of width X0, has become lockingly engaged in annular region 50*a* of tubular liner 12, of similar width X0.

Figure 24A:
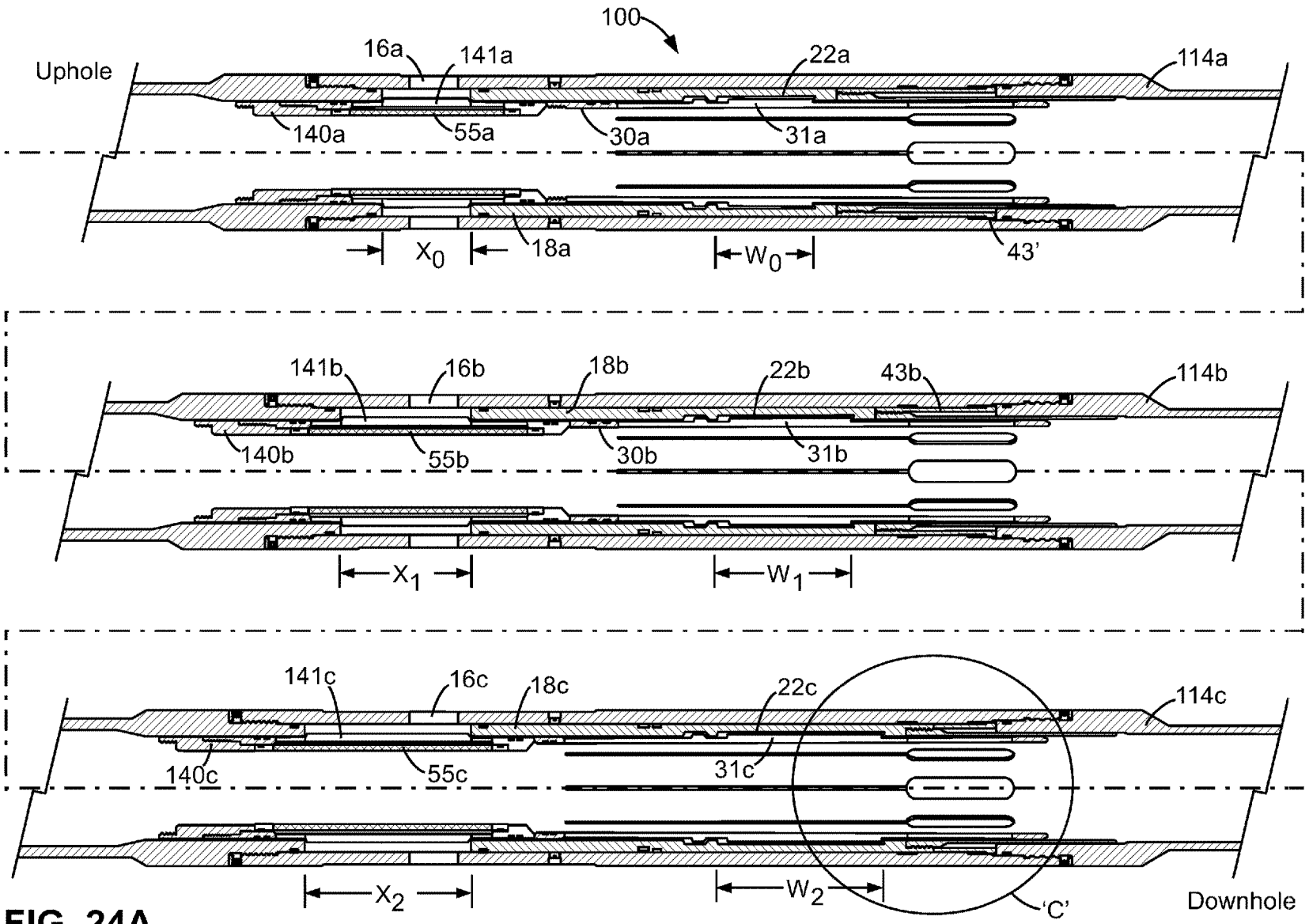

FIG. 24A shows a further successive step in the system/method 100, where one of either two things has occurred-either a pulse of high pressure fluid has been further applied to the uphole side of a frangible disk 53*a* of sand screen sub 140*a* so as to cause disk 33*a* thereof to rupture and disintegrate, or if disk 53*c* is of a dissolvable type upon application of a corrosive fluid (not shown), a corrosive fluid has been flowed downhole to dissolve disk 53*c*.

Description of Related Method/System 200

FIGS. 25-30*a* depict successive steps and configuration of a related method/system 200 of the present invention.

Specifically, method/system 200 similar to method/system 100 utilizes a plurality of configurationally-different sand screen subs 140*a*, 140*b*, and 140*c*, but in contrast to either of aforementioned methods/systems 10, 100, utilizes only one actuation member 30*c* having a radially outwardly biased protuberance 31*c* of profile/width W2 thereon to actuate a plurality of sliding sleeve members 18*c*, each having an interior circumferential groove profile 22*c* of a similar width/profile W2, and thereby open a plurality (cluster) of frac/production ports 16*a*, 16*b*, and 16*c* within respective discrete segments 214*a*, 214*b*, 214*c* of tubing liner 12.

Figure 26:
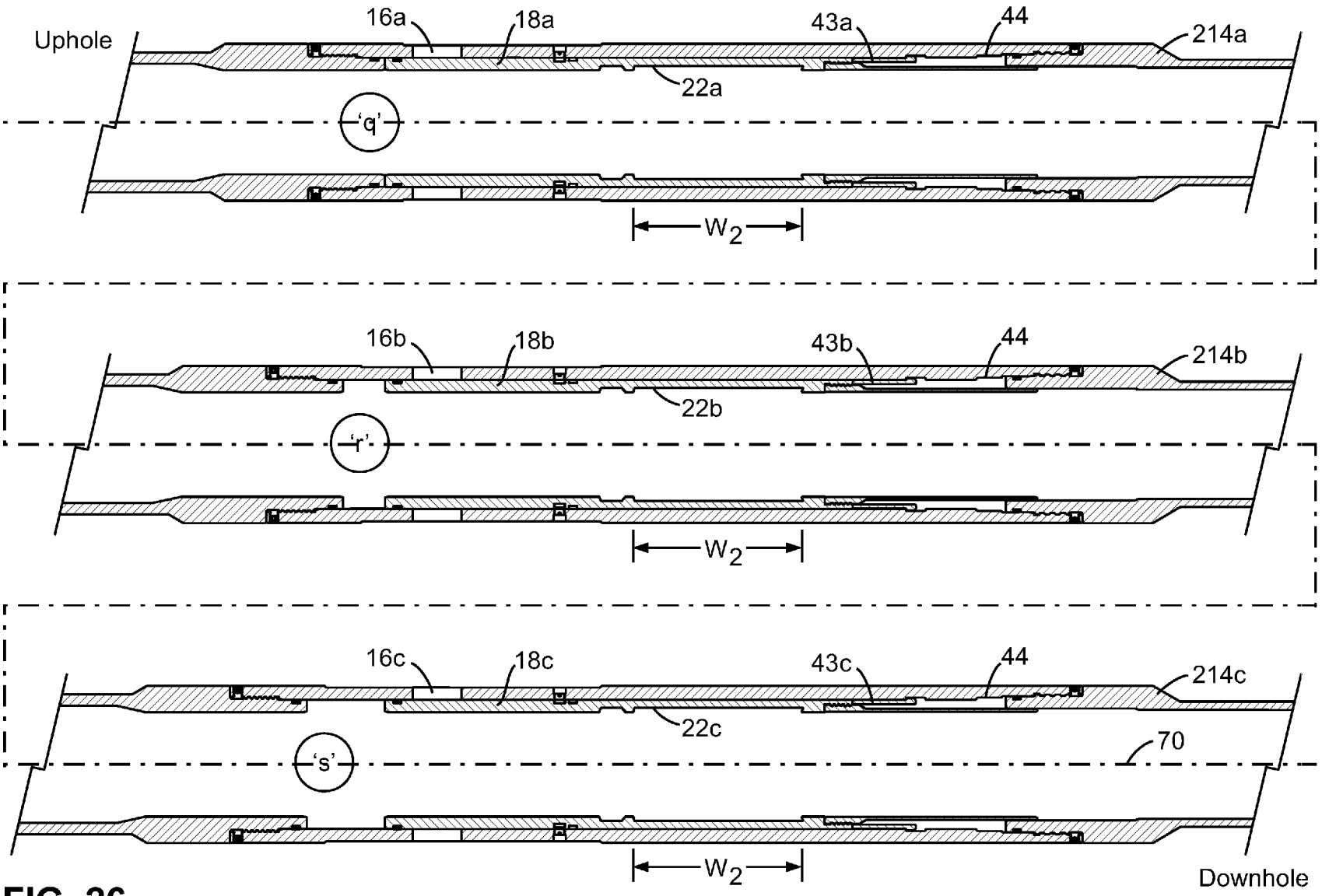

As firstly seen from FIG. 26, the tubular liner 12 of method/system 200 comprises, like method/system 100, a plurality of individually different segments 214*a*, 214*b*, and 214*c*, each with a corresponding frac/production port 16*a*, 16*b*, 16*c*. Each discrete segment 214*a*, 214*b*, 214*c*, however, has a slidable sleeve member 18*a*, 18*b*, 18*c* having a respective interior circumferential groove profile 22*a*, 22*b*, 22*c* all of a consistent width/profile W2.

Notably, however, in comparison to the discrete segments 14*a*, 14*b*, 14*c* of method/system 10, discrete segments 214*a*, 214*b*, and 214*c* of the method/system 200 are configurationally different in region "q", 'r', and 's', to provide the advantage of being able to individually and uniquely matingly engage individual sand screen subs 140*a*, 140*b*, and 140*c* at a particular desired location along tubular liner 12, in the manner hereinafter explained and depicted in FIGS. 28, 29, and 30, 22, and 24.

Figure 27:
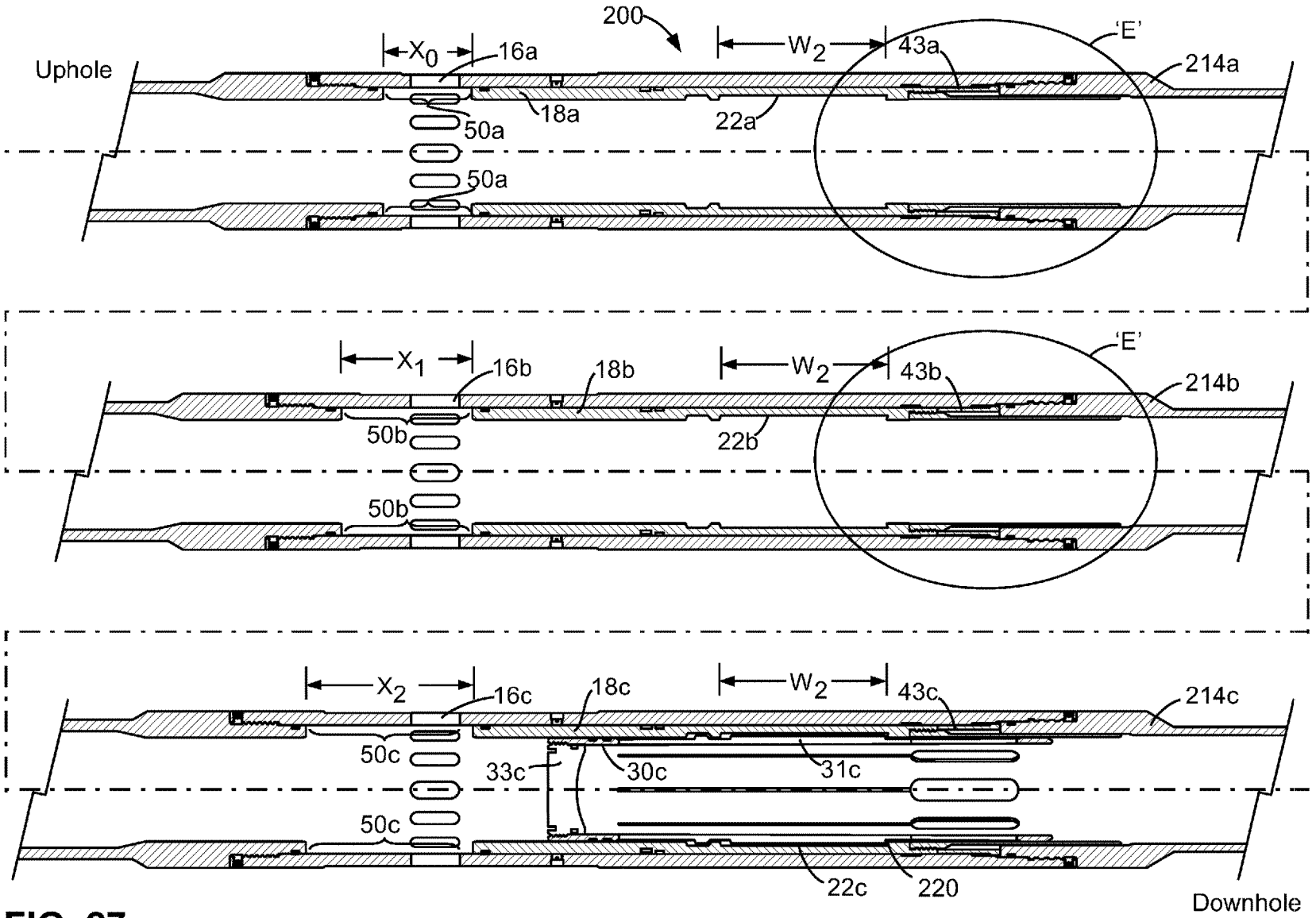

FIG. 27 shows a further successive step in the system/method 200, where a single actuation member 30 having a radially outwardly biased protuberance 31*c* thereon of width/profile W2, is flowed down tubing liner 12, until radially outwardly biased protuberance 31*c* thereon of profile/width W2 matingly engages interior circumferential groove profile 22*a* on corresponding sliding sleeve member 18*a*, and slidably moves sliding sleeve member 22*a* downhole to thereby uncover/open frac/production port 16*a*. Annular region 50*a*, of width X0, is thereby created in tubular liner 12.

Due to a chamfer 220 expressly provided on a downhole side edge of protuberance 31*c* of actuation member 30, upon continued further fluid pressure applied to an uphole side of said actuation member 30, chamfer 220 contacts a downhole side edge of the circumferential groove profile 22*a* in sliding sleeve member 18*a* and the radially-outwardly biased protuberance 31*c* thereafter becomes radially inwardly depressed and thereby disengaged from mating engagement with said interior circumferential groove 22*a*, thereby allowing actuation member 30 to continue moving downhole to engage interior circumferential groove profile 22*b* on corresponding sliding sleeve member 18*b*, and slidably move sliding sleeve member 22*b* downhole to similarly uncover/open frac production port 16*b*. Annular region 50*b*, of width X1, is thereby created in tubular liner 12.

Again, due to a chamfer 220 provided on a downhole side edge of protuberance 31*c* of actuation member 30, upon continued further fluid pressure applied to an uphole side of said actuation member 30, chamfer 220 contacts a downhole side edge of the circumferential groove profile 22*b* in sliding sleeve member 18*b* and the radially-outwardly biased protuberance 31*c* thereafter becomes radially inwardly depressed and thereby disengaged from mating engagement with said interior circumferential groove 22*a*, thereby allowing actuation member 30 to continue moving downhole to engage interior circumferential groove profile 22*c* on corresponding sliding sleeve member 18*c*, and slidably move sliding sleeve member 18*c* downhole to similarly uncover/open frac production port 16*c*. Annular region 50*c*, of width X2, is thereby created in tubular liner 12.

The resulting configuration of the tubular liner is as per that depicted in FIG. 27.

Figure 32:
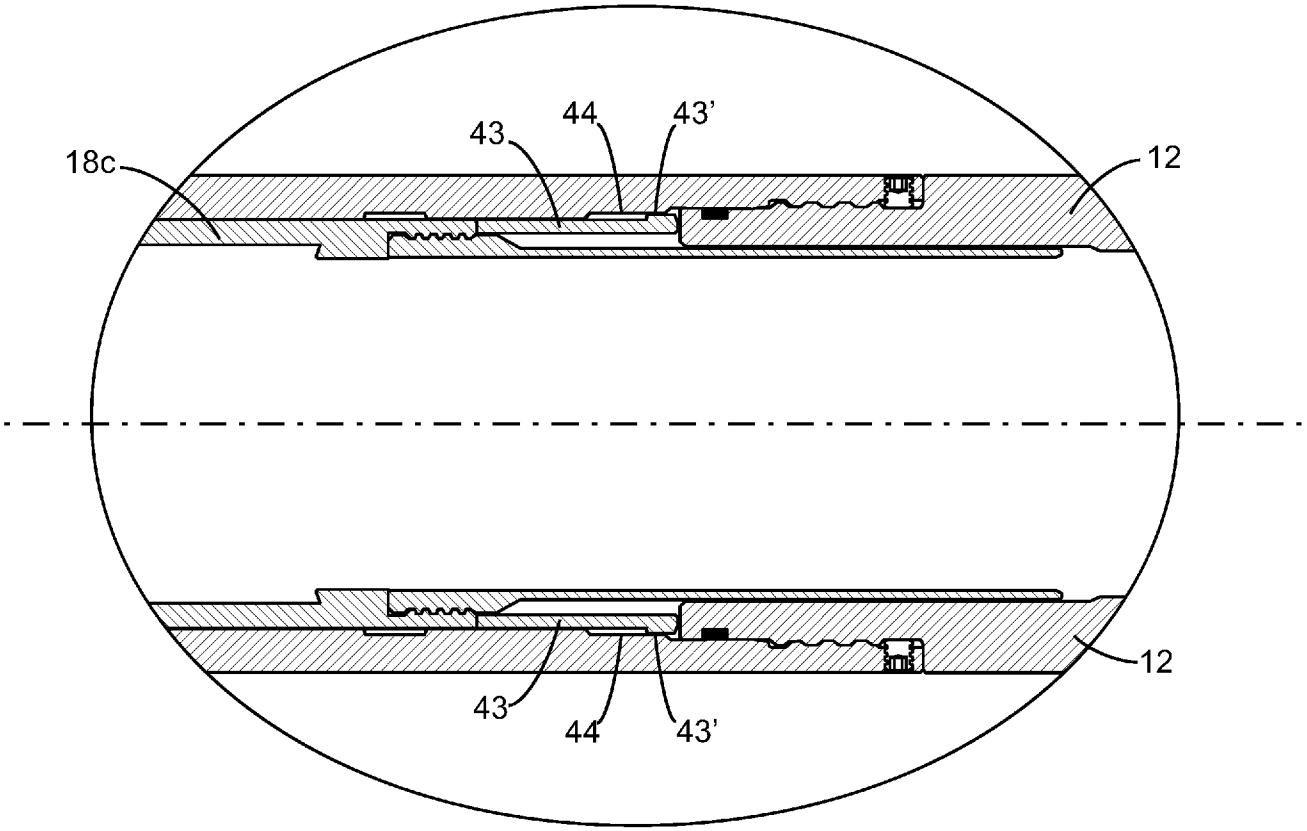
FIG. 32 is an enlarged view of region "E" of FIG. 27*b*, FIG. 28, and FIG. 31*f*.

When sliding sleeve member 18*a*, 18*b*, 18*c* are moved so as to uncover respective frac/production ports 16*a*, 16*b*, 16*c*, collet fingers 43 on sliding sleeve members 18*a*, 18*b*, 18*c* are moved downhole, such that distal ends 43' thereof matingly engage annular ring 44 in tubular liner 12, as shown in region "E" of FIG. 27 and in enlarged view in FIG. 32, thereby preventing sliding sleeve members 18*a*, 18*b*, 18*c* from further movement.

Figure 27A:
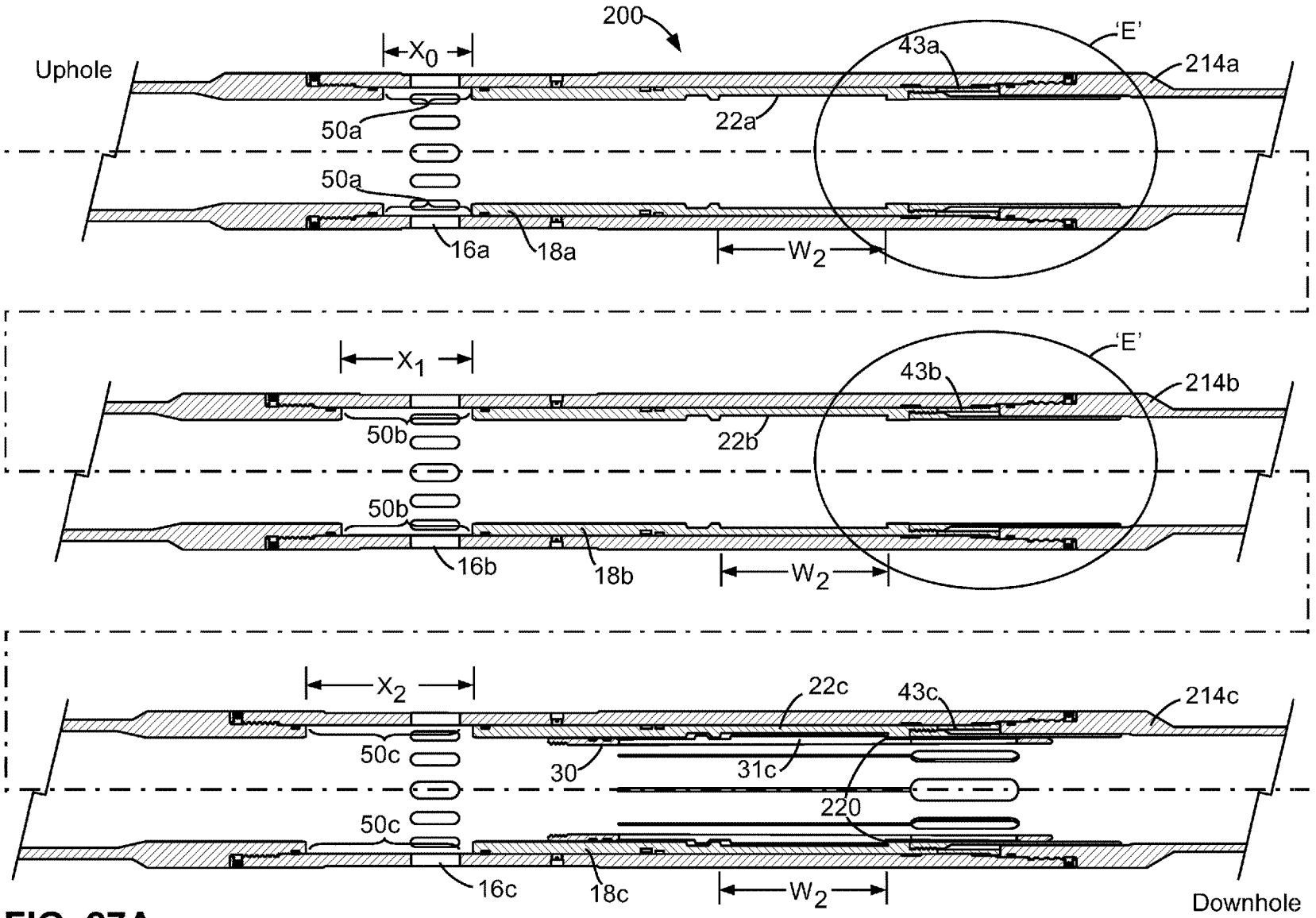
FIG. 27*a* is a subsequent view of the tubing liner of FIG. 27, wherein fluid applied uphole has caused bursting and subsequent disappearance of, or corrosive dissolution of, a plug member on an uphole side of said first actuation member.

FIG. 27*a* shows a further successive step in the system/method 200, where one of either two things has occurred-either a pulse of high pressure fluid has been further applied to the uphole side of a frangible disk 33*c* of actuation member 30 so as to cause disk 33*c* to rupture and disintegrate, or if disk 33*c* is of a dissolvable type upon application of a corrosive fluid (not shown), a corrosive fluid has been flowed downhole to dissolve disk 33*c*.

Figure 27B:
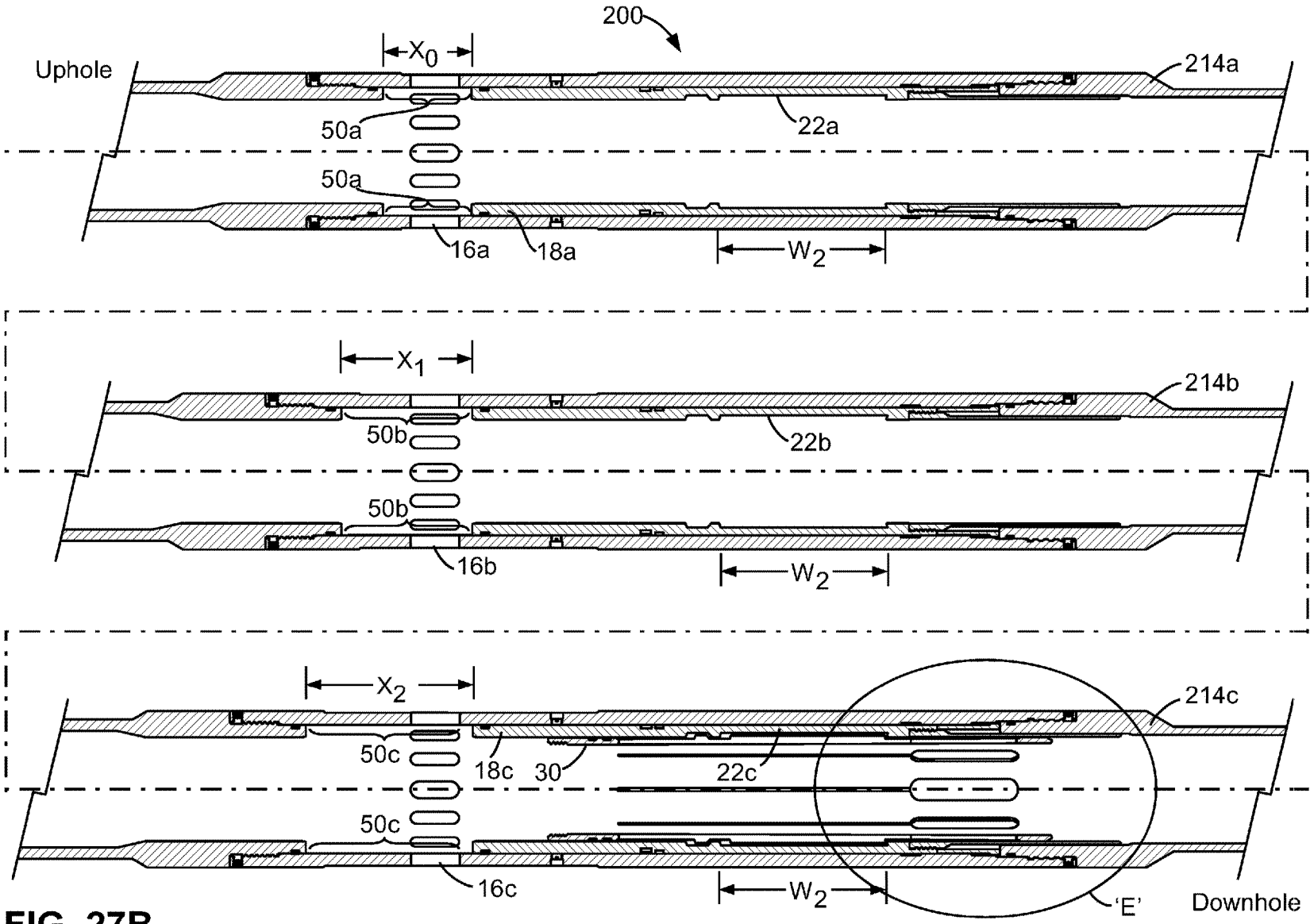
FIG. 27*b* depicts an optional additional step in the aforesaid method, wherein the first actuation member is dissolvable in a corrosive fluid, and a corrosive fluid has been streamed downhole to dissolve the first actuation member after having actuated the associated sliding sleeve member to an open position.

FIG. 27*b* depicts an optional step in the method/system 200, for a situation where the entire actuation member 30 has been made dissolvable, and a corrosive fluid has been flowed downhole to dissolve actuation member 30.

Remaining FIGS. 28-30*a* depict a configuration where actuation member 30 has been made dissolvable, and a corrosive fluid has been flowed downhole to dissolve actuation member 30, and actuation member 30 no longer remains. Of course, if actuation member 30 has not been made dissolvable, actuation member 30 and the optional step of FIG. 27*b* not carried out, actuation member 30 would remain in the most downhole segment 214*c* in each of remaining FIGS. 28-30*a*.

Figure 28:
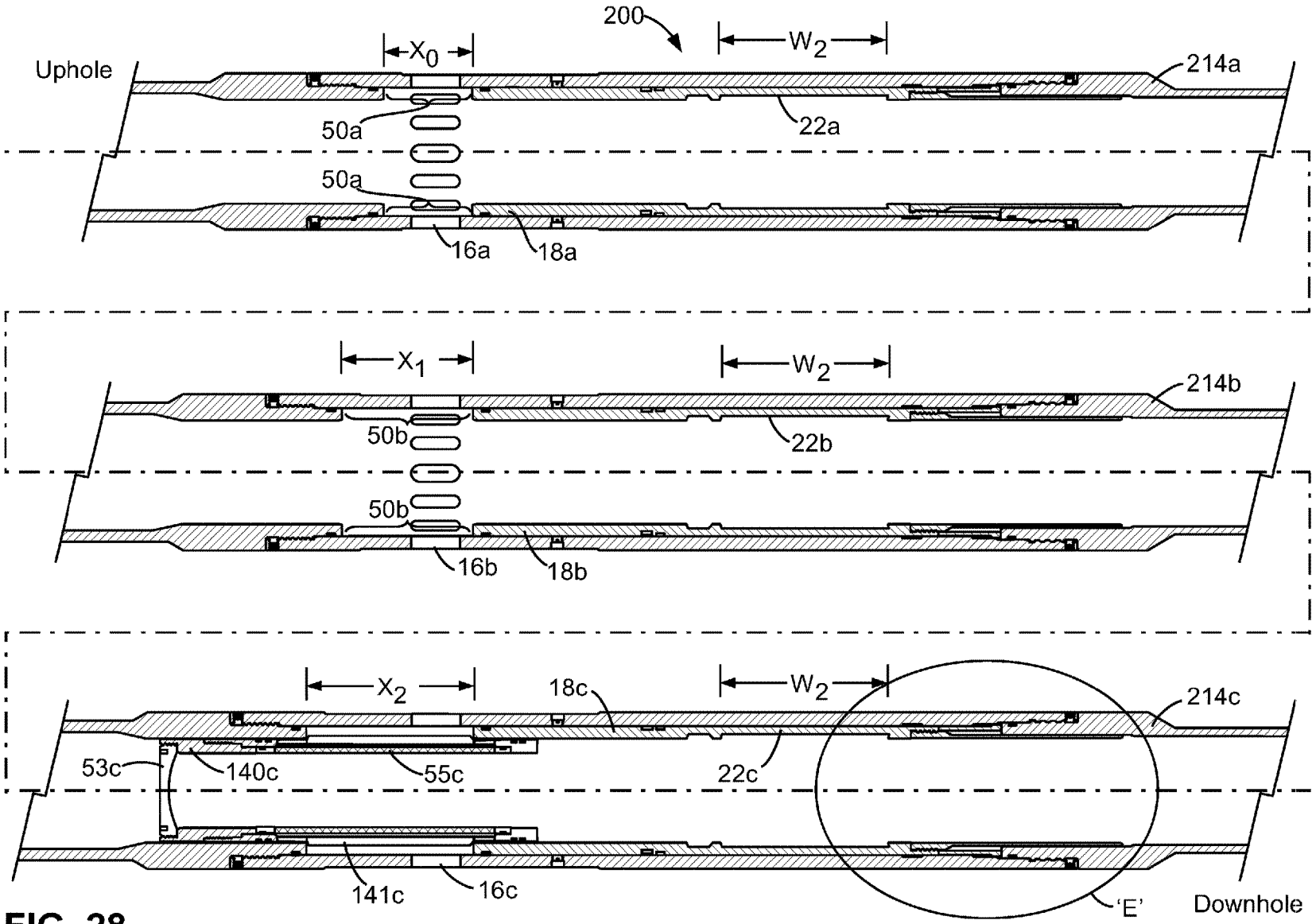

FIG. 28 shows a further successive step in the system/method 200, where a first sand screen sub 140*c*, as best seen in FIGS. 25*a*, 25*b*, has been flowed downhole in tubing liner 12, and a radially outwardly biased retainer member 141*c* thereof, of width X2, has become lockingly engaged in annular region 50*c* of tubular liner 12, of similar width X2.

Figure 28A:
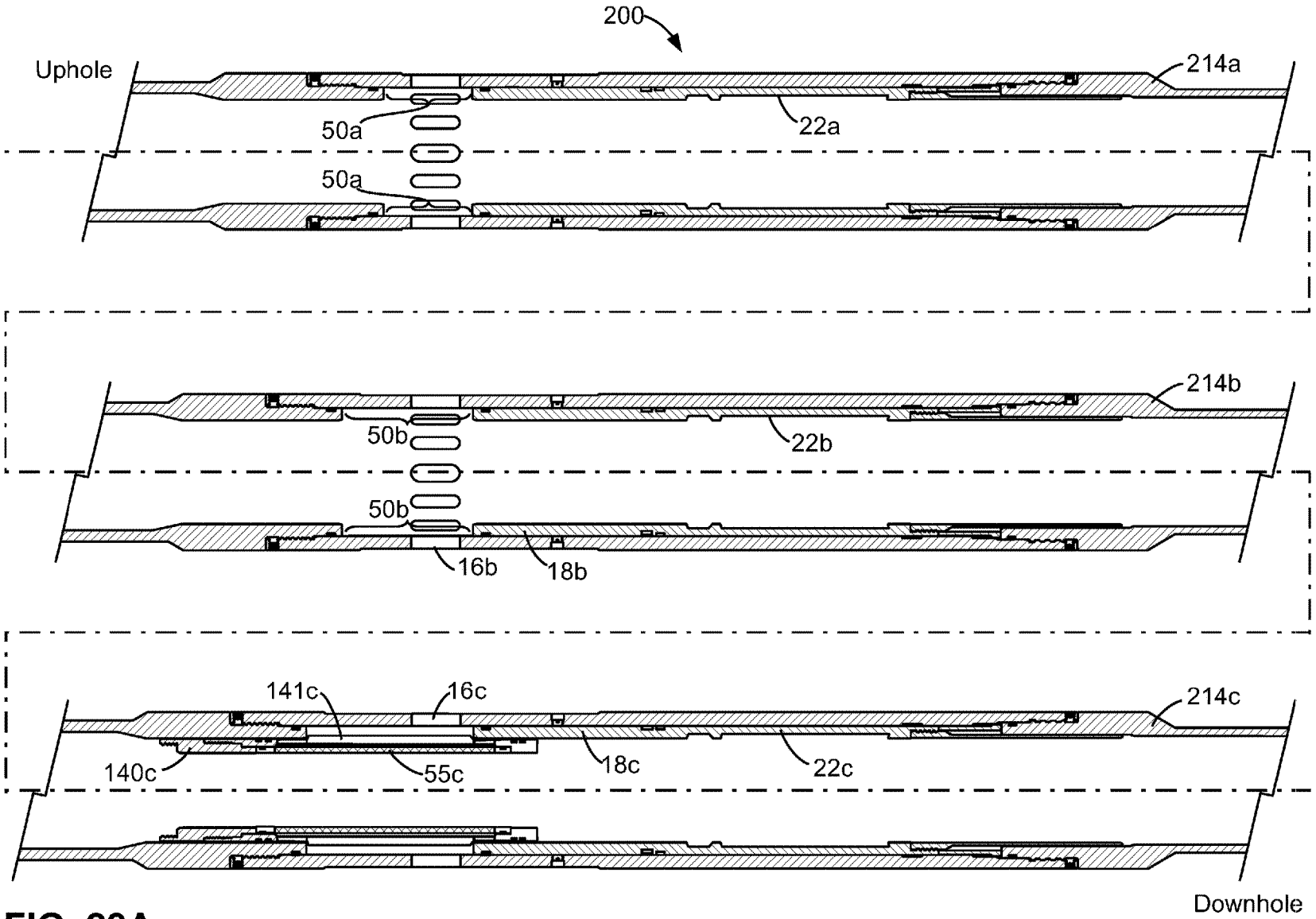
FIG. 28*a* is a subsequent view of the tubing liner of FIG. 28 wherein fluid applied uphole has caused bursting and subsequent disappearance of, or corrosive dissolution of, a plug member on an uphole side of said first sand screen sub.

FIG. 28*a* shows a further successive step in the system/method 200, where one of either two things has occurred-either a pulse of high pressure fluid has been further applied to the uphole side of a frangible disk 53*c* of sand screen sub 140*c* so as to cause disk 53*c* thereof to rupture and disintegrate, or if disk 53*c* is of a dissolvable type upon application of a corrosive fluid (not shown), a corrosive fluid has been flowed downhole to dissolve disk 53*c*.

Figure 29:
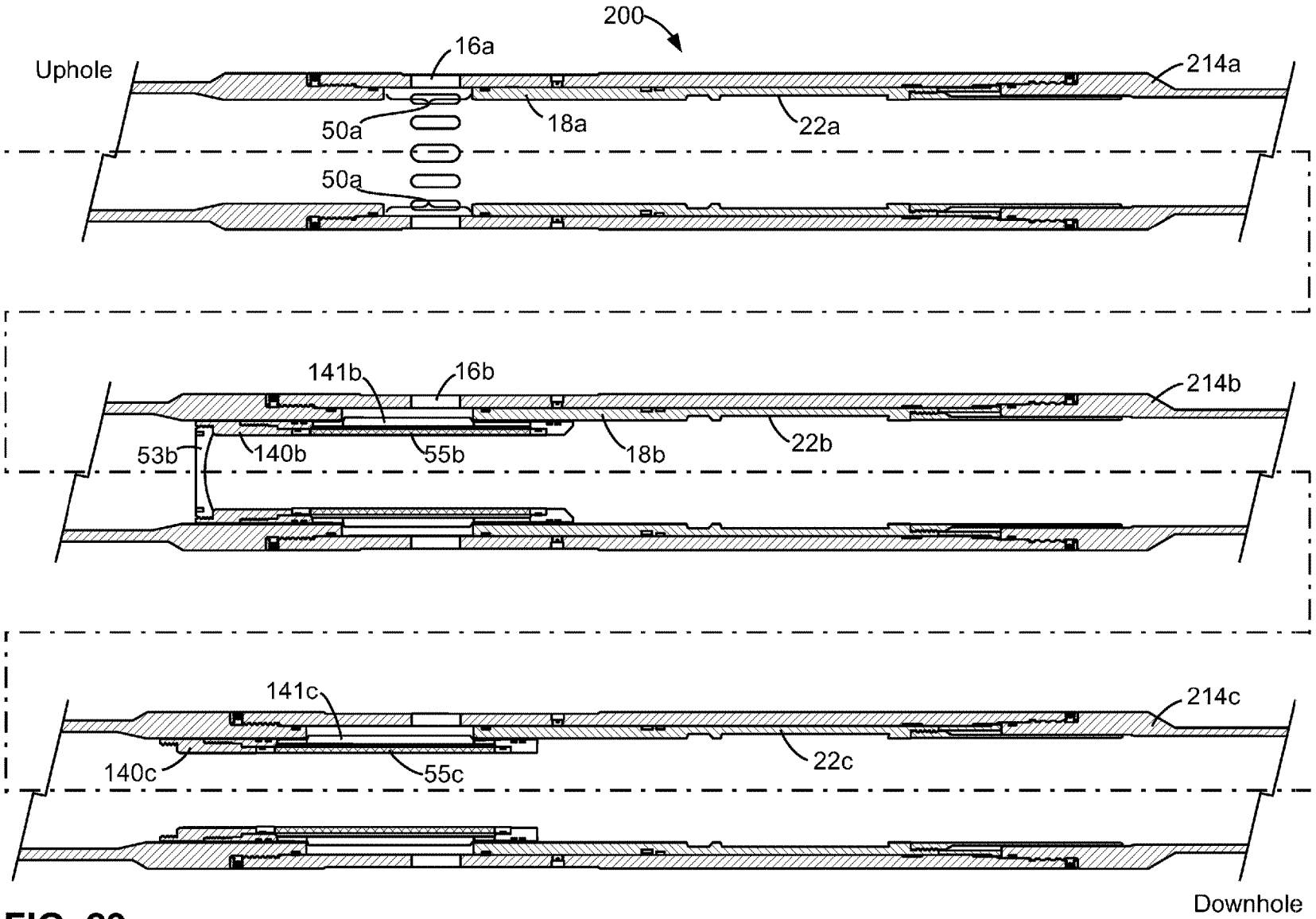

FIG. 29 shows a further successive step in the system/method 200, where a second sand screen sub 140*b*, as best seen in FIGS. 25*c*, 25*d*, has been flowed downhole in tubing liner 12, and a radially outwardly biased retainer member 141*b* thereof, of width X1, has become lockingly engaged in annular region 50*b* of tubular liner 12, of similar width X1.

Figure 29A:
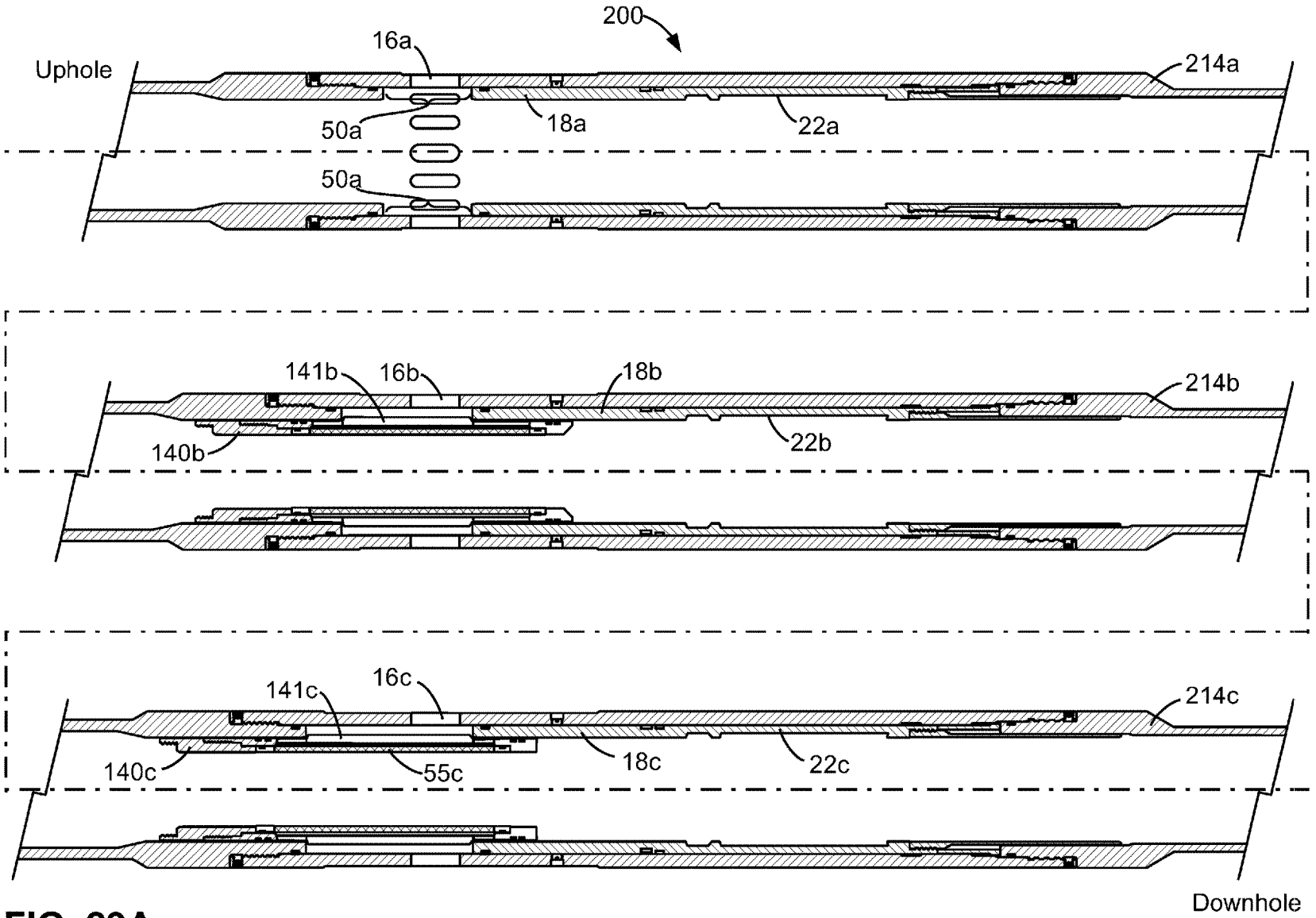
FIG. 29*a* is a subsequent view of the tubing liner of FIG. 29 wherein fluid applied uphole has caused bursting and subsequent disappearance of, or corrosive dissolution of, a plug member on an uphole side of said second sand screen sub.

FIG. 29*a* shows a further successive step in the system/method 200, where one of either two things has occurred-either a pulse of high pressure fluid has been further applied to the uphole side of a frangible disk 53*b* of sand screen sub 140*b* so as to cause disk 53*b* thereof to rupture and disintegrate, or if disk 53*b* is of a dissolvable type upon application of a corrosive fluid (not shown), a corrosive fluid has been flowed downhole to dissolve disk 53*b*.

Figure 30:
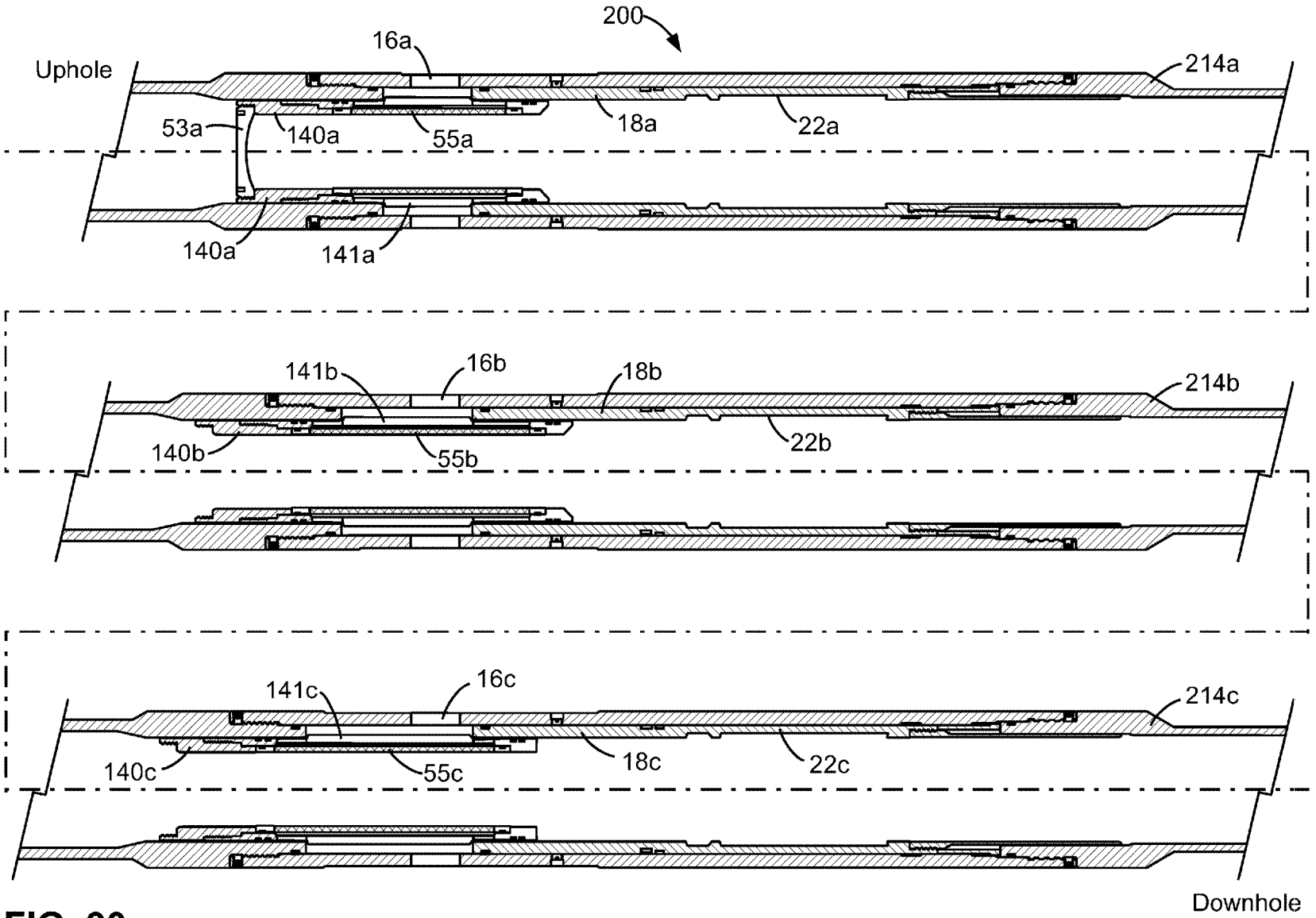

FIG. 30 shows a further successive step in the system/method 200, where a third sand screen sub 140*a*, as best seen in FIGS. 25*e*, 25*f*, has been flowed downhole in tubing liner 12, and a radially outwardly biased retainer member 141*a* thereof, of width X0, has become lockingly engaged in annular region 50*a* of tubular liner 12, of similar width X0.

Figure 30A:
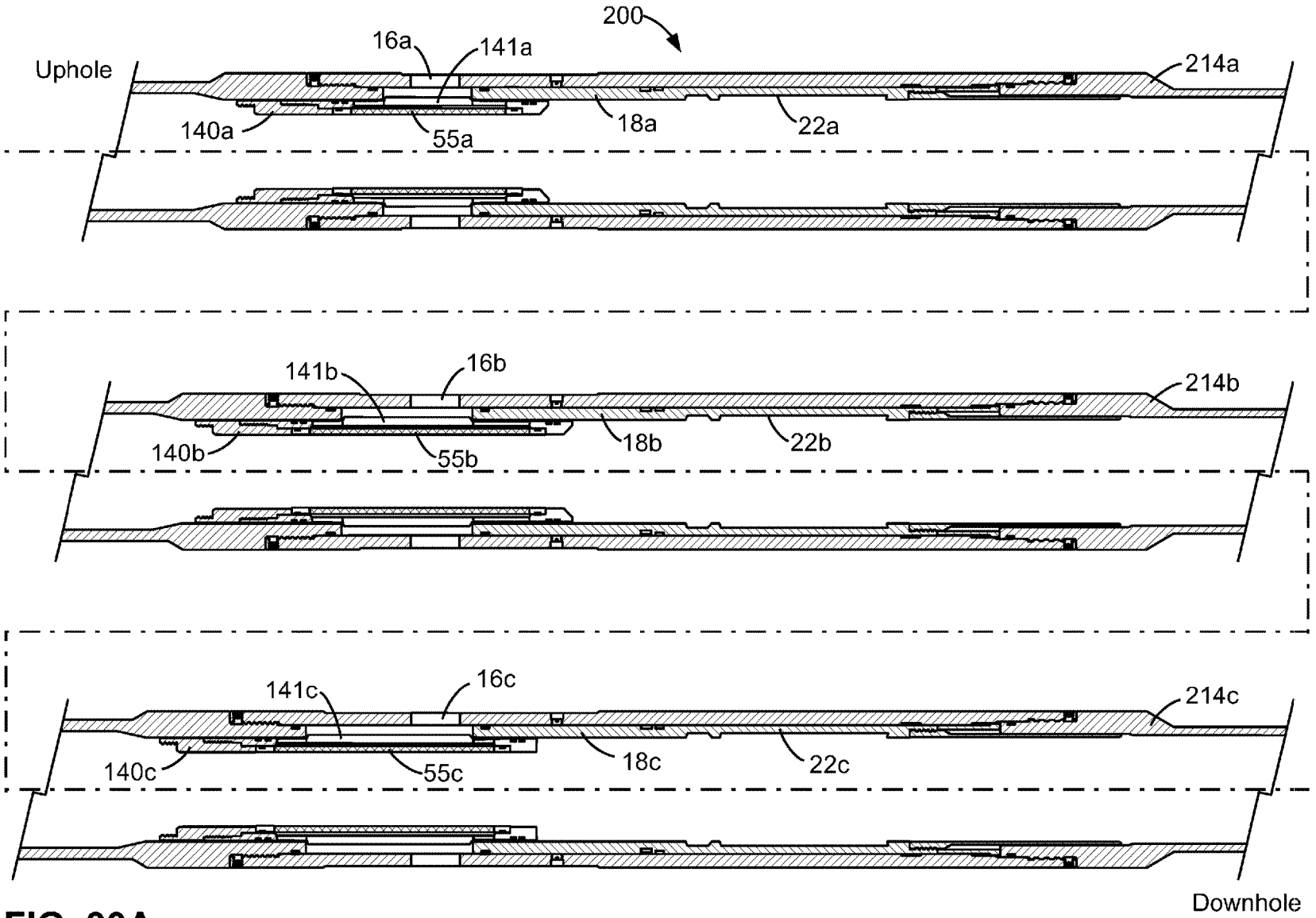

FIG. 30*a* shows a further successive step in the system/method 200, where one of either two things has occurred-either a pulse of high pressure fluid has been further applied to the uphole side of a frangible disk 53*a* of sand screen sub 140*a* so as to cause disk 53*a* thereof to rupture and disintegrate, or if disk 53*a* is of a dissolvable type upon application of a corrosive fluid (not shown), a corrosive fluid has been flowed downhole to dissolve disk 53*a* thereof.

Description of Related Method/System 300

FIGS. 31*a*-31*f* depict successive steps and configuration of a related method/system 300 of the present invention.

The method/system 300 shown in FIGS. 31*a*-31*f* differs from the method/system 200 in that instead of using a burst plate disk or dissolvable disk 53*c* at an uphole end of actuation member 30, actuation member 30 has a sealing surface 302 against which a dissolvable ball member 301 may sealingly engage, to thereby serve as a dissolvable plug and allow actuation member 30 to be flowed downhole to actuate (open) corresponding slidable sleeve members 18*a*, 18*b*, 18*c* and thus frac/production ports 16*a*, 16*b*, 16*c*.

Figure 31A:
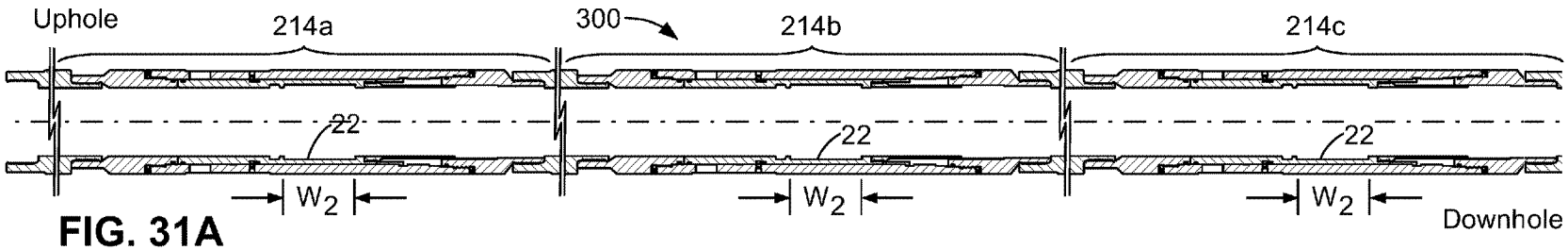

FIG. 31*a* shows a tubular liner 12 of method/system 300 comprising a plurality of individually different segments 214*a*, 214*b*, and 214*c*, each with a corresponding frac/production port 16*a*, 16*b*, 16*c*. Each discrete segment 214*a*, 214*b*, 214*c*, however, has a slidable sleeve member 18*a*, 18*b*, 18*c* having a respective interior circumferential groove profile 22*a*, 22*b*, 22*c* all of a consistent width/profile W2.

Figure 31B:
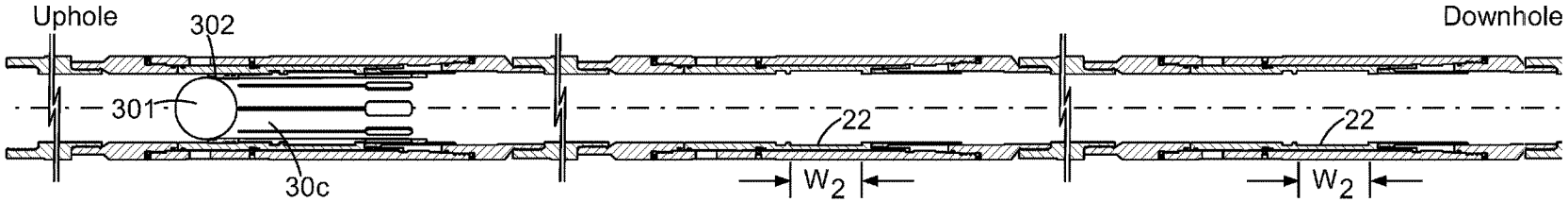
Figure 31C:
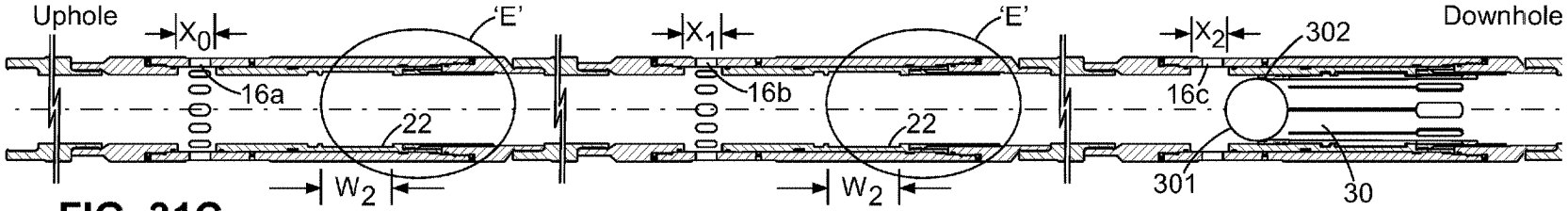
Figure 31D:
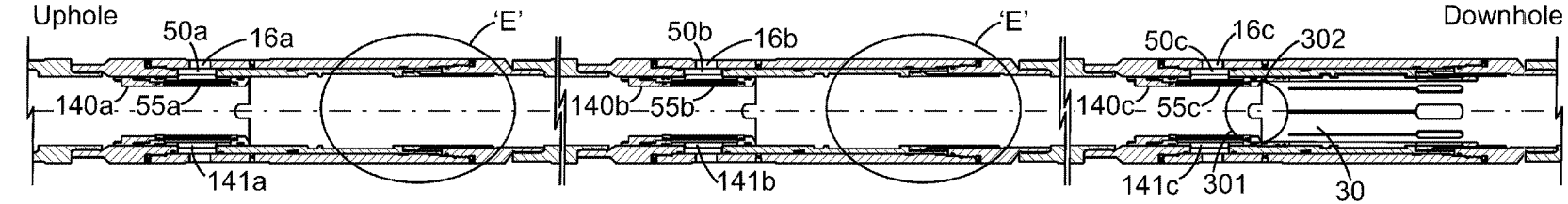

Discrete segments 214*a*, 214*b*, and 214*c* of the method/system 300 are configurationally different, to provide the advantage of being able to individually and uniquely matingly engage individual sand screen subs 140*a*, 140*b*, and 140*c* at a particular desired location along tubular liner 12, in the manner as shown in FIG. 31*d*.

FIG. 31*b* shows a further successive step in the system/method 300, where a single actuation member 30 having a radially outwardly biased protuberance 31*c* thereon of width/profile W2, and a sealing surface 302 for a dissolvable ball 301, is flowed down tubing liner 12, until radially outwardly biased protuberance 31*c* thereon of profile/width W2 matingly engages interior circumferential groove profile 22*a* on corresponding sliding sleeve member 18*a*.

FIG. 31*c* shows actuation member 30 having successively engaged and opened frac/production ports 16*a*, 16*b*, and 16*c*, thereby creating annular regions 50*a*, 50*b*, 50*c* of respective widths X0, X1, and X2 immediately underlying the respective opened frac ports 16*a*, 16*b*, and 16*c*.

When sliding sleeve members 18*a*, 18*b*, 18*c* are moved so as to uncover respective frac/production ports 16*a*, 16*b*, 16*c*, collet fingers 43 on sliding sleeve members 18*a*, 18*b*, 18*c* are moved downhole, such that distal ends 43' thereof matingly engage annular ring 44 in tubular liner 12, as shown in region "E" of FIG. 31*c* and in enlarged view in FIG. 32, thereby preventing sliding sleeve members 18*a*, 18*b*, 18*c* from further movement.

FIG. 31*d* shows a further successive step in the system/method 300, where a first sand screen sub 140*c*, a second sand screen sub 140*b*, and a third sand screen sub 140*a*, as best seen in FIGS. 25*a*, 25*b*, FIGS. 25*c*, 25*d*, and FIGS. 25*e*, 25*f* respectively, have each been flowed downhole in tubing liner 12, and a radially outwardly biased retainer member 141*c*, 141*b*, and 141*a* thereof, of width X2, X1, and X0, respectively, has become lockingly engaged in annular region 50*c*, 50*b*, and 50*a* respectively of tubular liner 12.

Figure 31E:
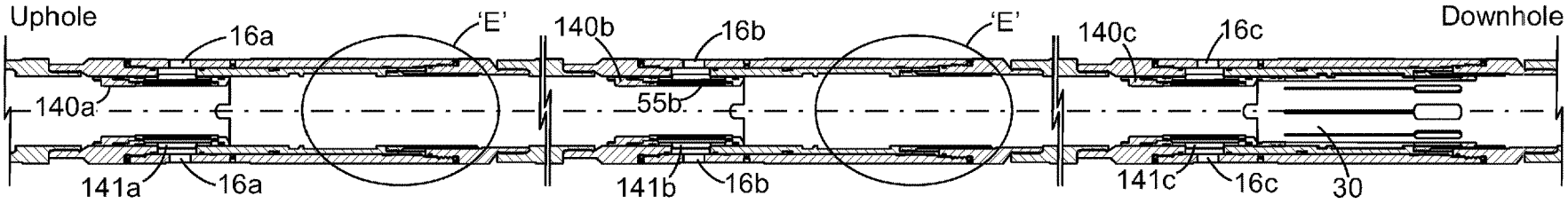

FIG. 31*e* shows a further successive step in the system/method 300, where a corrosive fluid has been flowed downhole to dissolve ball member 301.

Figure 31F:
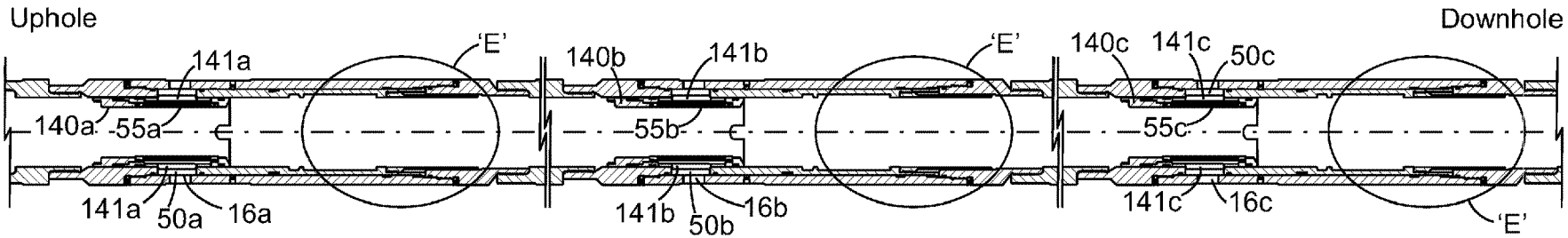

FIG. 31*f* shows a further successive (optional) step in the system/method 300, where the actuation member 30 has been made dissolvable, and where a corrosive fluid has been flowed downhole to dissolve actuation member 30.

The foregoing description of the disclosed embodiments and related systems/methods 10, 100, 200 and 300 is provided to enable any person skilled in the art to make or use the present invention. The scope of the claims should not be limited by the preferred embodiments set forth in the examples, but should be given the broadest interpretation consistent with the specification, including the description and drawings, as a whole. Thus, the present invention is not intended to be limited to the embodiments shown herein, but is to be accorded the full scope consistent with the claims.

For a complete definition of the invention and its intended scope, reference is to be made to the summary of the invention and the appended claims read together with and considered with the disclosure and drawings herein.

What is claimed is:

1. A system for fracking a hydrocarbon formation at a given location along a wellbore and subsequently allowing installation of a sand screen at said location without having to "trip out" a frac string prior to commencing production, comprising;

a tubular liner insertable within said wellbore and having an interior bore, further comprising:

(a) a plurality of spaced-apart frac ports longitudinally spaced at intervals along said tubular liner, providing, when open, fluid communication between the interior bore of the tubular liner and an exterior of the tubular liner;

(b) a corresponding plurality of cylindrical hollow sliding sleeve members, each configured in an initial closed position to cover a corresponding set of said frac ports and prevent flow of fluid from the interior bore to an exterior of the tubular liner, and slidably moveable longitudinally in the interior bore to an open position to uncover said corresponding set of the frac ports; and (c) a plurality of shear members, initially securing respectively said plurality of sliding sleeve members to the tubular liner in the initial closed position thereof, and sheareable when a longitudinal force is applied thereto to thereafter allow longitudinal slidable movement of respective one of said plurality of sliding sleeve members;

at least one actuation member, insertable within the interior bore of the tubular liner and engagable with at least one of the plurality of sliding sleeve members for shearing the shear members that initially secure the at least one sliding sleeve member and conditioning the at least one sliding sleeve member to the open position;

at least one cylindrical sand screen sub, insertable within the interior bore of said tubular liner and displaceable within said tubular liner to a location therein proximate one of said frac ports in said tubular liner whose corresponding sliding sleeve member has been conditioned to the open position by said actuation member, said at least one sand screen sub comprising:

(a) a cylindrical hollow member having at an uphole end thereof a dissolvable plug member or burst plate which at least for a limited time substantially obstructs passage of fluid within said interior bore thereby causing pressurized fluid injected downhole in said bore of said tubular liner to force said sand screen sub downhole in said tubular liner; and (b) a cylindrical, longitudinally-extending oil-permeable screen mesh forming a portion of an outer periphery of said sand screen sub downhole from said dissolvable plug member or burst plate thereon, which screen mesh when said sand screen sub is located proximate said one of said frac ports, underlies said one of said frac ports and prevents ingress of sand but permits ingress of oil, from said formation into the interior bore via said one of said frac ports.

2. The system for fracking a hydrocarbon formation as claimed in claim 1, wherein said at least one sand screen sub further comprises:

(c) a resiliently outwardly biased retaining member directly or indirectly engagable with a mating profile on said tubular liner when said sand screen sub has flowed down said tubular liner to said one of said frac ports whose corresponding sliding sleeve member has been opened and to a position within the tubular liner wherein the screen mesh of said sand screen sub underlies said one of said frac ports, which retaining member after engagement with said tubular liner prevents uphole displacement of said sand screen sub in said tubular liner.

3. The system for fracking a hydrocarbon formation as claimed in claim 2, wherein said resiliently outwardly biased retaining member on said at least one sand screen sub has a chamfer on a downhole side edge thereof and a flat face on an uphole side edge thereof perpendicularly disposed to a longitudinal axis of said tubular liner; and wherein downhole movement of said at least one sand screen sub in said tubular liner is allowed by said chamfer causing said resiliently outwardly biased retaining member to become radially depressed upon fluid pressure being exerted on an uphole side of said sand screen sub; and wherein uphole movement in said sand screen sub is prevented, when said screen mesh of said sand screen sub underlies said one of said frac ports, by said flat face engaging, directly or indirectly, an annular region in said tubular liner.

4. A system for fracking a hydrocarbon formation as claimed in claim 2, further comprising:

a second sand screen sub, insertable within the interior bore of said tubular liner comprising:

(a) a cylindrical hollow member having at an uphole end thereof a dissolvable plug member or burst plate which at least for a limited time substantially obstructs passage of fluid within said interior bore thereby causing pressurized fluid injected downhole in said bore of said tubular liner to force said sand screen sub downhole in said tubular liner;

(b) a cylindrical, longitudinally-extending oil-permeable screen mesh forming a portion of an outer periphery of said second sand screen sub downhole from said dissolvable plug member or burst plate thereon, which screen mesh when said sand screen sub is located proximate said one of said frac ports, underlies said one of said frac ports and prevents ingress of sand but permits ingress of oil, from said formation into the interior bore via said one of said frac ports; and (c) a retaining member on said cylindrical hollow member, which engages, directly or indirectly, said tubular liner when said second sand screen sub has flowed down said tubular liner to another of said frac ports whose corresponding sliding sleeve member has been opened on said tubular liner by a second actuation member to a position wherein the screen mesh of said sand screen sub underlies said another of said frac ports, which retaining member after engagement with said tubular liner prevents uphole displacement of said second sand screen sub in said tubular liner.

5. The system for fracking a hydrocarbon formation as claimed in claim 2, wherein the at least one sand screen sub comprises a plurality of sand screen subs, and wherein:

the retaining member on each sand screen sub possesses a unique profile or width; and the tubular liner, proximate each frac port, possesses an annular region of a corresponding unique profile or width;

wherein the retaining member on one of said sand screen subs, when said one of said sand screen subs is flowed down the tubular liner, will only engage the tubular liner at a particular annular region along said tubing liner, and the retaining member thereof after engagement with said annular region prevents longitudinal displacement of said sand screen sub from said position in said tubular liner.

6. The system for fracking a hydrocarbon formation as claimed in claim 2, wherein said at least one sand screen sub comprises a plurality of sand screen subs, and wherein:

said retaining member on each sand screen sub is of a unique width relative to a width of a retaining member on another of said sand screen subs; and wherein a retaining member of width $X_2$ on a first sand screen sub inserted downhole is of a greater width than a width $X_1$ of a retaining member on a second sand screen sub thereafter subsequently inserted downhole in said tubular liner; and said retaining member on said first sand screen sub matingly engages a corresponding annular region in said tubular liner of an equal or greater width $X_2$; and said retaining member on said second sand screen sub matingly engages a corresponding annular region of width $\geq X_1$ but $< X_2$, located uphole in said tubular liner.

7. The system for fracking a hydrocarbon formation as claimed in claim 1, wherein said at least one sand screen sub is flowable downhole to a position underlying a desired opened frac port.

8. The system for fracking a hydrocarbon formation as claimed in claim 1, wherein after said actuation member has moved a most downhole of said sliding sleeves to an open position uncovering said corresponding frac port, and said sand screen sub flowed downhole to underlie the uncovered frac port, further movement of said at least one sand screen sub downhole in said tubing liner is prevented by said sand screen sub abutting said actuation member.

9. The system for fracking a hydrocarbon formation as claimed in claim 1 or 8 wherein said actuation member is dissolvable upon a corrosive fluid being applied to said interior bore of said tubular liner.

10. A method for conducting a fracking procedure at at least one location along a wellbore situated within a hydrocarbon formation, and thereafter installing a sand screen within a tubular liner within said wellbore to prevent ingress of sand into said tubular liner, comprising the steps of:

(i) locating a tubular liner having:

a hollow interior bore;

a plurality of frac ports spaced along a periphery of said tubular liner;

a corresponding plurality of sliding sleeve members respectively initially covering each of said frac ports;

within said wellbore;

(ii) situating a first actuation member within said tubular liner to engage the first actuation member with a first one of the plurality of sliding sleeve members, said first sliding sleeve member associated with a first set of said frac ports;

(iii) actuating said first actuation member to actuate the first sliding sleeve member to uncover and thereby open the associated first set of frac ports in said tubular liner and thereby allow fluid communication from said interior bore to an exterior of said tubular liner and said hydrocarbon formation via the opened first set of frac ports;

(iv) injecting a fracking fluid into said tubular liner and causing said frac fluid to flow into the hydrocarbon formation via the opened first set of frac ports;

(v) inserting a first sand screen sub into said tubular liner, said first sand screen sub having:

a resiliently-outwardly biased protuberance having a given profile; and an annular screen mesh about an outer periphery of said first sand screen sub; and (vi) applying a pressurized fluid to an uphole end of said first sand screen sub and causing said first sand screen sub to flow downhole to a position in said tubular liner where said annular screen mesh thereof underlies said open frac port and causing said profile of said resiliently-outwardly biased protuberance thereon to engage a mating profile on an interior of said tubular liner and thereby retain said first sand screen sub in a position wherein the annular screen mesh thereof underlies said open frac port.

11. The method as claimed in claim 10, further comprising the step, after step (vi), of injecting pressurized fluid into said interior bore at a pressure sufficient to rupture a burst disk member located on said sand screen sub, so as to thereafter allow fluid to flow through said sand screen sub.

12. The method as claimed in claim 10, further comprising the step, at some time after step (iii), of dissolving a plug member in said first actuation member to allow subsequent flow of fluid through said first actuation member after said first actuation member has moved said first sliding sleeve downhole and thereby opened said associated first set of frac ports.

13. The method as claimed in claim 12, wherein said step of dissolving said plug member further comprises flowing a corrosive fluid down said tubular liner to said first actuation member.

14. The method as claimed in claim 10, further comprising the step, after step (vi), of exposing said sand screen sub to a corrosive fluid so as to dissolve a portion of said sand screen sub so as to thereafter allow fluid to flow longitudinally through said sand screen sub.

15. The method as claimed in claim 10, further comprising the step, at some time after step (iii), of flowing a corrosive fluid into said interior bore and causing said actuation member to dissolve.

16. The method as claimed in claim 10 for further conducting a fracking procedure at a plurality of spaced apart locations along said wellbore and installing sand screens within the tubular liner at each of said plurality of locations to prevent ingress of sand into the tubular liner at each of said locations, wherein after step (vi) such method further comprises carrying out the following further steps:

(vii) situating a second actuation member within said tubular liner to engage the first actuation member with a second one of the plurality of sliding sleeve members, said sliding sleeve member associated with a second set of said frac ports;

(viii) actuating said second actuation member to actuate the sliding sleeve member to uncover and thereby open the associated second set of frac ports in said tubular liner and thereby allow fluid communication from said interior bore to an exterior of said tubular liner and said hydrocarbon formation via the opened associated frac port;

(ix) injecting a fracking fluid into said tubular liner and causing said frac fluid to flow into the hydrocarbon formation via the opened second set of frac ports;

(x) situating a second sand screen sub within said tubular liner, said second sand screen sub having a resiliently-outwardly biased protuberance thereon and an annular screen mesh about an outer periphery thereof; and (xi) applying a pressurized fluid to an uphole end of said second sand screen sub and causing said second sand screen sub to flow downhole to a position in said tubular liner where said screen mesh thereon underlies said second set of frac ports, and causing said resiliently-outwardly biased protuberance on said second sand screen sub to engage a mating profile on an interior of said tubular liner proximate said second set of frac ports so as to thereby retain said second sand screen sub and said annular screen mesh thereof underlying said second set of frac ports.

17. A method for fracking a hydrocarbon formation at a plurality of clustered contiguous locations along a wellbore within said formation and installing sand screens within a tubular liner within said wellbore at each of said plurality of locations to prevent ingress of sand into the tubular liner at each of said locations, said method comprising the steps of:

(i) locating a tubular liner having:

a hollow interior bore;

a plurality of contiguous frac ports spaced along a periphery of said tubular liner;

a corresponding plurality of sliding sleeve members respectively initially covering each of said frac ports;

within said wellbore;

(ii) situating an actuation member within said tubular liner to engage the actuation member with a first one of the plurality of sliding sleeve members, said first sliding sleeve member associated with a first set of said frac ports;

(iii) actuating said actuation member to actuate the first sliding sleeve member to uncover and thereby open the associated first set of frac ports in said tubular liner and thereby allow fluid communication from said interior bore to an exterior of said tubular liner and said hydrocarbon formation via the opened first set of frac ports;

(iv) continuing to actuate said actuation member to further move downhole and engage a second one of the plurality of sliding sleeve members, said second sliding sleeve member associated with a second set of said frac ports;

(v) continuing to actuate said actuation member to actuate the first sliding sleeve member to uncover and thereby open the associated second set of frac ports in said tubular liner and thereby allow fluid communication from said interior bore to an exterior of said tubular liner and said hydrocarbon formation via the opened second set of frac ports;

(vi) injecting a fracking fluid into said tubular liner and causing said frac fluid to flow into the hydrocarbon formation via the opened first and second sets of frac ports;

(vii) situating a first sand screen sub within said tubular liner, said first sand screen sub having a resiliently-outwardly biased protuberance having a profile, and said first sand screen sub further having an annular screen mesh about an outer periphery thereof;

(viii) applying a pressurized fluid to an uphole end of said first sand screen sub and causing said first sand screen sub to flow downhole to a position in said tubular liner where said annular screen mesh thereof underlies said second set of open frac ports and causing said profile of said protuberance thereon to engage a mating profile on an interior of said tubular liner and thereby retain said first sand screen sub and said annular screen mesh thereof underlying said second set of open frac ports;

(ix) situating a second sand screen sub within said tubular liner, said second sand screen sub having a resiliently-outwardly biased protuberance having a profile different than the profile of the protuberance on said first sand screen sub, and likewise having an annular screen mesh about an outer periphery thereof;

(x) applying a pressurized fluid to an uphole end of said second sand screen sub and causing said second sand screen sub to flow downhole to a position in said tubular liner where said annular screen mesh thereof underlies said first set of open frac ports, and causing said profile of said protuberance thereon to engage a mating profile on an interior of said tubular liner and thereby retain said second sand screen sub and said annular screen mesh thereof underlying said first set of open frac ports.

18. The method as claimed in claim 17, further comprising the step, after step (vi), of injecting pressurized fluid into said interior bore at a pressure sufficient to rupture a burst disk member located on said first or second sand screen sub, so as to thereafter allow fluid to flow through said first or second sand screen sub.

19. The method as claimed in claim 17, further comprising the step, after step (vi), of exposing said actuation member to a corrosive fluid so as to dissolve a portion of said actuation member so as to thereafter allow fluid to flow through said actuation member.

20. The method as claimed in claim 17, further comprising the step, sometime after step (v), of exposing said actuation member to a corrosive fluid so as to dissolve all or substantially all of said actuation member.

21. The method as claimed in claim 17, further comprising the step, after step (vii), of exposing said first sand screen sub to a corrosive fluid so as to dissolve a portion of said first sand screen sub so as to thereafter allow fluid to flow longitudinally through said first sand screen sub.

22. The method as claimed in claim 17, further comprising the step, after step (ix), of exposing said second sand screen sub to a corrosive fluid so as to dissolve a portion of said second sand screen sub so as to thereafter allow fluid to flow longitudinally through said second sand screen sub.

23. A method for successively uncovering spaced-apart frac ports situated along a hollow tubular liner, carrying out a fracking operation at each uncovered frac port, and installing a sand screen at each of said uncovered frac ports, comprising the steps of:

(i) locating an actuation member in said tubular liner, said tubular liner initially having a plurality of sliding sleeve members respectively covering a corresponding plurality of said spaced-apart frac ports along said tubular liner;

(ii) flowing said actuation member downhole to engage one of the plurality of sliding sleeve members covering an lowermost covered frac port along said tubular liner, and actuate said actuation member and said lowermost sliding sleeve member to together move downhole and thereby uncover an associated of said ports in said tubular liner;

(iii) injecting a pressurized frac fluid into said tubular liner to frac the formation at the location of the opened frac port;

(iv) injecting a sand screen sub down said tubular liner, said sand screen sub having a resiliently-outwardly biased protruding member thereon, wherein upon the sand screen sub reaching said first actuation member, the resiliently-outwardly biased protruding member then engages a mating profile on an interior of said tubular liner and thereby retains the sand screen sub in a position underlying said opened port and said protruding member thereafter prevents said sand screen sub from moving back uphole; and (v) repeating steps (i)-(iv) until all of said plurality of spaced-apart ports along said tubular liner have been uncovered, the wellbore fracked at each opened frac port, and sand screen subs installed at each opened frac port.

24. A sand screen sub insertable within an interior bore of a tubular liner and displaceable within said tubular liner to a location therein proximate one or more opened frac ports in said tubular liner, said sand screen sub comprising:

(a) a cylindrical hollow member having at an uphole end thereof a dissolvable plug member or burst plate, said dissolvable plug member or burst plate being configured for, when said sand screen sub is inserted within the interior bore, at least for a limited time substantially obstructing passage of fluid within said interior bore thereby causing pressurized fluid injected downhole in said bore of said tubular liner to force said sand screen sub downhole in said tubular liner; and (b) a cylindrical, longitudinally-extending oil-permeable screen mesh forming a portion of an outer periphery of said sand screen sub downhole from said dissolvable plug member or burst plate thereon, wherein said screen mesh is configured for, when said sand screen sub is located proximate said one or more opened frac ports, underlying said one or more opened frac ports, and preventing ingress of sand but permitting ingress of oil, from said formation into the interior bore via said one or more opened frac ports.

25. The sand screen sub as claimed in claim 24 further comprising:

(c) a resiliently outwardly biased retaining member configured for directly or indirectly engaging with a mating profile on said tubular liner and preventing uphole displacement of said sand screen sub in said tubular liner when said sand screen sub has flowed down said tubular liner to said one or more opened frac ports, and the screen mesh of said sand screen sub underlies said one or more opened frac ports.

26. The sand screen sub as claimed in claim 25, wherein said resiliently outwardly biased retaining member on said at least one sand screen sub has a chamfer on a downhole side edge thereof and a flat face on an uphole side edge thereof perpendicularly disposed to a longitudinal axis of said tubular liner; and wherein downhole movement of said at least one sand screen sub in said tubular liner is allowed by said chamfer causing said resiliently outwardly biased retaining member to become radially depressed upon fluid pressure being exerted on an uphole side of said sand screen sub; and wherein uphole movement in said sand screen sub is prevented, when said screen mesh of said sand screen sub underlies said one or more opened frac ports, by said flat face engaging, directly or indirectly, an annular region in said tubular liner.

* * * * *